US005352573A

United States Patent [19]

Seto et al.

[11] Patent Number: 5,352,573

[45] Date of Patent: * Oct. 4, 1994

[54] SILVER HALIDE COLOR PHOTOGRAPHIC LIGHT-SENSITIVE MATERIAL

[75] Inventors: Nobuo Seto; Yasuhiro Yoshioka; Makoto Suzuki; Masakazu Morigaki, all of Kanagawa, Japan

[73] Assignee: Fuji Photo Film Co., Ltd., Kanagawa, Japan

[ * ] Notice: The portion of the term of this patent subsequent to Oct. 26, 2010 has been disclaimed.

[21] Appl. No.: 982,439

[22] Filed: Nov. 27, 1992

[30] Foreign Application Priority Data

Nov. 27, 1991 [JP] Japan ..... 3-335851

[51] Int. Cl.[5] ..... G03C 7/38; G03C 1/34

[52] U.S. Cl. ..... 430/551; 430/558; 430/384; 430/385

[58] Field of Search ..... 430/558, 551, 607, 610, 430/384, 385

[56] References Cited

U.S. PATENT DOCUMENTS

| | | | |
|---|---|---|---|
| 4,782,011 | 11/1988 | Goddard et al. | 430/551 |
| 4,910,127 | 3/1990 | Sakaki et al. | 430/558 |
| 4,980,275 | 12/1990 | Goddard | 430/372 |
| 5,049,482 | 9/1991 | Nishijima et al. | 430/551 |
| 5,059,515 | 10/1991 | Leppard | 430/607 |
| 5,104,782 | 4/1992 | Seto et al. | 430/551 |
| 5,139,931 | 8/1992 | Seto et al. | 430/558 |
| 5,178,991 | 1/1993 | Morigaki et al. | 430/553 |
| 5,256,526 | 10/1993 | Suzuki et al. | 430/556 |

FOREIGN PATENT DOCUMENTS

| | | |
|---|---|---|
| 0342637 | 11/1989 | European Pat. Off. . |
| 0488248 | 6/1992 | European Pat. Off. . |
| 0491197 | 6/1992 | European Pat. Off. . |

*Primary Examiner*—Lee C. Wright

*Attorney, Agent, or Firm*—Sughrue, Mion, Zinn, Macpeak & Seas

[57] ABSTRACT

A silver halide color photographic light-sensitive material having an improved color forming property, color reproducibility and image preservative performance is described. The light-sensitive material comprises a support having provided thereon at least one silver halide emulsion layer comprising (a) a cyan dye-forming coupler represented by the following formulas (I) or (II):

(I)

(II)

wherein Za, Zb, $R_1$, $R_2$ and X represent substituents described herein; (b) a compound represented by the following formula (A):

(A)

wherein $R_{a1}$–$R_{a6}$ represent substituents described herein.

17 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, more specifically to a silver halide color photographic light-sensitive material for which a pyrroloazole type cyan coupler and a specific compound are used to improve color forming property, color reproducibility and image preservative performance.

BACKGROUND OF THE INVENTION

In general, a silver halide color photographic light-sensitive material has three silver halide emulsion layers which are light-sensitive to the three primary colors of red, green and blue, respectively. A dye image is reproduced by a process in which three kinds of couplers contained in the respective emulsion layers are subjected to color development in a relationship of complementary colors with the colors to which the respective layers are sensitive, a so-called substractive color process. A dye image obtained by photographically processing a silver halide color photographic light-sensitive material generally comprises an azomethine dye or an indoaniline dye, each formed by reacting an oxidation product of an aromatic primary amine color developing agent with a coupler.

In this silver halide color photographic light-sensitive material, a phenol type or naphthol type cyan coupler is generally used for forming a cyan dye image. However, the dyes formed by these couplers have unfavorable absorptions in the blue color and green color regions and therefore have serious problems due to a marked deterioration in color reproducibility.

2,4-Diphenylimidazoles, described in European Patent Application 0 249 453 A2, have been proposed as a means for solving this problem. The dyes formed by these couplers have less unfavorable absorptions in a short wavelength region as compared with the dyes formed by the conventional cyan couplers and are preferable in terms of a color reproducibility.

However, these couplers are not deemed to have enough color reproducibility and in addition, there still remains the practical problem that the coupling activity is low and that the fastness to heat and light is notably low.

Further, the pyrazoloazole type couplers described in JP-A-64-552 (the term "JP-A" as used herewith means an unexamined published Japanese patent application), JP-A-64-553, JP-A-64-554, JP-A-64-555, JP-A-64-556, and JP-A-64-557 are improved in an absorption in a short wavelength region as compared with the dyes formed by the conventional cyan couplers but are not deemed to have enough color forming property and color reproducibility as a cyan coupler.

Meanwhile, for the purpose of improving the fastness of the dye obtained from the phenol type and naphthol type cyan couplers generally used, there have been proposed UV absorbers, epoxy compounds and phenylenediamine compounds in JP-A-50-151149, U.S. Pat. No. 4,239,851 and JP-A-62-178963; the compounds obtained by subjecting the phenolic hydroxyl groups of phenols, hydroquinones and catechols to etherification, esterification, silylesterification and phosphoric acid esterification in JP-A-56-11453, JP-A-61-167953, JP-A-64-46751, and JP-A-1-284852; phenols, chromanols, hydroquinones, catechols, and amines in JP-A-63-85547, JP-A-63-98661, JP-A-53-77527, JP-A-62-232650, JP-A-62-210465, and JP-A-l-137257; and amide compounds and high molecular amide compounds in European Patent Application 0 268 496 A and JP-A-2-43541; and metal complexes in JP-A-62-121456 and 62-121457.

However, these compounds do not exert sufficient effect to the phenol type and naphthol type cyan dyes; while same compounds show the desired effect on the light fastness, they do not adequately effect the heat fastness or on the contrary, they deteriorate it. Alternatively, if these compounds show the desired effect on the heat fastness, on the contrary, they deteriorate the light fastness.

Further, for the purpose of improving the fastness of a dye obtained from a pyrazoloazole type cyan coupler and an imidazole type cyan coupler, there are proposed UV absorbers proposed for the phenol type and naphthol type cyan couplers, hindered phenols, hindered amines, amides, high molecular amides, phosphorus compounds, hydroquinones, and catechols in JP-A-l-149045, JP-A-l-156744, JP-A-l-156745, JP-A-1-295257, JP-A-1-230042, and JP-A-l-156746. However, while unnecessary subabsorptions in a short wavelength region are small, they are insufficient for improving the fastness.

Further, the combined uses of the azomethine dyes obtained from the pyrroloazole type dye-forming couplers and the anti-fading agents having a specific structure are disclosed in JP-A-62-289837, JP-A-62-291647, JP-A-62-291650, and JP-A-62-291653. However, these anti-fading agents have a weak anti-fading effect since the dyes obtained from these couplers are magenta dyes.

SUMMARY OF THE INVENTION

The first object of the present invention is to provide a silver halide color photographic light-sensitive material capable of providing a dye image having an excellent color reproducibility, no discoloration over a long period of time and a high storing performance.

The second object of the present invention is to provide a silver halide color photographic light-sensitive material having depressed fog, a sufficient effect for preventing discoloring and fading of the dye image without badly affecting the color forming property, containing an anti-fading agent generating no fine crystals after coating, and having excellent fastness.

The third object of the present invention is to provide a silver halide color photographic light-sensitive material having an excellent color reproducibility and a dye image and background which do not discolor over a long period of time and which show less varied color forming property even after storage for a long period of time after coating.

The fourth object of the present invention is to provide a silver halide color photographic light-sensitive material having an excellent color reproducibility, less discoloration of the background even after storing a dye image over a long period of time, and a less collapsed balance of the yellow, magenta and cyan colors.

Various investigations made by the present inventors have resulted in finding that the above objects can be achieved by a silver halide color photographic light-sensitive material comprising a support having provided thereon at least one silver halide emulsion layer comprising (a) a cyan dye-forming coupler represented by the following formulas (I) or (II):

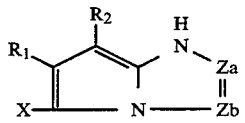

(I)

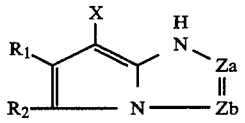

(II)

wherein Za and Zb each represent —C($R_3$)= or —N=, provided that either one of Za and Zb is —N= and the other is —C($R_3$)=; $R_1$ and $R_2$ each are an electron attractive group having a Hammett's substituent constant $\sigma_p$ of 0.20 or more and the sum of the $\sigma_p$ values of $R_1$ and $R_2$ is 0.65 or more; $R_3$ represents a hydrogen atom or a substituent; X represents a hydrogen atom or a group capable of splitting off upon a reaction with an oxidation product of an aromatic primary amine color developing agent; and the group represented by $R_1$, $R_2$, $R_3$ or X may become a divalent group and combine with a monomer higher than a dimer and a high molecular weight chain to form a homopolymer or a copolymer; and (b) a compound represented by the following formula (A):

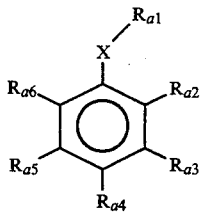

(A)

wherein $R_{a1}$ represents an aliphatic group, an aromatic group, a heterocyclic group, —Si($Ra_7$)($R_{a8}$)($R_{a9}$), —CO($R_{a10}$), —$SO_2$($R_{a11}$), or —P(O)$_n$($R_{a12}$)($R_{a13}$); $R_{a2}$, $R_{a3}$, $R_{a4}$, $R_{a5}$ and $R_{a6}$ may be the same or different and each represent a hydrogen atom, —X'—$R_{a1}$, an aliphatic group, an aromatic group, a heterocyclic group, aliphatic oxycarbonyl group, an aromatic oxycarbonyl group, a halogen atom, an acyl group, a sulfonyl group, a carbamoyl group, a sulfamoyl group, a cyano group, a nitro group, a sulfo group, or a carboxyl group; —X— represents —O— or —N($R_{a1}$')—; —X'— represents —O—, —S— or —N($R_{a1}$')—; $R_{a7}$, $R_{a8}$ and $R_{a9}$ may be the same or different and each represent an aliphatic group, an aromatic group, an aliphatic oxy group, or an aromatic oxy group; $R_{a10}$ and $R_{a11}$ each represent an aliphatic group, an aromatic group, an aliphatic amino group, or an aromatic amino group; $R_{a12}$ and $R_{a13}$ may be the same or different and each represent an aliphatic group, an aromatic group, an aliphatic oxy group, or an aromatic oxy group; n represents 0 or 1; and $R_{a1}$' represents a hydrogen atom or a group defined for $R_{a1}$.

In formula (A), of the respective groups of —X—$R_{a1}$ and $R_{a2}$ to $R_{a6}$, the groups located in an ortho position to each other may be combined to form a 5 to 8-membered ring. Further, where —X— or —X'— is —N($R_{a1}$')—, $R_{a1}$ and $R_{a1}$' may be combined with each other to form a 5 to 8-membered ring.

DETAILED EXPLANATION OF THE INVENTION

The present invention will be explained below in detail.

Hammett's rule was proposed by L. P. Hammett in 1935 in order to quantitatively discuss the affects exerted to a reaction or equilibrium of a benzene derivative by a substituent. This rule is well known and widely accepted in the art.

The $\sigma_p$ value and $\sigma_m$ value are available as the substituent constants obtained according to Hammett's rule and the values thereof are described in numerous publications, including, for example, *Lange's Handbook of Chemistry* vol. 12, edited by J. A. Dean, 1979 (McGrow-Hill) and *Chemical Region* (Kagaku no Ryoiki) No. 122, pp. 96 to 103, 1979 (Nankohdo). In the present invention, the respective groups are regulated and described by the Hammett's substituent constant $\sigma_p$ value but this does not mean that they are limited to the substituents in which the $\sigma_p$ values are described in these publications. It should be clear that even the $\sigma_p$ values of groups which are not described in these publications are included in the scope of the present invention as long as these values are included in the above range when they are measured according to Hammett's rule.

The compounds of the present invention represented by formulas (I) and (II) are not benzene derivatives but the $\sigma_p$ values will be used as a scale showing the electron effect of a substituent regardless of a substitution position. In the present invention, hereinafter the $\sigma_p$ values will be used in such sense.

In the instant specification, the "aliphatic" series may be linear or branched, and saturated or unsaturated. For example, the aliphatic series may represent an alkyl group, an alkenyl group, an alkynyl group, a cycloalkyl group, or a cycloalkenyl group, which in turn may also have further substituents. The aliphatic series preferably contains from 1 to 40 total carbon atoms including carbon atoms of the substituents.

The "aromatic" series represents aryl and this may further have a substituent. The aromatic series contains from 6 to 46 total carbon atoms including carbon atoms of the substituents.

The "heterocyclic" series is a ring having a hereto atom such as nitrogen, oxygen or sulfur to form a 5-membered to 8-membered ring and includes an aromatic group. It may further have a substituent. It preferably contains from 1 to 40 total carbon atoms including carbon atoms of the substituents.

The substituents in the instant specification and the substituents that the above-defined aliphatic, aromatic and heterocyclic series may have may be any of the substitutable groups, unless otherwise stated. These substituents include, for example, an aliphatic group, an aromatic group, a heterocyclic group, an acyl group, an acyloxy group, an acylamino group, an aliphatic oxy group, an aromatic oxy group, a heterocyclic oxy group, an aliphatic oxycarbonyl group, an aromatic oxycarbonyl group, a heterocyclic oxycarbonyl group, an aliphatic carbamoyl group, an aromatic carbamoyl group, an aliphatic sulfonyl group, an aromatic sulfonyl group, an aliphatic sulfamoyl group, an aromatic sulfamoyl group, an aliphatic sulfonamide group, an aromatic sulfonamide group, an aliphatic amino group, an aromatic amino group, an aliphatic carbamoylamino group, an aromatic carbamoylamino group, an aliphatic sulfamoylamino group, an aromatic sulfamoylamino group, an aliphatic sulfinyl group, an aromatic sulfinyl group, an aliphatic thio group, an aromatic thio group, a mercapto group, a hydroxy group, a cyano group, a nitro group, a hydroxyamino group, an aliphatic oxycarbonylamino group, an aromatic oxycarbonylamino group, a silyl group, a phosphoryl group, and a halogen atom.

When one or more groups in the instant specification contain carbon atom(s), the carbon number is preferably 70 or less, more preferably 50 or less unless otherwise indicated, provided that the group forming a homopolymer or a copolymer by combining with a monomer higher than a dimer and a high molecular weight chain is excluded therefrom.

The cyan coupler of the present invention will be described below in detail.

Za and Zb each represent —C($R_3$)= or —N=, provided that when either one of Za and Zb is —N= the other is —C($R_3$)=. The cyan couplers of the present invention are represented by the following formulas (I-a), (I-b), (II-a) or (II-b):

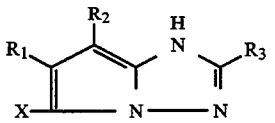
(I-a)

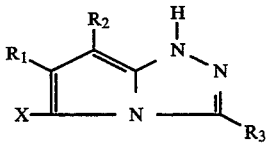
(I-b)

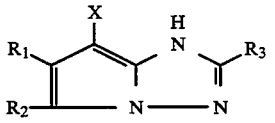
(II-a)

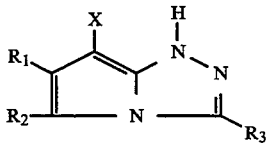
(II-b)

wherein $R_1$, $R_2$, $R_3$ and X represent the same ones as those defined for $R_1$, $R_2$, $R_3$ and X in formulas (I) and (II), respectively.

$R_3$ represents a hydrogen atom or a substitutent, said substituent including, a halogen atom, an alkyl group, an aryl group, a heterocyclic group, a cyano group, a hydroxy group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group. These groups may further be substituted with the substituents exemplified in $R_3$.

More specifically, $R_3$ represents a hydrogen atom, a halogen atom (for example, a chlorine atom and a bromine atom), an alkyl group (for example, a linear or branched alkyl group having 1 to 32 carbon atoms, an aralkyl group, an alkenyl group, an alkynyl group, a cycloalkyl group, and a cycloalkenyl group, and to be more detailed, methyl, ethyl, propyl, isopropyl, t-butyl, tridecyl, 2-methanesulfonylethyl, 3-(3-pentadecylphenoxy) propyl, 3-[4-{2-[4-(4-hydroxyphenylsulfonyl) phenoxy] dodecanamido} phenyl] propyl, 2-ethoxytridecyl, trifluoromethyl, cyclopentyl, and 3-(2,4-di-t-amylphenoxy) propyl), an aryl group (for example, phenyl, 4-t-butylphenyl, 2,4-di-t-amylphenyl, and4-tetradecanamidophenyl), a heterocyclic group (for example, 2-furyl, 2-thienyl, 2-pyrimidinyl, and 2-benzothiazolyl), a cyano group, a hydroxy group, a nitro group, a carboxy group, a sulfo group, an amino group, an alkoxy group (for example, methoxy, ethoxy, 2-methoxyethoxy, 2-dodecylethoxy, and 2-methanesulfonylethoxy), an aryloxy group (for example, phenoxy, 2-methylphenoxy, 4-t-butylphenoxy, 3-nitrophenoxy, 3-t-butyloxycarbamoyl-phenoxy, and 3-methoxycarbamoyl-phenoxy), an acylamino group (for example, acetamido, benzamido, tetradecanamido, 2-(2,4-di-t-amylphenoxy) butanamido, 4-(3-t-butyl-4-hydroxyphenoxy) butanamido, and 2-[4-(4-hydroxyphenyl-sulfonyl) phenoxy] decanamido), an alkylamino group (for example, methylamino, butylamino, dodecylamino, diethylamino, and methylbutylamino), an anilino group (for example, phenyl-amino, 2-chloranilino, 2-chloro-5-tetradecanaminoanilino, 2-chloro-5-dodecyloxycarbonylanilino, N-acetylanilino, and 2-chloro-5-[2-(3-t-butyl-4-hydroxphenoxy) dodecanamido] anilino), a ureido group (for example, phenylureido, methylureido, and N,N-dibutylureido), a sulfamoylamino group (for example, N,N-dipropylsulfamoylamino, and N-methyl-N-decyl-sulfamoylamino), an alkylthio group (for example, methylthio, octylthio, tetradecylthio, 2-phenoxyethylthio, 3-phenoxypropylthio, and 3-(4-t-butyl-phenoxy) propylthio), an arylthio group (for example, phenylthio, 2-butoxy-5-t-octylphenylthio, 3-pentadecyl-phenylthio, 2-carboxyphenylthio and 4-tetradecanamido-phenylthio), an alkoxycarbonylamino group (for example, methoxycarbonylamino and tetradecyloxycarbonylamino), a sulfonamido group (for example, methanesulfonamido, hexadecanesulfonamido, benzenesulfonamido, p-toluene-sulfonamido, octadecanesulfonamido, and 2-methoxy-5-t-butylbenzenesulfonamido), a carbamoyl group (for example, N-ethylcarbamoyl, N, N-dibutylcarbamoyl, N- (2-dodecyloxyethyl) carbamoyl, N-methyl-N-dodecylcarbamoyl, and N-[3-(2,4-di-t-amylphenoxy) propyl] carbamoyl), a sulfamoyl group (for example, N-ethylsulfamoyl, N,N-dipropyl-sulfamoyl, N-(2-dodecyloxyethyl) sulfamoyl, N-ethyl-N-dodecylsulfamoyl, and N,N-diethylsulfamoyl), a sulfonyl group (for example, methanesulfonyl, octanesulfonyl, benzenesulfonyl, and toluenesulfonyl), an alkoxycarbonyl group (for example, methoxycarbonyl, butyloxycarbonyl, dodecyloxycarbonyl, and octadecyloxycarbonyl), a heterocyclic oxy group (for example, 1-phenyltetrazole-5-oxy, and 2-tetrahydropyranyloxy), an azo group (for example, phenylazo, 4-methoxyphenylazo, 4-pivaloylaminophenylazo, and 2-hydroxy-4-propanoylphenylazo), an acyloxy group (for example, acetoxy), a carbamoyloxy group (for example, N-methylcarbamoyloxy and N-phenylcarbamoyloxy), a silyloxy group (for example, trimethylsilyloxy and dibutylmethylsilyloxy), an aryloxycarbonylamino group (for example, phenoxycarbonylamino), an imido group (for example, N-succinimido, N-phthalimido, and 3-octadecenylsuccinimido), a heterocyclic thio group (for example, 2-benzothiazolyl-thio, 2,4-di-phenoxy-1,3,5-triazole-6-thio, and 2-pyridylthio), a sulfinyl group (for example, dodecanesulfinyl, 3-pentadecylphenyl-sulfinyl, and 3-phenoxypropylsulfinyl), a phosphonyl group (for example, phenoxyphosphonyl, octyloxyphosphonyl, and phenylphosphonyl), an aryloxycarbonyl group (for example, phenoxycarbonyl), an acyl group (for example, acetyl, 3-phenylpropanoyl, benzoyl, and 4-dodecyloxybenzoyl), and an azolyl group (for example, imidazolyl, pyrazolyl, 3-chloropyrazole-1-yl, and triazolyl).

Preferred substituents of $R_3$ include, an alkyl group, an aryl group, a heterocyclic group, a cyano group, a nitro group, an acylamino group, an anilino group, a ureido group, a sulfamoylamino group, an alkylthio group, an arylthio group, an alkoxycarbonyl-amino group, a sulfonamido group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, a phosphonyl group, an aryloxycarbonyl group, an acyl group, and an azolyl group.

$R_3$ is further preferably an alkyl group or an aryl group. It is more preferably an alkyl group or aryl group having at least one substituent from the viewpoint of a flocculation property, and further preferably an alkyl group or aryl group each having at least one alkoxy group, sulfonyl group, sulfamoyl group, carbamoyl group, acylamido group, or sulfonamido group as a substituent. $R_3$ is particularly preferred to be an alkyl group or aryl group each having at least one acylamido group or sulfonamido group as a substituent. These substituents substituted on the aryl group are more preferably substituted at least on an ortho position. The alkyl group is more preferably a secondary or tertiary alkyl group which is branched at the $\alpha$ position.

In the cyan coupler of the present invention, $R_1$ and $R_2$ each are an electron attractive group having the $\sigma_p$ value of 0.2 or more, and the value of 0.65 or more in the total of the $\sigma_p$ values of $R_1$ and $R_2$ makes it possible to develop a color to form a cyan dye image. The total of the $\sigma_p$ values of $R_1$ and $R_2$ is preferably 0.70 or more and the upper limit thereof is not much more than 1.8.

$R_1$ and $R_2$ each are an electron attractive group having the Hammett's substituent constant $\sigma_p$ of 0.20 or more, preferably 0.30 or more. The upper limit thereof is 1.0 or less.

Examples of the groups represented by $R_l$ and R2 which are electron attractive groups having the $\sigma_p$ values of 0.20 or more include, an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkyl-sulfinyl group, an arylsulfinyl group, an alkyl-sulfonyl group, an arylsulfonyl group, a sulfonyloxy group, an acylthio group, a sulfamoyl group, a thiocyanato group, a thiocarbonyl group, a halogenated alkyl group, a halogenated alkoxy group, a halogenated aryloxy group, a halogenated alkylamino group, a halogenated alkylthio group, an aryl group substituted with the other electron attractive group having $\sigma_p$ of 0.20 or more, a heterocyclic group, a halogen atom, an azo group, and a selenocyanato group. Of these substituents, the groups capable of further having the substituents may further have the substituents given for the groups defined for $R_3$.

More specifically, examples of the electron attractive groups having the $\sigma_p$ values of 0.20 or more include, an acyl group preferably having 1 to 50 carbon atoms (for example, acetyl, 3-phenylpropanoyl, benzoyl, and 4-dodecyloxybenzoyl), an acyloxy group preferably having 1 to 50 carbon atoms (for example acetoxy), a carbamoyl group preferably having 0 to 50 carbon atoms (for example, carbamoyl, N-ethylcarbamoyl, N-phenylcarbamoyl, N,N-dibutylcarbamoyl, N-(2-dodecyloxyethyl) carbamoyl, N-(4-n-pentadecanamido)phenylcarbamoyl, N-methyl-N-dodecylcarbamoyl, and N-[3-(2,4-di-t-amylphenoxy) propyl] carbamoyl), an alkoxycarbonyl group preferably having a straight chain, branched or cyclic alkyl moiety of 1 to 50 carbon atoms (for example, methoxycarbonyl, ethoxycarbonyl, isopropyloxycarbonyl, tert-butyloxycarbonyl, isobutyloxycarbonyl, butyloxycarbonyl, dodecyloxycarbonyl, and octadodecyloxycarbonyl), an aryloxycarbonyl group preferably having 6 to 50 carbon atoms (for example, phenoxycarbonyl), a cyano group, a nitro group, a dialkylphosphono group preferably having 2 to 50 carbon atoms (for example, dimethylphosphono), a diarylphosphono group preferably having 12 to 50 carbon atoms (for example, diphenylphosphono), a diarylphosphinyl group (for example, diphenylphosphinyl), an alkylsulfinyl group preferably having 1 to 50 carbon atoms (for example, 3-phenoxypropylsulfinyl), an arylsulfinyl group preferably having 6 to 50 carbon atoms (for example, 3-pentadecylphenylsulfinyl), an alkylsulfonyl group preferably having 1 to 50 carbon atoms (for example, methanesulfonyl and octanesulfonyl), an arylsulfonyl group preferably having 6 to 50 carbon atoms (for example, benzenesulfonyl and toluenesulfonyl), a sulfonyloxy group preferably having 1 to 50 carbon atoms (for example, methanesulfonyloxy and toluenesulfonyloxy), an acylthio group preferably having 1 to 50 carbon atoms (for example, acetylthio and benzoylthio), a sulfamoyl group preferably having 0 to 50 carbon atoms (for example, N-ethylsulfamoyl, N,N-dipropylsufamoyl, N-(2-dodecyloxyethyl) sulfamoyl, N-ethyl-N-dodecylsulfamoyl, and N,N-diethylsulfamoyl), a thiocyanato group, a thiocarbonyl group preferably having 1 to 50 carbon atoms (for example, methylthiocarbonyl and phenylthiocarbonyl), a halogenated alkyl group preferably 1 to 10 carbon atoms (for example, trifluoromethane and heptafluoropropane), a halogenated alkoxy group preferably having 1 to 10 carbon atoms (for example, trifluoromethyloxy), a halogenated aryloxy group (for example, pentafluorophenyloxy), a halogenated alkylamino group (for example, N,N-di-(trifluoromethyl)-amino), a halogenated alkylthio group (for example, difluoromethylthio and 1,1,2,2-tetrafluoroethylthio), an aryl group substituted with the other electron attractive group having $\sigma_p$ of 0.20 or more (for example, 2,4-dinitrophenyl, 2,4,6-trichlorophenyl, and penta-chlorophenyl), a heterocyclic group (for example, 2-benzoxazolyl, 2-benzo-thiazolyl, 1-phenyl-2-benzimidazolyl, 5-chloro-1-tetrazolyl, and 1-pyrrolyl), a halogen atom (for example, a chlorine atom and a bromine atom), an azo group (for example, phenylazo), and a selenocyanato group. Of these substituents, the groups capable of further having the substituents may further have the substituents given for the groups defined for $R_3$.

Preferable substituents represented by $R_1$ and $R_2$ include, an acyl group, an acyloxy group, a carbamoyl group, an alkoxycarbonyl group, an aryloxy-carbonyl group, a cyano group, a nitro group, an alkylsulfinyl group, an arylsulfinyl group, an alkyl-sulfonyl group, an arylsulfonyl group, a sulfamoyl group, a halogenated alkyl group, a halogenated alkoxy group, a halogenated alkylthio group, a halogenated aryloxy group, an aryl group substituted with the other electron attractive group having $\sigma_p$ of 0.2 0 or more, and a heterocyclic group. More preferred are an alkoxy-carbonyl group, a nitro group, a cyano group, an arylsulfonyl group, a carbamoyl group, and a halogenated alkyl group.

Most preferred as $R_1$ is a cyano group. Particularly preferred as $R_2$ is an alkoxycarbonyl group and most preferred is a branched alkoxycarbonyl group.

X represents a hydrogen atom or a group capable of splitting off by the coupling reaction with an oxidation product of an aromatic primary amine color developing agent. More specifically, X may represent a halogen atom, an alkoxy group, an aryloxy group, an acyloxy group, an alkyl or arylsulfonyloxy group, an acylamino group, an alkyl or arylsulfonamido group, an alkoxycarbonyloxy group, an aryloxycarbonyloxy group, an alkyl, aryl or heterocyclic thio group, a carbamoylamino group, a 5 -membered or 6 -membered nitrogen-containing heterocyclic group, an imido group, and an arylazo group. These groups may further be substituted with the groups listed as the substituents for $R_3$.

To be more detailed, X may represent a halogen atom (for example, a fluorine atom, a chlorine atom and a bromine atom), an alkoxy group (for example, ethoxy, dodecyloxy, methoxyethylcarbamoylmethoxy, carboxypropyl-oxy, methylsulfonylethoxy, and ethoxycarbonylmethoxy), an aryloxy group (for example, 4-methylphenoxy, 4-chloro-phenoxy, 4-methoxyphenoxy, 4-carboxyphenoxy, 3-ethoxycarboxyphenoxy, 3-acetylaminophenoxy, and 2-carboxylphenoxy), an acyloxy group (for example, acetoxy, tetradecanoyloxy, and benzoyloxy), an alkyl or arylsulfonyloxy group (for example, methanesulfonyloxy and toluene-sulfonyloxy), an acylamino group (for example, dichloroacetylamino and heptafluorobutylyl-amino), an alkyl or arylsulfonamido group (for example, methanesulfonamido, trifluoromethanesulfonamido, and p-toluenesulfonylamino), an alkoxycarbonyloxy group (for example, ethoxycarbonyloxy and benzyloxycarbonyloxy), an aryloxycarbonyloxy group (for example, phenoxycarbonyl-oxy), an alkyl, aryl or heterocyclic thio group (for example, dodecylthio, 1-carboxydodecylthio, phenylthio, 2-butoxy-5-t-octylphenylthio, and tetrazolylthio), a carbamoylamino group (for example, N-methylcarbamoyl-amino and N-phenylcarbamoylamino), a 5-membered or 6-membered nitrogen-containing heterocyclic group (for example, imidazolyl, pyrazolyl, triazolyl, tetrazolyl, and 1,2-dihydro-2-oxo-1-pyridyl), an imido group (for example, succinimido and hydantoinyl), and an arylazo group (for example, phenylazo and 4-methoxyphenylazo). In addition to the above groups, X may be of the form of a splitting group having a bond via a carbon atom in a bis type coupler in some cases, which can be obtained by condensing a tetraequivalent coupler with aldehydes or ketones. Further, X may contain a photographically useful group such as a development inhibitor and a development accelerator.

X is preferably a halogen atom, an alkoxy group, an aryloxy group, an alkyl or arylthio group, or a 5-membered or 6-membered nitrogen-containing heterocyclic group bonded to a coupling active site via the nitrogen atom. X is more preferably a halogen atom, or an alkyl or arylthio group. Particularly preferred is an arylthio group.

In the cyan coupler represented by formula (I) or (II), the group represented by $R_1$, $R_2$, $R_3$ or X may become a divalent group and combine with a polymer higher than a dimer and a high molecular weight chain to form a homopolymer or a copolymer. The typical example of the homopolymer or copolymer formed by combining the high molecular weight chain is a homopolymer or copolymer of an addition polymer ethylene type unsaturated compound having a cyan coupler residue represented by formula (I) or (II). In this instance, one or more kinds of a cyan color development repeating unit having the cyan coupler residue represented by formula (I) or (II) may be contained in the polymer and one or more kinds of a non-color developable ethylene type monomer may be contained therein as a copolymerization component. The cyan color development repeating unit having the cyan coupler residue represented by formula (I) or (II) is represented preferably by the following formula (P):

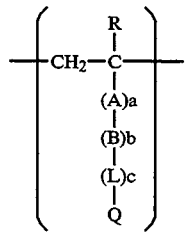

(P)

wherein R represents a hydrogen atom, an alkyl group having 1 to 4 carbon atoms, or a chlorine atom; A represents —CONH—, —COO—, or a substituted or unsubstituted phenylene group; B represents a substituted or unsubstituted alkylene group, phenylene group or aralkylene group; L represents —CONH—, —NHCONH—, —NHCOO—, —NHCO—, —OCONH—, —NH—, —COO—, —OCO—, —CO—, —O—, —S—, —$SO_2$—, —$NHSO_2$—, or —$SO_2NH$—; a, b and c each represent 0 or 1; and Q represents a cyan coupler residue of the compound represented by formula (I) or (II), in which a hydrogen atom splits off from $R_1$, $R_2$, $R_3$ or X.

In the formula (P), preferably R is a hydrogen atom or a methyl group, A is —CONH—, B is a phenylene group or an alkylene group, L is —CONH—, and a, b and c each is 0 or 1.

Preferably the polymer is a copolymer of a cyan color developing monomer represented by a coupler unit of formula (I) or (II) and a non-color developable ethylene type monomer subjected to no coupling with an oxidation product of an aromatic primary amine developing agent.

Non-color developable ethylene type monomer subjected to no coupling with an oxidation product of an aromatic primary amine developing agent which may be used include, acrylic acid, α-chloroacrylic acid, α-alkylacrylic acid (for example, methacrylic acid), amide or ester derived from these acrylic acids (for example, acrylamide, methacrylamide, n-butylacrylamide, t-butylacrylamide, diacetone acrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxy methacrylate), vinyl ester (for example, vinyl acetate, vinyl propionate, and vinyl laurate), acrylonitrile, methacrylonitrile, an aromatic vinyl compound (for example, styrene and the derivatives thereof, for example, vinyl toluene, divinylbenzene, vinyl acetophenone, and sulfostyrene), itaconic acid, citraconic acid, crotonic acid, vinylidene chloride, vinyl alkyl ether (for example, vinyl ethyl ether), maleic acid ester, N-vinyl-2-pyrrolidone, N-vinylpyridine, and 2- and 4-vinylpyridine.

Particularly preferred are acrylic acid ester, methacrylic acid ester, and maleic acid ester. The non-color developable ethylene type monomer used herewith can be used in combination of two or more kinds, for example, methyl acrylate and butyl acrylate, butyl acrylate and styrene, butyl methacrylate and methacrylic acid, and methyl acrylate and diacetone acrylamide.

As known in the art of a polymer couplers, the ethylene type unsaturated monomer for copolymerizing with the vinyl type monomer corresponding to the compound represented by formula (I) or (II) can be selected so that the physical properties and/or chemical properties of the copolymer formed, such as solubility, compatibility with a binder for a photographic colloid composition, such as gelatin, and flexibility and thermal stability thereof, are favorably affected.

In order to incorporate the cyan coupler of the present invention into a silver halide light-sensitive material, preferably a red-sensitive silver halide emulsion layer, the cyan coupler is preferably converted to a coupler-in-emulsion type coupler. For meeting this purpose, at least one of the groups represented by $R_1$, $R_2$, $R_3$ and X is preferably a so-called ballast group (preferably having 10 or more total carbon atoms, more preferably 10 to 50 total carbon atoms). In particular, $R_3$ is preferably the ballast group.

In the present invention, the cyan coupler represented by formula (I), particularly the cyan coupler represented by formula (I-a), is preferred in terms of the effect thereof.

Examples of the cyan couplers of the present invention are shown below but the present invention is not limited thereto.

(1)

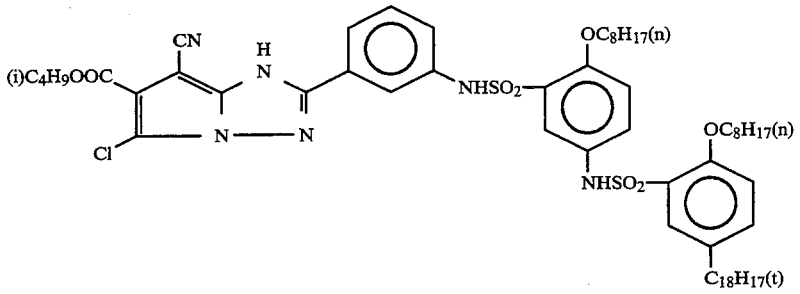

(2)

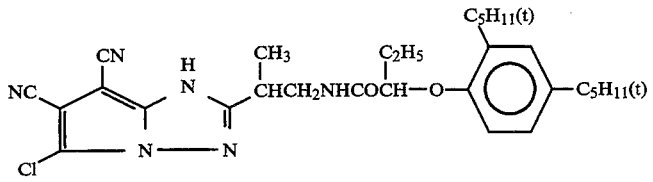

(3)

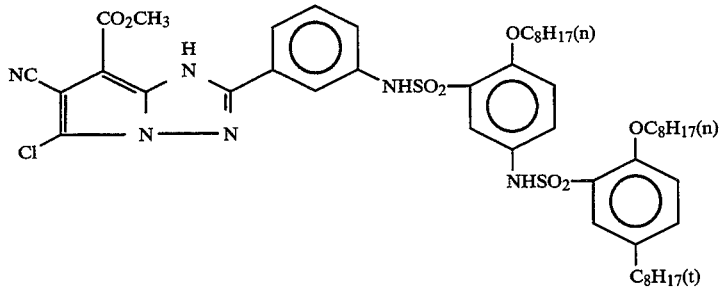

(4)

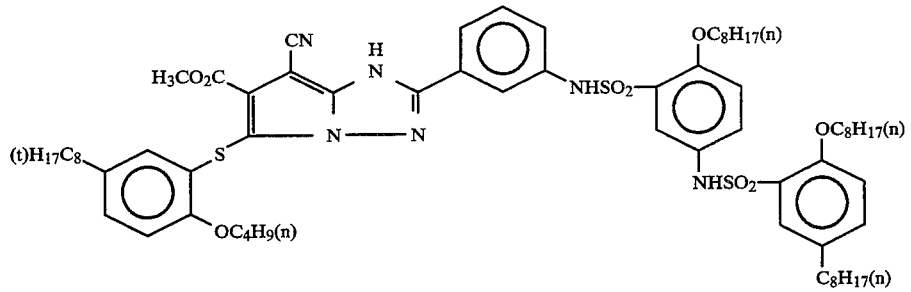

-continued
(5)
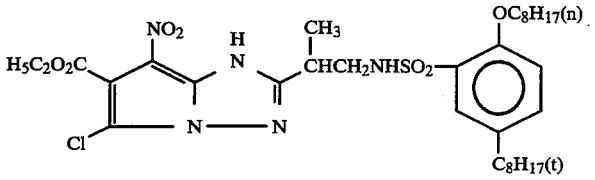
(6)
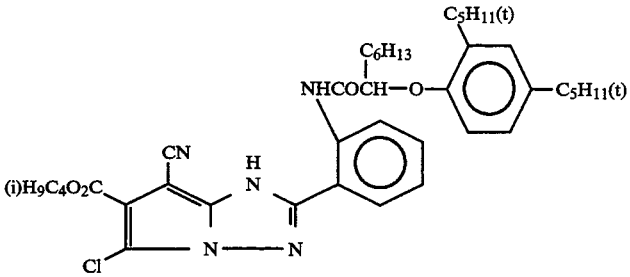
(7)
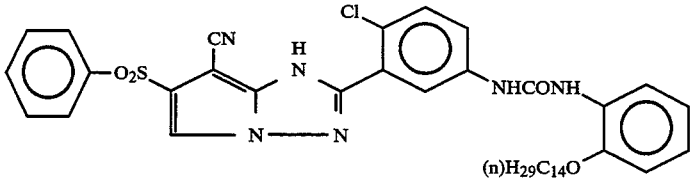
(8)
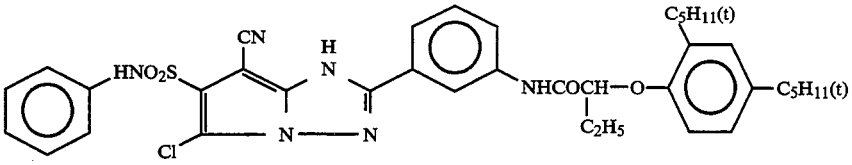
(9)
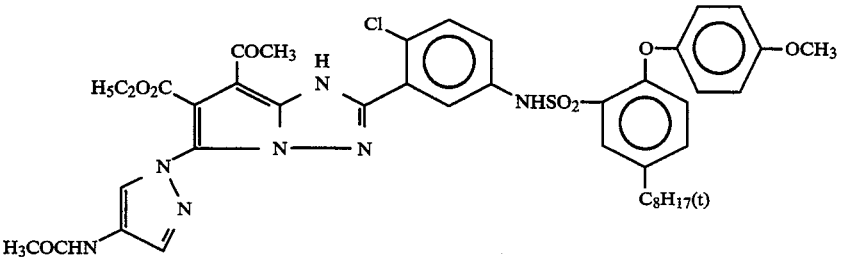
(10)
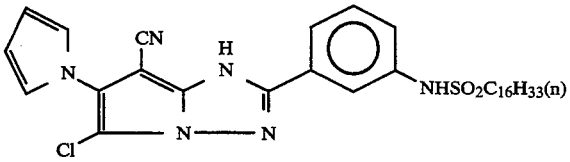
(11)
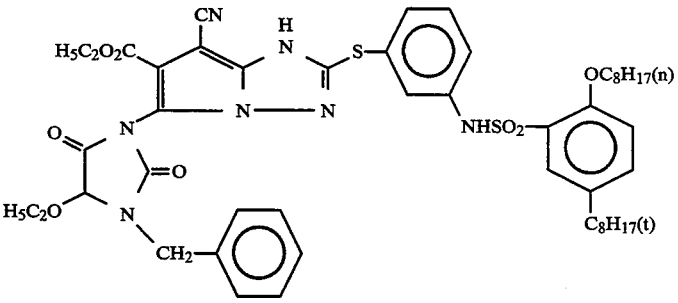

-continued
(12)
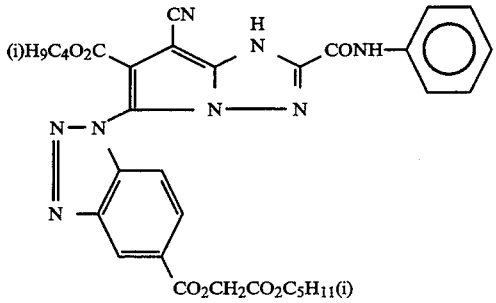
(13)
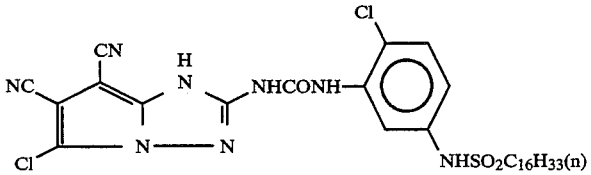
(14)
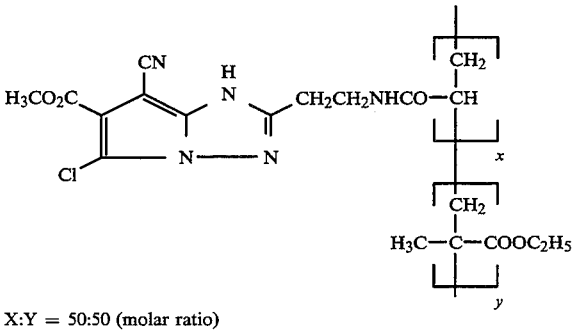
X:Y = 50:50 (molar ratio)
(15)
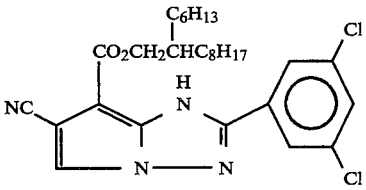
(16)
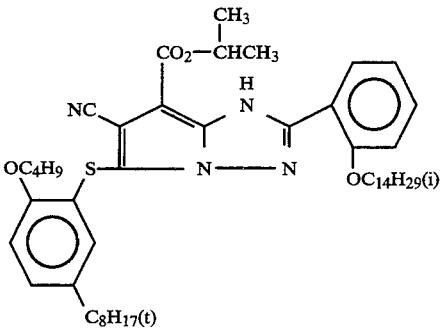
(17)
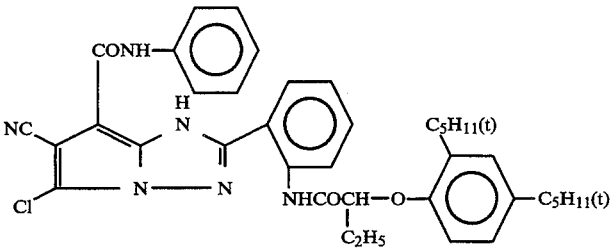

-continued
(18)
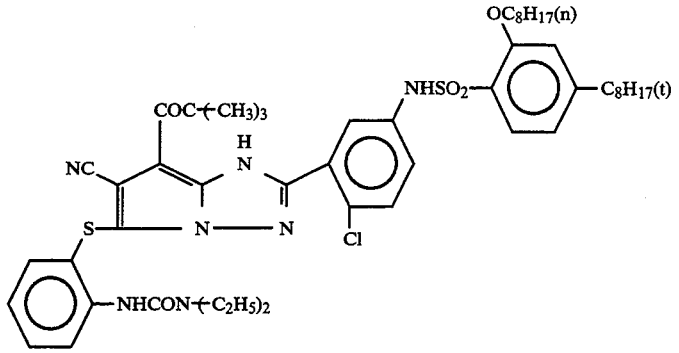
(19)
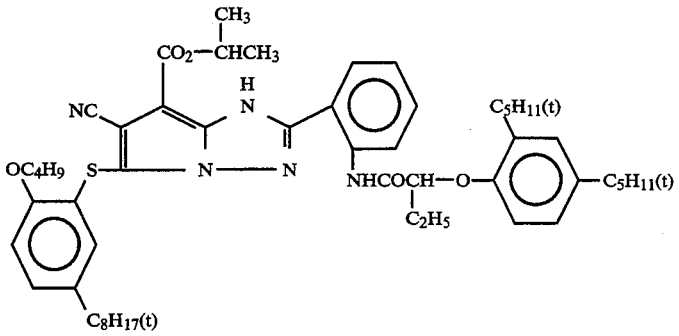
(20)
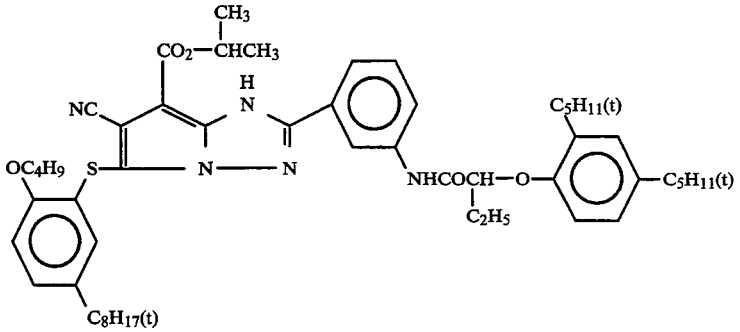
(21)
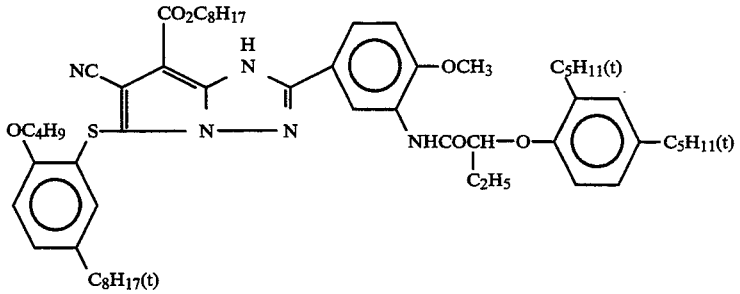
(22)
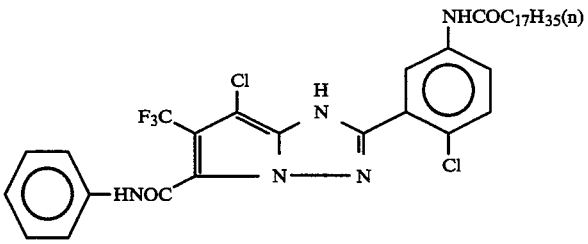

-continued
(23)
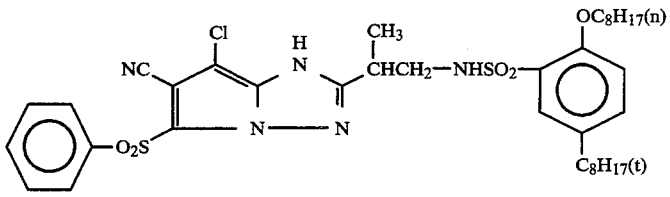
(24)
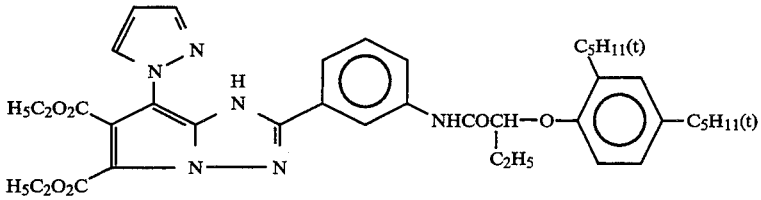
(25)
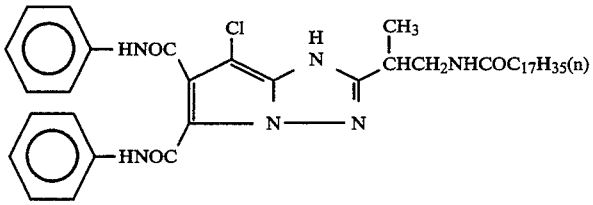
(26)
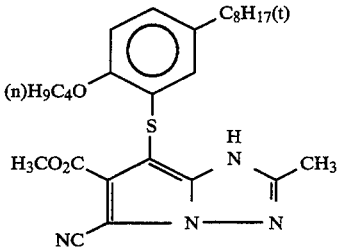
(27)
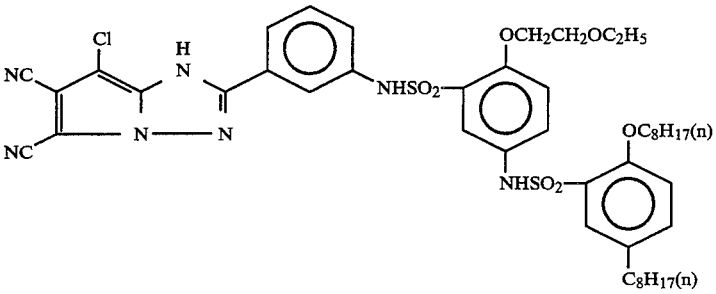
(28)
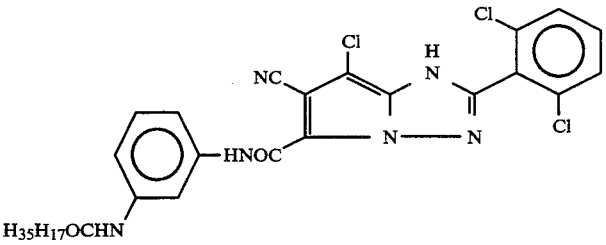
(29)
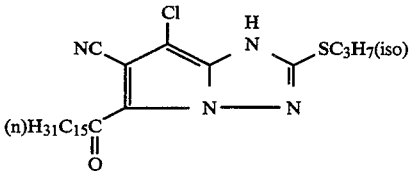

-continued
(30)
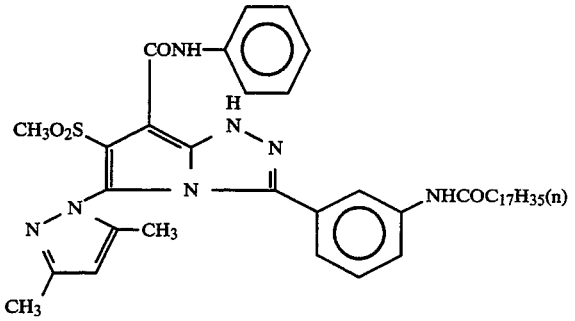
(31)
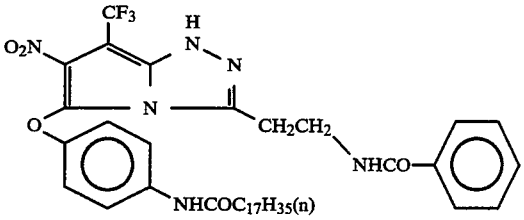
(32)
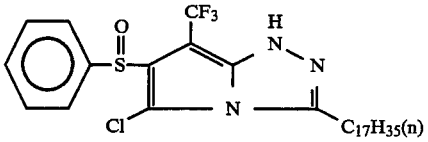
(33)
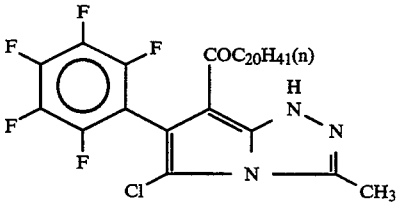
(34)
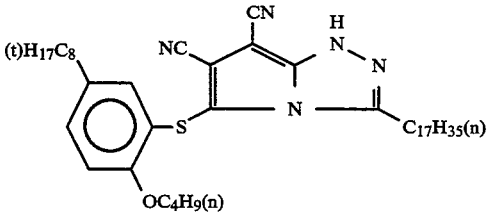
(35)
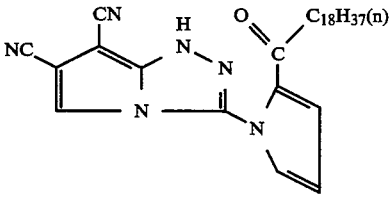
(36)
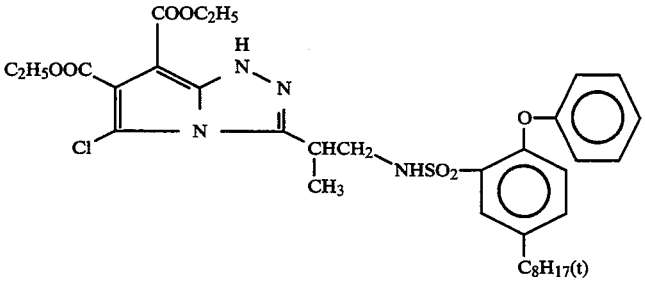

-continued
(37)
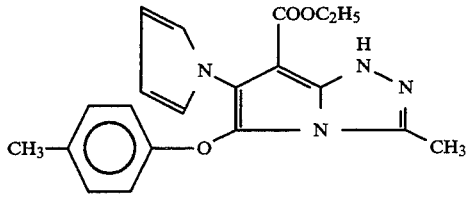
(38)
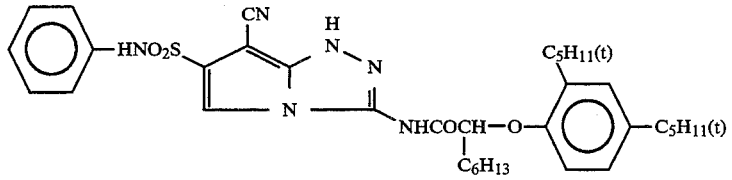
(39)
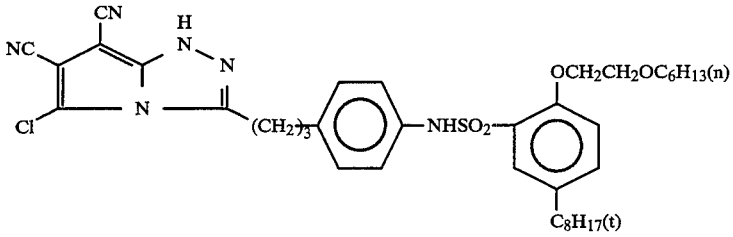
(40)
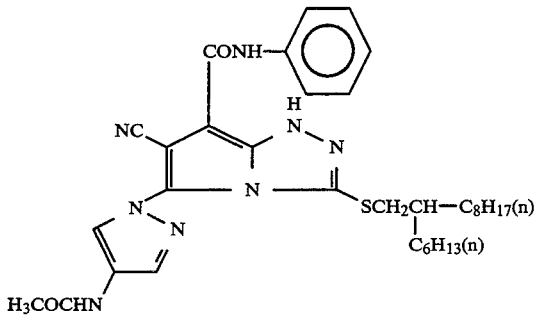
(41)
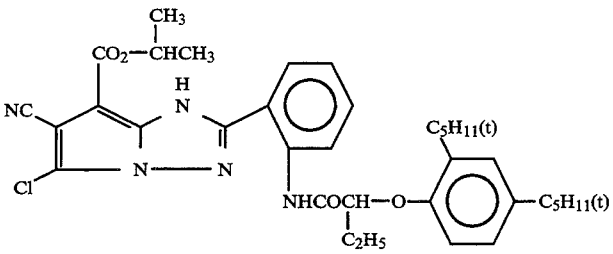
(42)
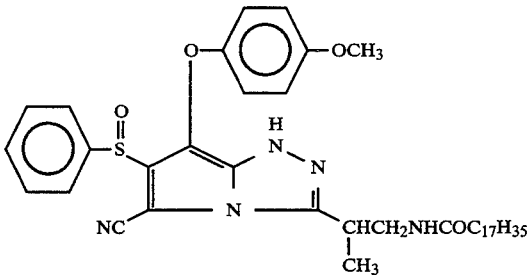

-continued
(43)
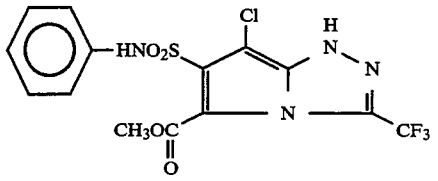
(44)
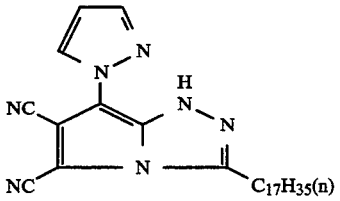
(45)
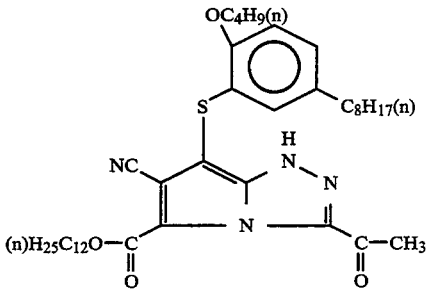
(46)
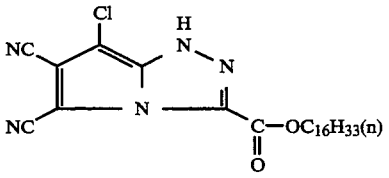
(47)
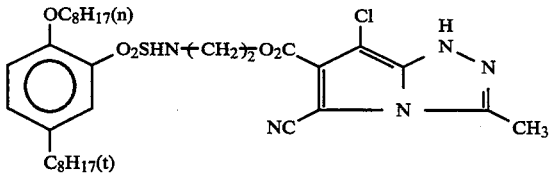
(48)
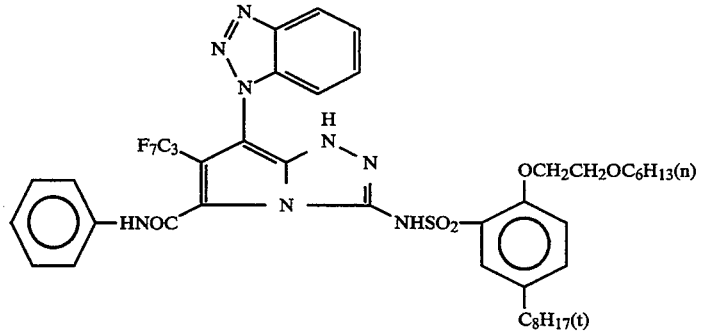

-continued
(49)
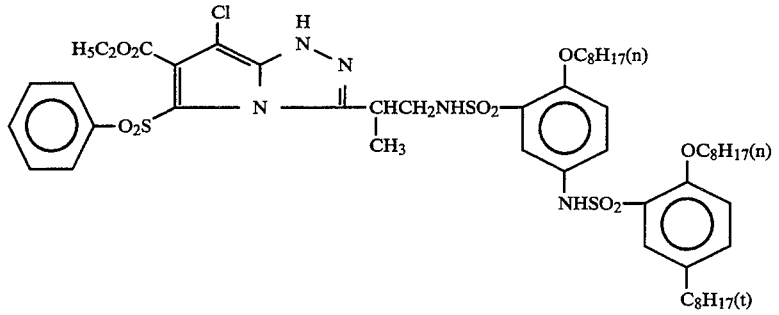
(50)
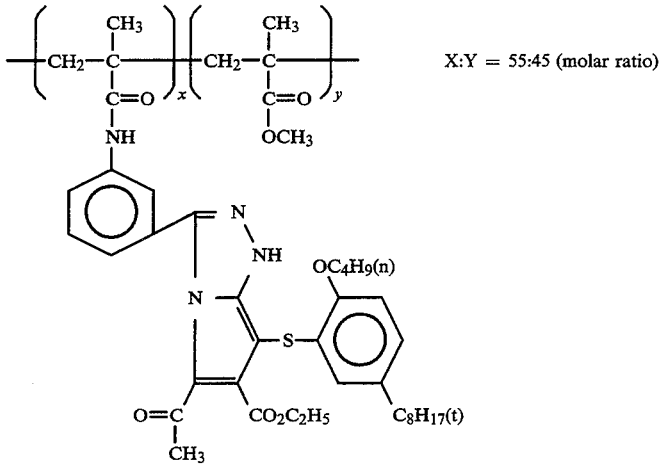
X:Y = 55:45 (molar ratio)
(51)
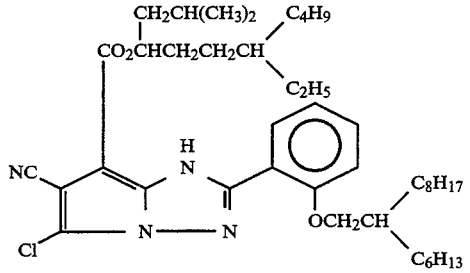
(52)
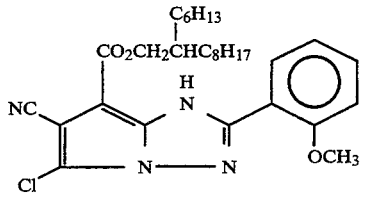
(53)
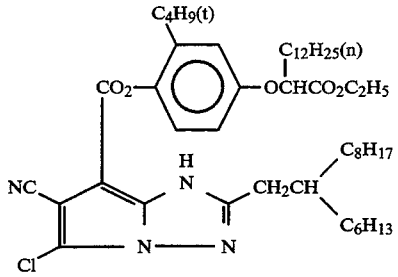

-continued
(54)
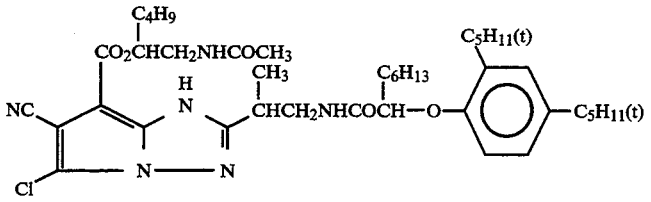
(55)
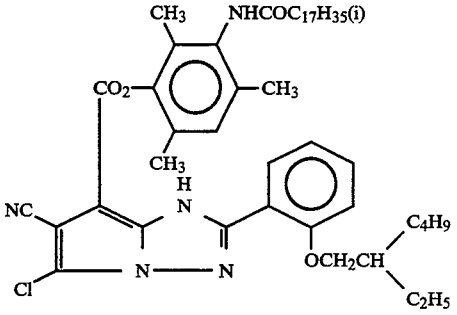
(56)
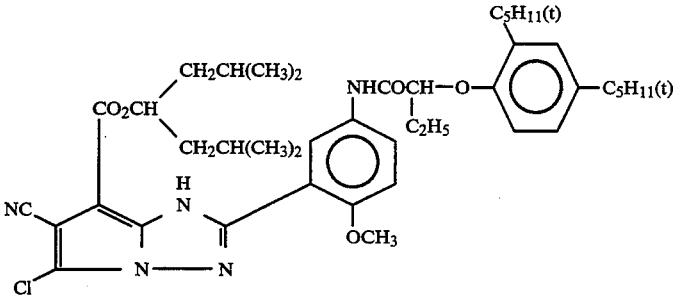
(57)
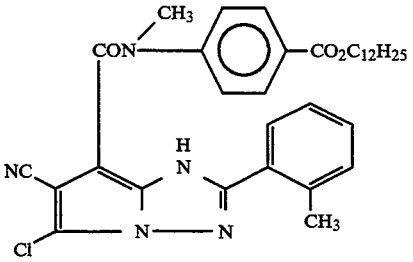
(58)
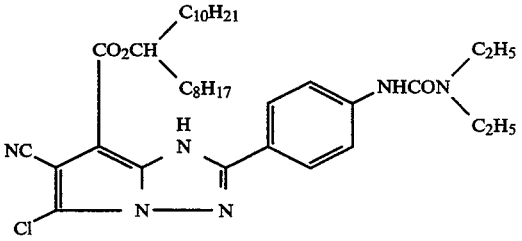
(59)
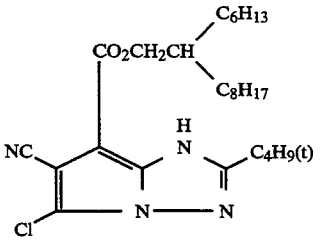

-continued
(60)
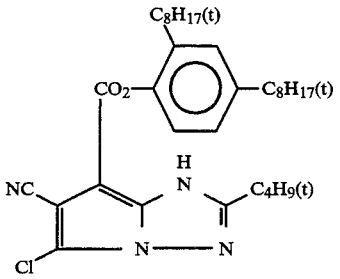
Examples of the synthesis of the cyan couplers of the present invention are shown below in order to explain the synthetic method thereof.
SYNTHETIC EXAMPLE 1 [SYNTHESIS OF EXEMPLIFIED COMPOUND (1)]
Exemplified Compound (1)
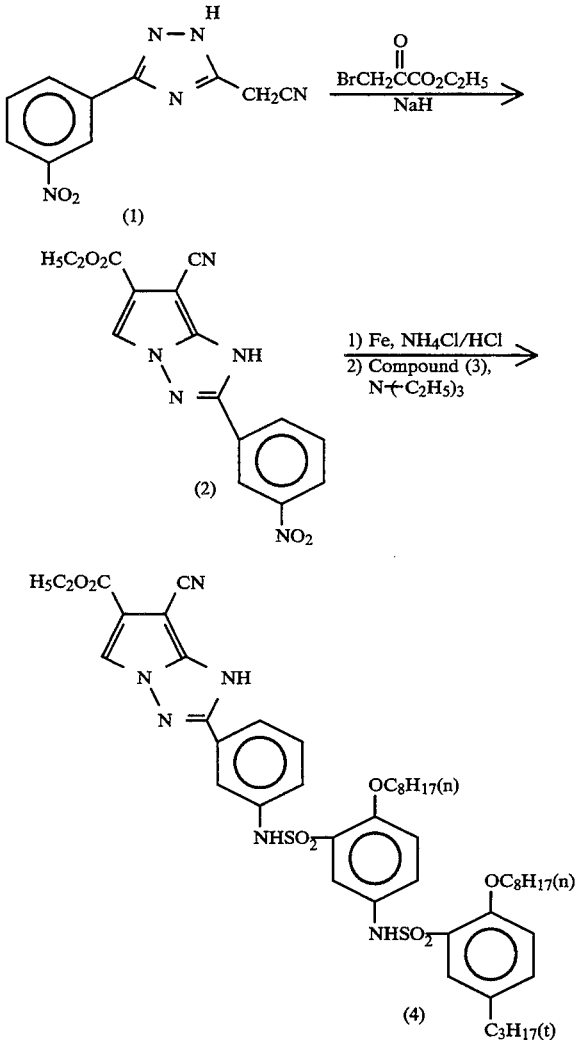
-continued
Exemplified Compound (1)
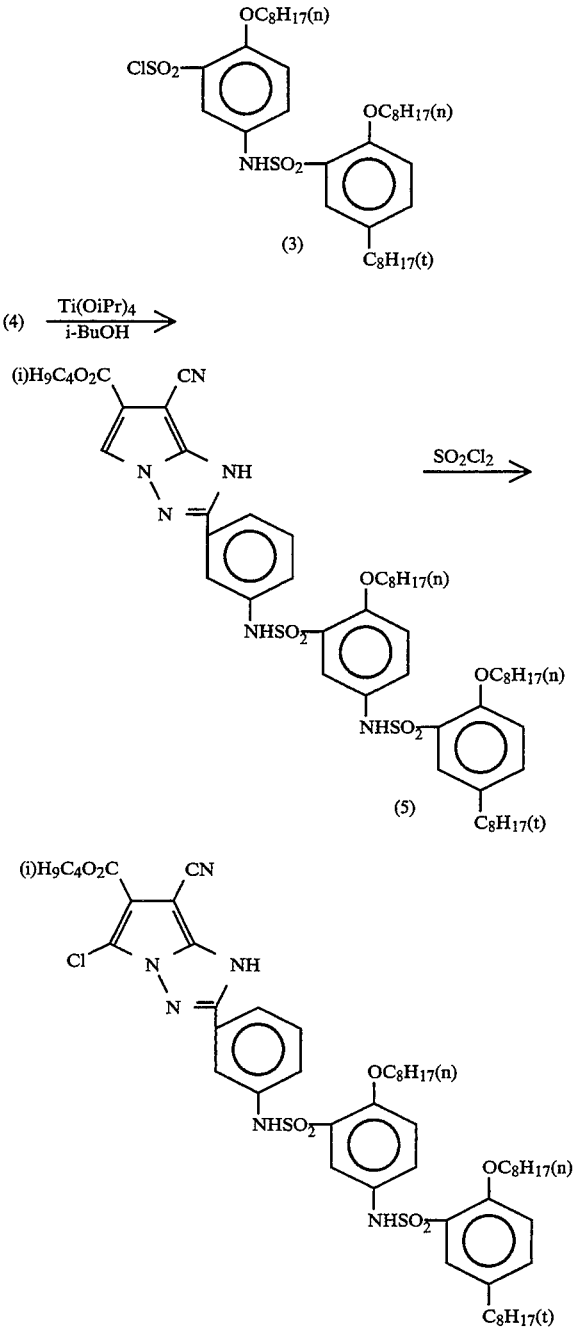
3-m-Nitrophenyl-5-methylcyano-l,2,4-triazole (1) (20.0 g, 87.3 mmol) was dissolved in dimethylacetamide (150 ml), and NaH (60% in oil) (7.3 g, 183 mmol) was added thereto in small increments, followed by heating to 80° C. The dimethylacetamide solution (50 ml) of ethyl bromopyruvate (13.1 ml, 105 mmol) was added drop by drop to the above solution. It was stirred at 80° C. for 30 minutes after the addition of the ethyl bromopyruvate and then was cooled down to room temperature. Hydrochloric acid (1N) was added to the reaction solution to make it acid, and then the solution was extracted with ethyl acetate. After drying on sodium sulfate, the solvent was distilled off under a reduced pressure. The residue was refined with a silica gel chromatography to obtain the compound (2) (10.79 g, 38%).

Reduced iron (9.26 g, 166 mmol) and ammonium chloride (0.89 g, 16.6 mmol) were suspended in isopropanol 300 ml and then, water 30 ml and conc. Hydrochloric acid 2 ml were further added to heat and reflux the suspension for 30 minutes. The compound (2) (10.79 g, 33.2 mmol) was added thereto in small increments while heating and refluxing. After heating and refluxing for an additional 4 hours, the solution was immediately filtered with celite and the liltrate was subjected to a distillation under a reduced pressure. The residue was dissolved in the mixed solvent of dimethylacetamide 40 ml and ethyl acetate 60 ml and the compound (3) (25.6 g, 36.5 mmol) was added thereto. Then, triethylamine (23.1 ml, 166 mmol) was added and the solution was heated at 70° C. for 5 hours. After the reaction solution was cooled down to room temperature, water was added thereto and the solution was extracted with ethyl acetate. After the extract was washed with water, it was dried on sodium sulfate and the solvent was distilled off under a reduced pressure. The residue was refined with a silica gel chromatography to obtain compound (4) (16.5 g, 52%).

Compound (4) (7.0 g, 7.30 mmol) was dissolved in isobutanol (14 ml) and tetraisopropyl orthotitanate (0.43 ml, 1.46 mmol) was added, followed by heating for refluxing for 6 hours. After the reaction solution was cooled down to room temperature, water was added thereto and the solution was extracted with ethyl acetate. The extract was dried on sodium sulfate and the solvent was distilled off under a reduced pressure. The residue was refined with a silica gel chromatography to obtain the compound (5) 5.0 g (69%).

Compound (5) (5.0 g, 5.04 mmol) was dissolved in tetrahydrofuran (50 ml), and $SO_2Cl_2$ (0.40 ml, 5.04 mmol) was added drop by drop while cooling with water. The solution was then stirred for an additional 4 hours while cooling with water. Water was added to the reaction solution and the solution was extracted with ethyl acetate. The extract was dried on sodium sulfate and the solvent was distilled off under a reduced pressure. The residue was refined through silica gel chromatography to obtain the exemplified compound (1) (3.9 g, 76%).

SYNTHETIC EXAMPLE 2 [SYNTHESIS OF EXEMPLIFIED COMPOUND (39)]

Exemplified Compound (39)

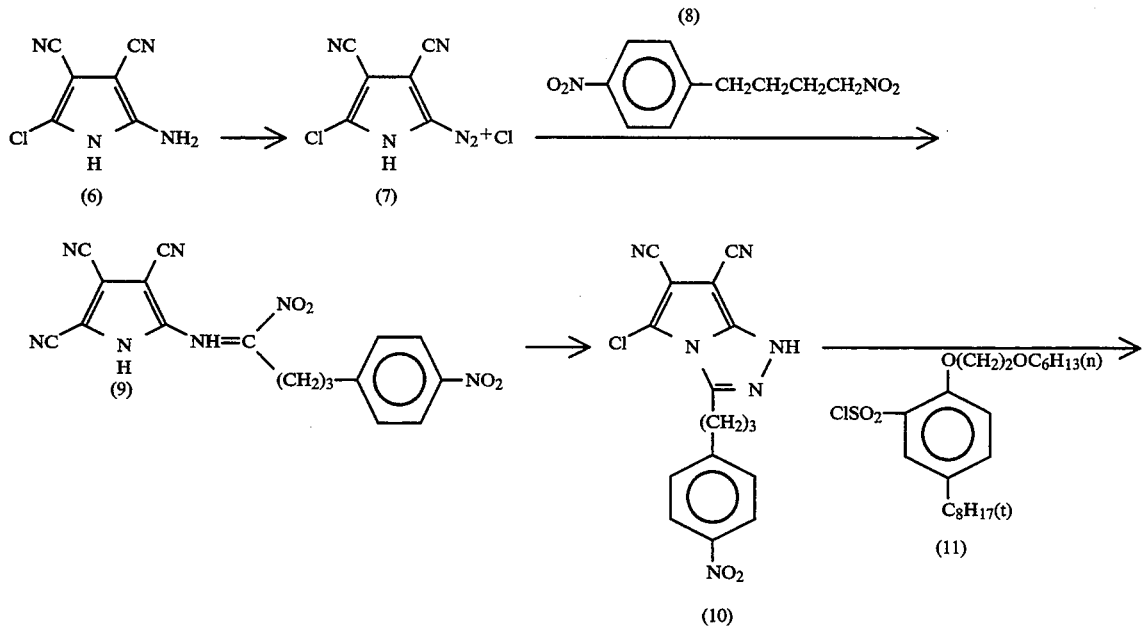

-continued

Exemplified Compound (39)

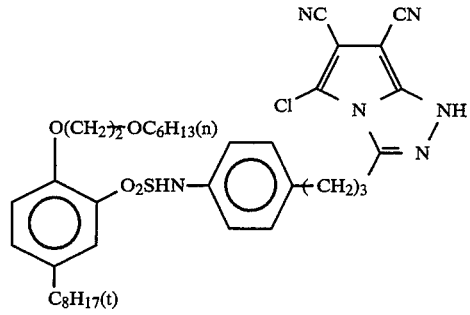

Hydrochloric acid (36%) 38 ml was added to 2-amino-5-chloro-3,4-dicyanopyrrole (6) (6.78 g, 40.7 mmol), and the aqueous solution 5.9 ml of sodium nitrite (2.95 g, 42.7 mmol) was slowly added drop by drop while stirring and cooling with ice, followed by continuing stirring for further 1.5 hours, whereby the compound (7) was prepared. While stirring and cooling with ice, the solution of the compound (7) thus prepared was slowly added drop by drop to a solution prepared by adding sodium methylate (28%) 102 ml to the ethanol solution 177 ml of the compound (8) (9.58 g, 427 mmol) while stirring and cooling with ice, and then stirring was continued for 1 hour. Next, the reaction solution was heated for refluxing for 1.5 hours. Then, ethanol was distilled off from the reaction solution under a reduced pressure, and the residue was dissolved in chloroform- The solution thus prepared was washed with a saturated brine, and after drying on sodium sulfate, chloroform was distilled off under a reduced pressure. The residue was refined through silica gel chromatography to obtain compound (10) 4.19 g [the yield from compounds (6) through (10): 29%).

Compound (6) was synthesized by subjecting 3,4-dicyanopyrrole to nitration and reduction with iron after chlorination. Also, compound (8) was synthesized from compound (a) synthesized from γ-lactone and benzene according to the method described in *Journal of the American Chemical Society*, 76, pp. 3209 (1954).

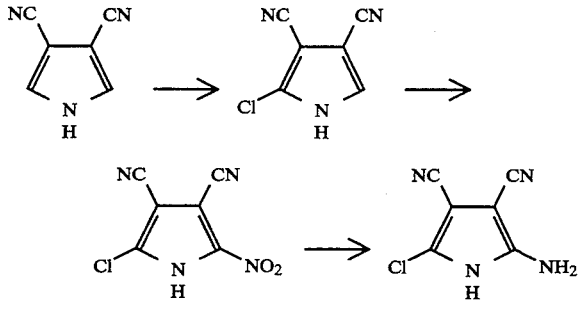

(6)

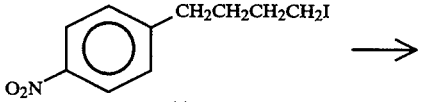

(a)

-continued

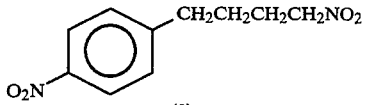

(8)

Water (10 ml), ammonium chloride (0.3 g, 5.9 mmol) and acetic acid (0.34 ml, 5.9 mmol) were added to reduced iron powder (3.3 g, 59.0 mmol), and the solution thus prepared was heated for refluxing for 15 minutes while stirring. Then, isopropanol (31 ml) was added thereto and the solution was heated for refluxing for further 20 minutes while stirring. Next, the isopropanol solution 14 ml of compound (10) (4.1 g, 11.8 mmol) was dropped and the solution was heated for refluxing for 2 hours. Then, the reaction solution was filtered using celite as a filter aid and the residue was washed with ethyl acetate, followed by distilling the solution under a reduced pressure.

The residue was dissolved in a mixed solvent of ethyl acetate (16 ml) and dimethylacetamide (24 ml). Added thereto was compound (11) (5.6 g, 13.0 mmol) and further triethylamine (8.2 ml, 59.0 mmol), and the solution was stirred at room temperature for 4 hours. Water was added thereto and the solution was extracted with ethyl acetate, followed by washing the extract with a saturated brine. After drying on sodium sulfate, the solvent was distilled off under a reduced pressure and the residue was refined with a silica gel chromatography, whereby exemplified compound (39) (6.46 g, 76%) could be obtained.

Formula (A) according to the present invention is discussed in detail below.

Substituents of $R_{a1}$ include, an aliphatic group, for example, methyl, ethyl, iso-propyl, t-butyl, benzyl, hexadecyl, allyl, vinyl, cyclohexyl, cyclohexenyl, phenoxyethyl, or methanesulfonamidethyl, preferably an alkyl group or alkenyl group which has 1 to 30 carbon atoms and may be substituted. An aromatic group is, for example, phenyl, 2-t-butylphenyl, 4-methoxyphenyl, or naphthyl, preferably phenyl which has 6 to 36 carbon atoms and may be substituted. A heterocyclic group is, for example, 2-tetrahydropyranyl or pyridyl.

The aliphatic groups represented by $R_{a7}$ to $R_{a13}$ are, for example, methyl, ethyl, t-butyl, benzyl, hexadecyl, allyl, cyclohexyl, cyclohexenyl, and phenoxyethyl, preferably an alkyl group or alkenyl group which has 1 to 20 carbon atoms and may be substituted. The aromatic groups represented by $R_{a7}$ to $R_{a13}$ are, for example, phenyl, 2,4-di-t-butylphenyl, 2-methylphenyl, and 4-dodecyloxyphenyl, preferably phenyl which has 6 to 12 carbon atoms in case of $R_{a7}$ to $R_{a9}$ and 6 to 30 carbon atoms in case of $R_{a10}$ to $R_{a13}$, and may be substituted. The aliphatic oxy groups represented by $R_{a7}$ to $R_{a13}$ are, for example, methoxy, ethoxy and t-butyloxy, preferably an alkoxy group which has 1 to 30 carbon atoms and may be substituted. The aromatic oxy groups represented by $R_{a7}$ to $R_{a13}$ are, for example, phenoxy, 2,4-di-t-butylphenoxy, 2-chlorophenoxy, and 4-methoxyphenoxy, preferably phenoxy which has 6 to 30 and may be substituted. The aliphatic amino groups represented by $R_{a10}$ and $R_{a11}$ are, for example, methylamino, dimethylamino, octylamino, dibutylamino, hexadecylamino, and phenoxyethylamino, preferably an alkylamino group which has 1 to 30 carbon atoms and may be substituted. The aromatic amino groups represented by $R_{a10}$ and $R_{a11}$ are, for example, anilino, 2,4-dichloroanilino, 4-t-octylanilino, N-methyl-anilino, 2-methylanilino, and N-hexadecylanilino, preferably an anilino group which has 6 to 30 carbon atoms and may be substituted.

The aliphatic groups represented by $R_{a2}$ to $R_{a6}$ are, for example, methyl, isopropyl, t-butyl, benzyl, 2-hydroxybenzyl, t-hexyl, t-octyl, cyclohexyl, 1-methylcyclohexyl, pentadecyl, allyl, cyclohexenyl, and acetylaminopropyl, preferably an alkyl group which has 1 to 30 carbon atoms and may be substituted. The aromatic groups are, for example, phenyl, 2-hydroxyphenyl, and 2-hydroxy-3,5-di-t-butylphenyl, preferably phenyl which has 6 to 36 carbon atoms and may be substituted. The heterocyclic groups are, for example, 1-pyrrolyl, 1-piperadyl, 1-indolinyl, 4-morphonilyl, and 1-piperidyl. The aliphatic oxycarbonyl groups are, for example, methoxycarbonyl, hexadecyloxycarbonyl, and ethoxyethoxycarbonyl, preferably an alkyloxycarbonyl group which has 2 to 31 carbon atoms and may be substituted. The aromatic oxycarbonyl groups are, for example, phenoxycarbonyl, 2,4-di-t-butylphenoxycarbonyl, and 2,4-dichlorophenoxycarbonyl, preferably a phenoxycarbonyl group which has 7 to 37 carbon atoms and may be substituted. The halogen atoms are, for example, fluorine, chlorine and bromine. The acyl groups are, for example, acetyl, tetradecanoyl, benzoyl, and 4-t-butylbenzoyl, preferably an alkylcarbonyl group which has 2 to 31 carbon atoms and may be substituted, and an arylcarbonyl group which has 7 to 37 carbon atoms. The sulfonyl groups are, for example, methanesulfonyl, octanesulfonyl, benzene-sulfonyl, and 2-hydroxybenzenesulfonyl, preferably an alkylsulfonyl group which has 1 to 30 carbon atoms and may be substituted, and an arylsulfonyl group which has 6 to 36 carbon atoms and may be substituted. The carbamoyl groups are, for example, methylcarbamoyl, diethylcarbamoyl, octylcarbamoyl, phenylcarbamoyl, N-methylphenylcarbamoyl, and N-octyl-4-methylcarbamoyl, preferably an alkylcarbamoyl group which has 2 to 31 carbon atoms and may be substituted, and an arylcarbamoyl group which has 7 to 37 carbon atoms. The sulfamoyl groups are, for example, methylsulfamoyl, diethylsulfamoyl, dioctylsulfamoyl, phenylsulfamoyl, N-methylphenylsulfamoyl,and N-octyl-4-methylsulfamoyl, preferably an alkylsulfamoyl group which has 1 to 30 carbon atoms and may be substituted, and an arylsulfamoyl group which has 6 to 36 carbon atoms.

In formula (A), of the respective groups represented by —X—$R_{a1}$ and $R_{a2}$ to $R_{a6}$, the substituents located in an ortho position to each other may be combined to form a 5 to 8-membered ring. Examples of the 5 to 8-membered ring include, a coumaran ring, a chroman ring, an indane ring, and quinoline ring. These may further form a spiro ring or a bicyclo ring. Further, where —X— or —X'— is —N($R_{a1}$')—, $R_{a1}$ and $R_{a2}$' may combine with each other to form a 5 to 8-membered ring. Examples of the 5 to 8-membered ring include, a morpholine ring, a piperidine ring, a piperidine ring, and an indoline ring.

Of the compounds of the present invention represented by formula (A), the following ones are preferred in terms of the effects of the invention:

(1) the compounds in which at least one of $R_{a2}$ to $R_{a6}$ is —X'—$R_{a1}$, and (2) the compounds in which —X— is —O— and $R_{a1}$ is —P(O) ($R_{a12}$) ($R_{a13}$).

The compounds represented by the following formulas (A-I) to (A-XVII) are more preferred in terms of the effects of the invention:

(A-I)

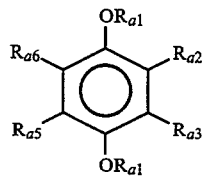

(A-II)

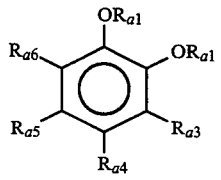

(A-III)

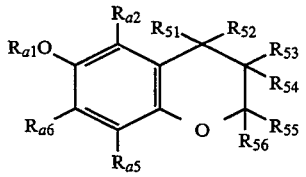

(A-IV)

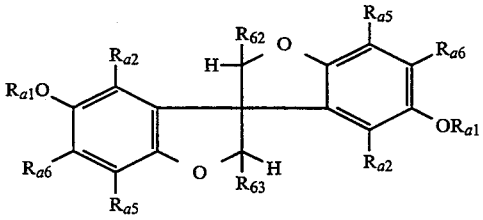

(A-V)

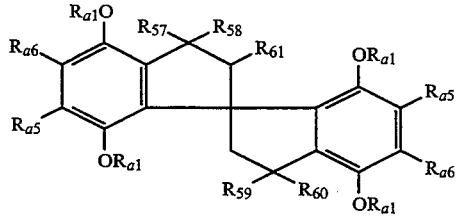

(A-VI)

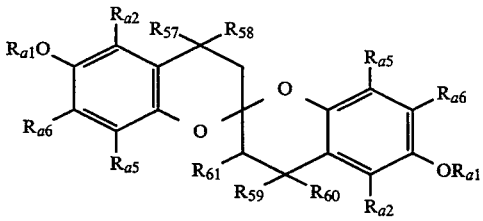

-continued (A-VII)

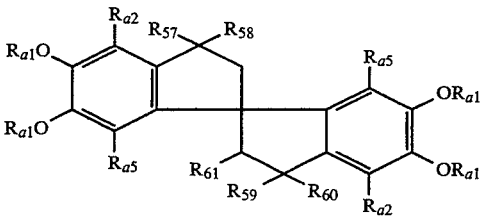

(A-VIII)

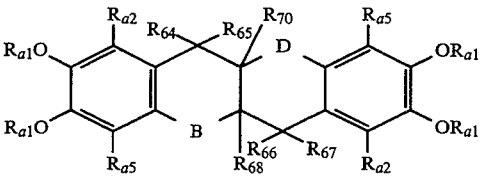

(A-IX)

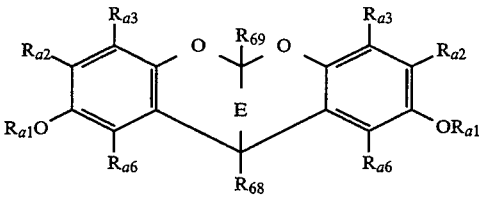

(A-X)

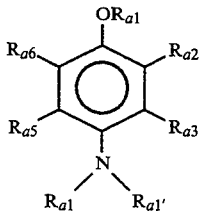

(A-XI)

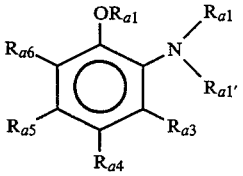

(A-XII)

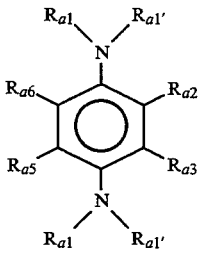

(A-XIII)

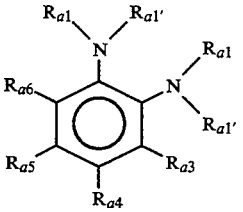

-continued (A-XIV)

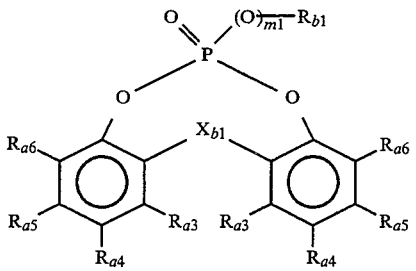

(A-XV)

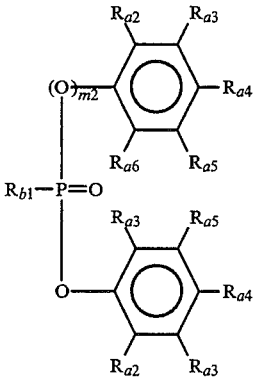

(A-XVI)

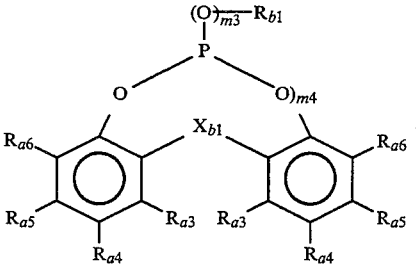

(A-XVII)

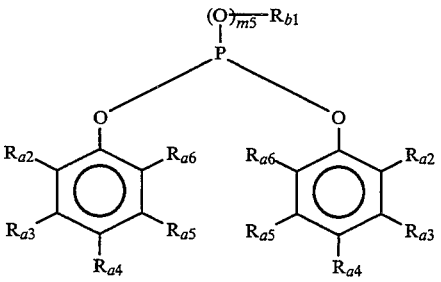

In formulas (A-I) to (A-XVII), $R_{a1}$ to $R_{a6}$ and $R_{a1}'$ are the same as those defined for $R_{a1}$ to $R_{a6}$ and $R_{a1}'$ in formula (A).

$R_{51}$ to $R_{69}$ may be the same or different and each represent a hydrogen atom, an alkyl group (for example, methyl, ethyl, isopropyl, and dodecyl), and an aryl group (for example, phenyl and p-methoxyphenyl). $R_{54}$ and $R_{55}$ and $R_{55}$ and $R_{56}$ may be combined with each other to form a 5 to 7-membered hydrocarbon ring. B and D each represent a single bond, —$C(R_{70})(R_{71})$— or —O— and E represents a single bond or —$C(R_{70})(R_{71})$—, wherein $R_{70}$ and $R_{71}$ may be the same or different and each represent a hydrogen atom, an alkyl group (for example, methyl, ethyl, isopropyl, butyl and octyl), and an aryl group (for example, phenyl and p-methylphenyl).

$R_{b1}$ represents an aliphatic group (for example, methyl, ethyl, butyl, isopropyl, octyl, dodecyl, benzyl, and allyl, preferably an alkyl group which may be substituted), or an aromatic group (for example, phenyl, p-methoxyphenyl and 2,4-dimethylphenyl, preferably a phenyl group which may be substituted). $X_{b1}$ represents a single bond, a substituted or unsubstituted methylene group, —S—, —O—, —CO—, —N($R_{a1}$')—, or —$SO_2$—; $m_1$ to $m_5$ each represent 0 or 1. In formulas (A-IV) to (A-IX), and (A-XIV) to (A-XVII), plural $R_{a2}$ to $R_{a6}$ in the same molecule each may be the same or different. Further, in formulas (A-I), (A-II), and (A-IV) to (A-XIII), plural $R_{a1}$ and $R_{a1}$' in the same molecule each may be the same or different.

In the compounds represented by formulas (A-I) to (A-IX), the substituents preferred in terms of the effects of the present invention are described below. $R_{a1}$ is preferably an alkyl group, an aryl group, —CO($R_{a10}$), or —$SO_2$($R_{a11}$), particularly preferred is an alkyl group. $R_{a2}$ to $R_{a6}$ each are preferably a hydrogen atom, —X'—$R_{a1}$, an alkyl group, an aryl group, or a halogen atom. $R_{51}$ to $R_{71}$ each are preferably a hydrogen atom or an alkyl group (a carbon atom number: 1 to 6).

In the compounds represented by formulas (A-X) to (A-XIII), the substituents preferred in terms of the effects of the present invention are described below. $R_{a1}$ of —O—$R_{a1}$ is preferably an alkyl group, an aryl group, —CO($R_{a10}$), or —$SO_2$($R_{a11}$), particularly preferred is an alkyl group. $R_{a1}$ and $R_{a1}$' of —N($R_{a1}$)($R_{a1}$') each are preferably an alkyl group, an aryl group, or a pyrrolidine ring, a piperidine ring, a piperazine ring, a morpholine ring, a thiomorpholine ring, an imide ring, a lactum ring or a nitrogen-containing heterocyclic group having at least one of a carbonyl and a sulfonyl group, each of which is formed by cyclization of $R_{a1}$ and $R_{a1}$'. $R_{a2}$ to $R_{a6}$ each are preferably a hydrogen atom, —X'—$R_{a1}$, an alkyl group, an aryl group, or a halogen atom.

In the compounds represented by formulas (A-XIV) to (A-XVII), the substituents preferred in terms of the effects of the present invention are described below. $R_{b1}$ is preferably an alkyl group which may be substituted or a phenyl group which may be substituted; $m_1$ is preferably 0. $R_{a2}$ is preferably a substituent other than a hydrogen atom, particularly preferably an alkyl group, and most preferably a branched alkyl group in formula (A-XVII). $R_{a3}$ to $R_{a6}$ each are preferably a hydrogen atom, —X'—$R_{a1}$, an alkyl group, an aryl group, or a halogen atom.

Of the compounds represented by formulas (A-I) to (A-XVII), the compounds further preferred in terms of the effects of the present invention are the ones represented by formulas (A-Z), (A-V), (A-VI), (A-VII), (A-VIII), (A-IX), (A-X), (A-XI), (A-XIV), and (A-XVI), more preferable compounds are represented by formulas (A-VII), (A-XI) and (A-XVI), and most preferable compounds are represented by formulas (A-VII) and (A-XI).

Examples of the compounds represented by formula (A) are shown below but the present invention is not limited thereby.

A-1

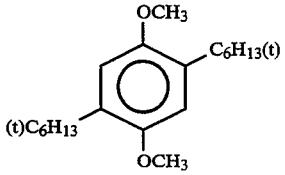

A-2

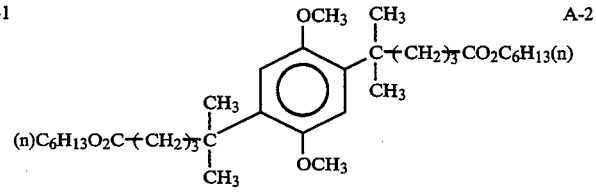

A-3

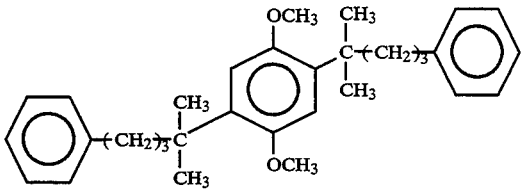

A-4

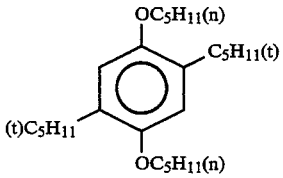

A-5

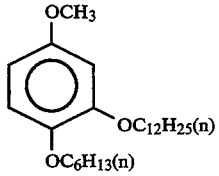

A-6

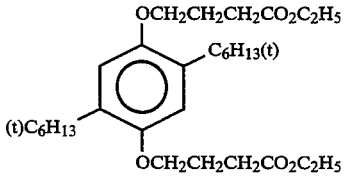

A-7

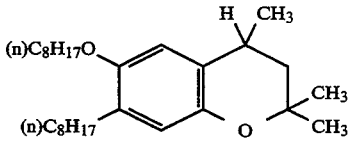

A-8

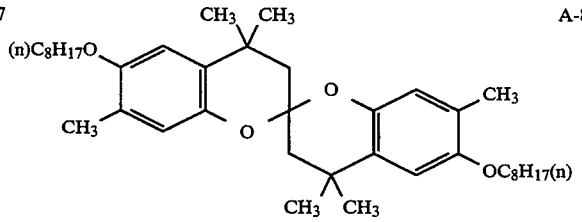

-continued
A-9
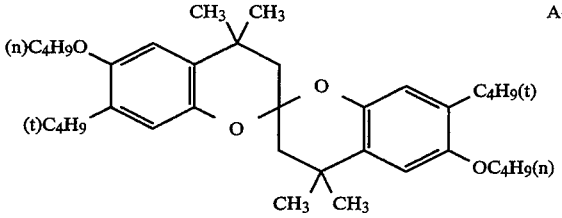
A-10
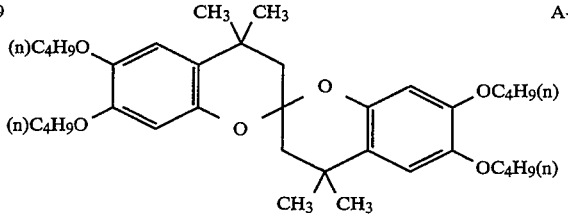
A-11
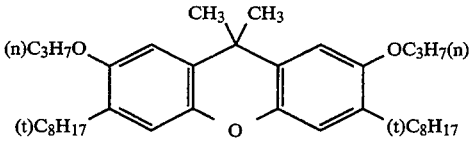
A-12
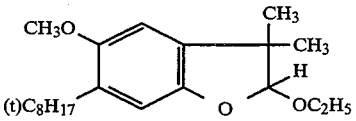
A-13
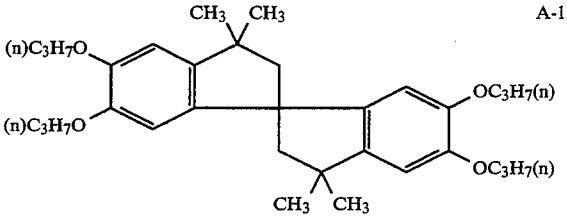
A-14
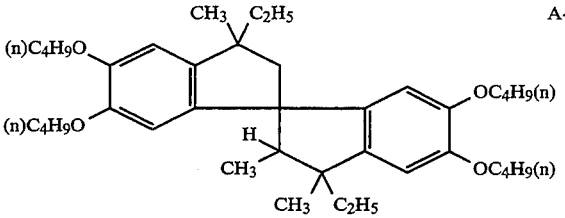
A-15
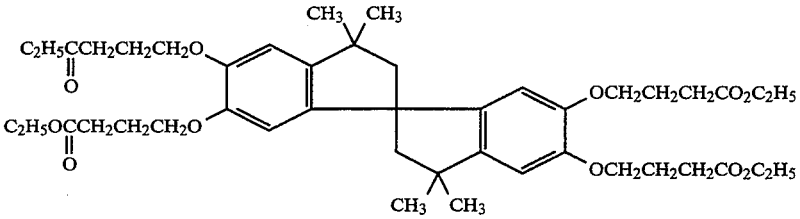
A-16
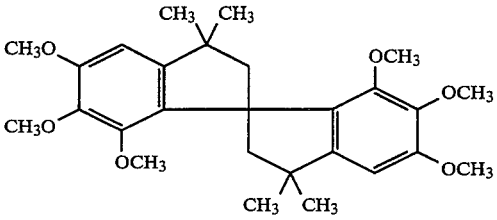
A-17
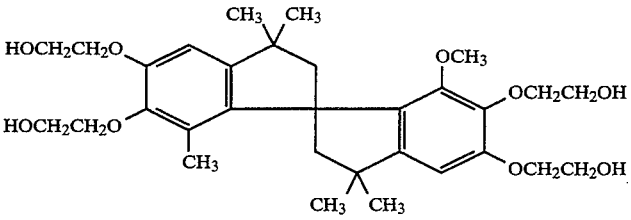
A-18
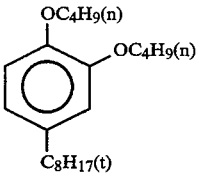
A-19
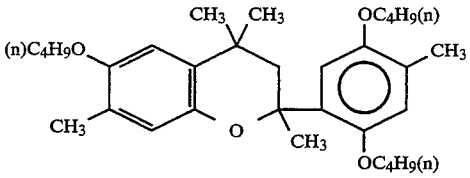
A-20
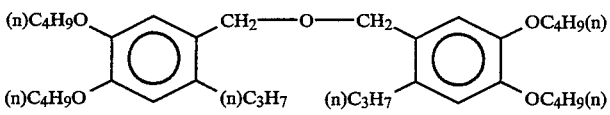

-continued
A-21
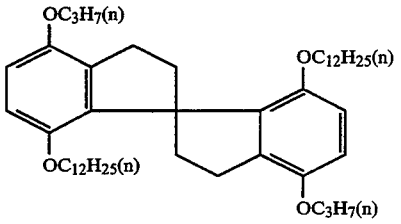
A-22
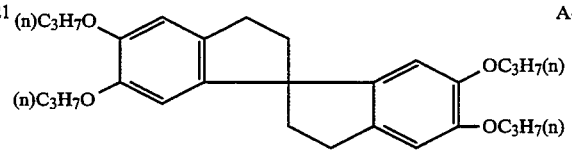
A-23
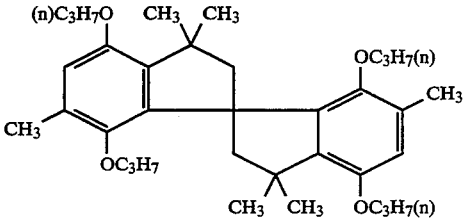
A-24
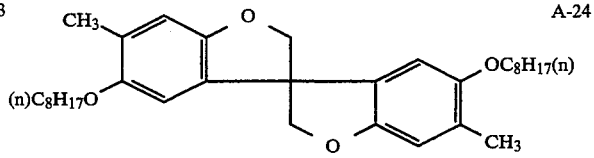
A-25
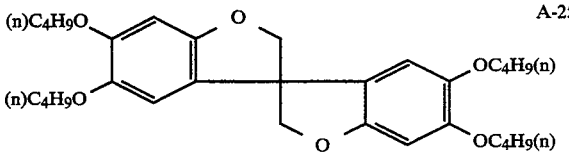
A-26
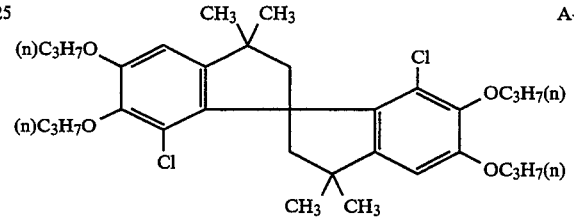
A-27
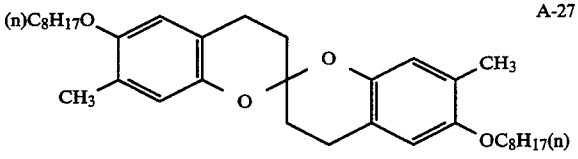
A-28
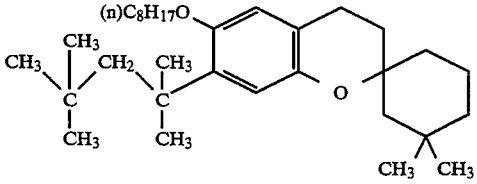
A-29
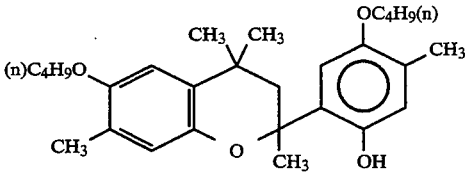
A-30
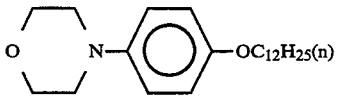
A-31
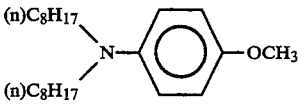
A-32
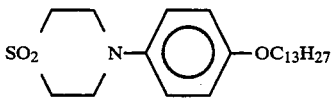
A-33
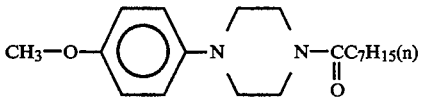
A-34
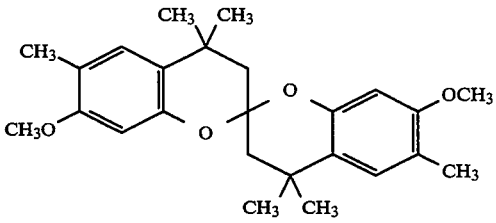
A-35
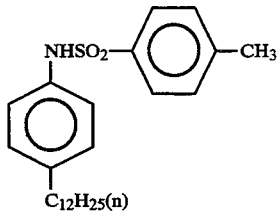
A-36
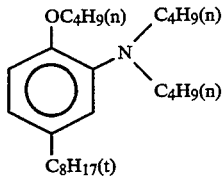

-continued
A-37
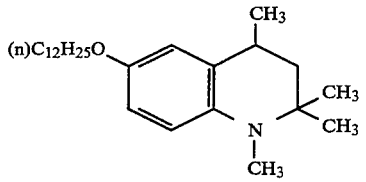
A-38
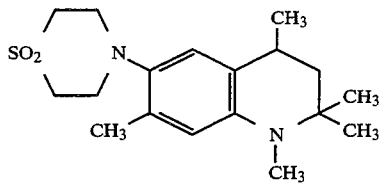
A-39
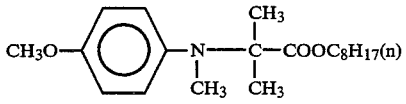
A-40
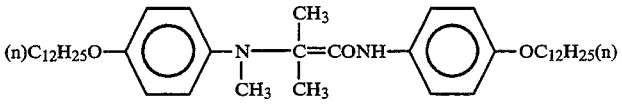
A-41
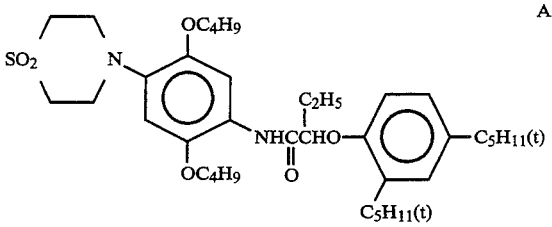
A-42
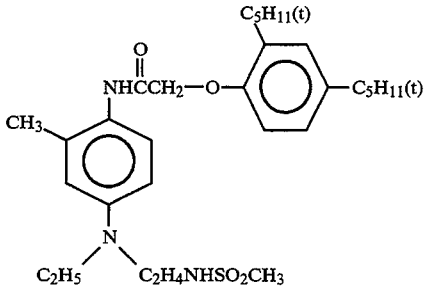
A-43
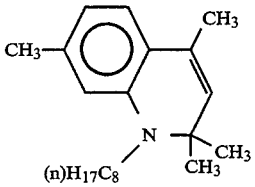
A-44
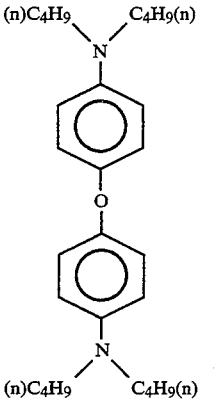
A-45
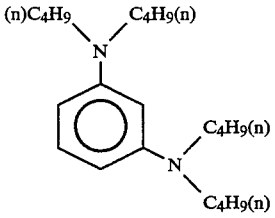
A-46
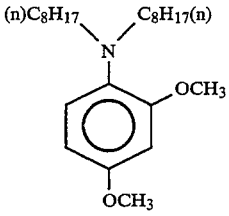
A-47
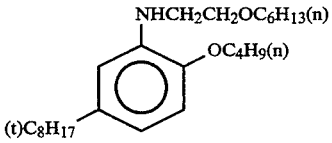
A-48
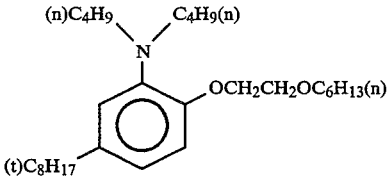

-continued
A-49
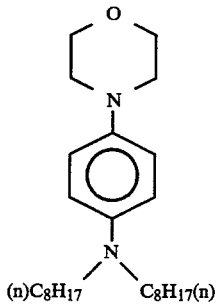
A-50
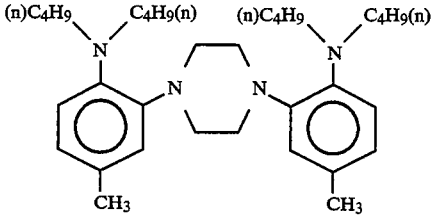
A-51
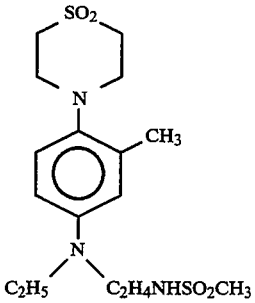
A-52
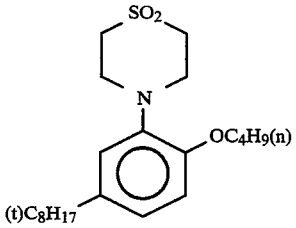
A-53
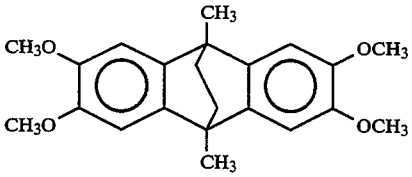
A-54
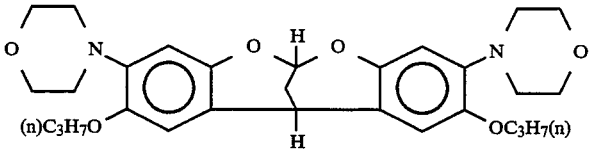
A-55
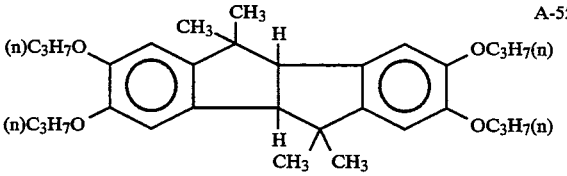
A-56
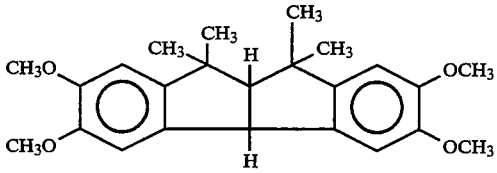
A-57
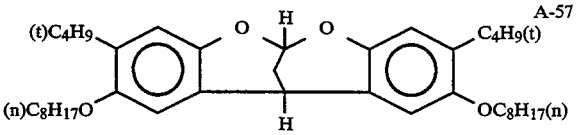
A-58
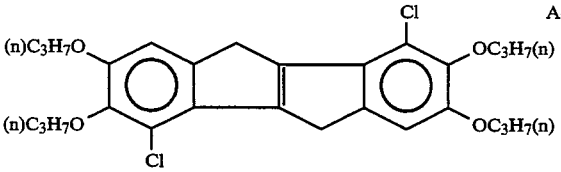
A-59
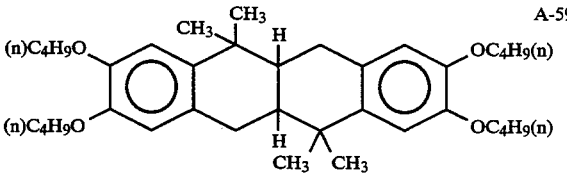
A-60
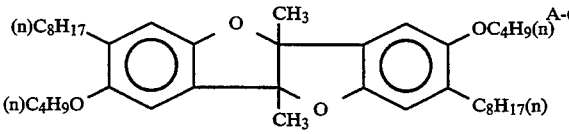

-continued
A-61
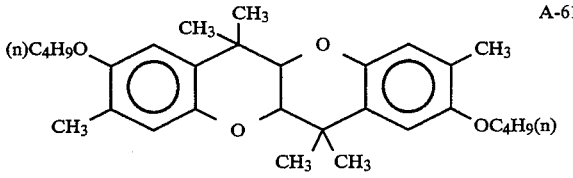
A-62
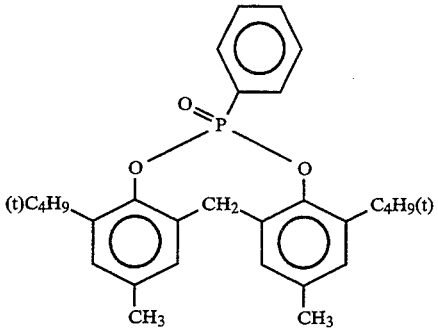
A-63
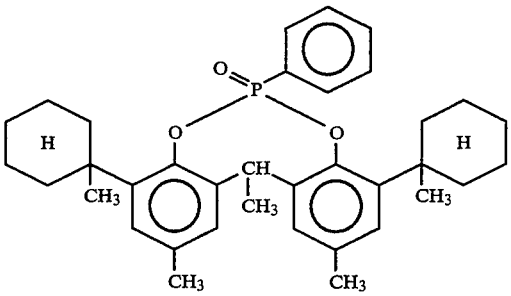
A-64
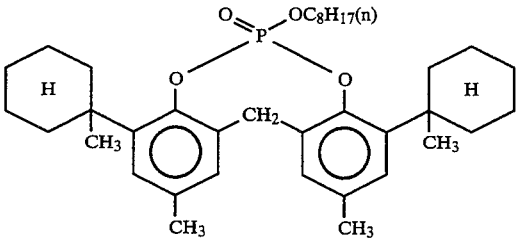
A-65
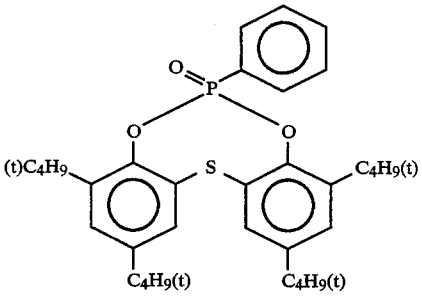
A-66
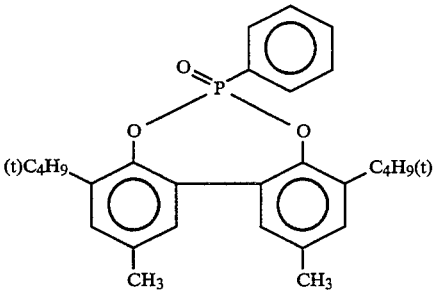
A-67
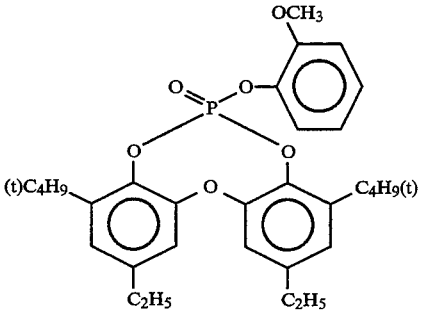
A-68
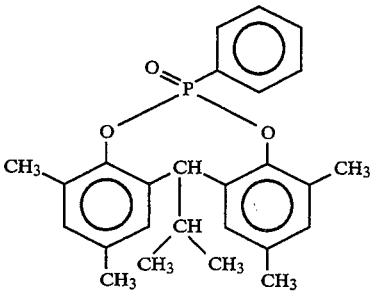
A-69
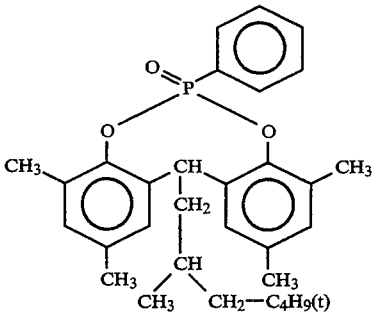
A-70
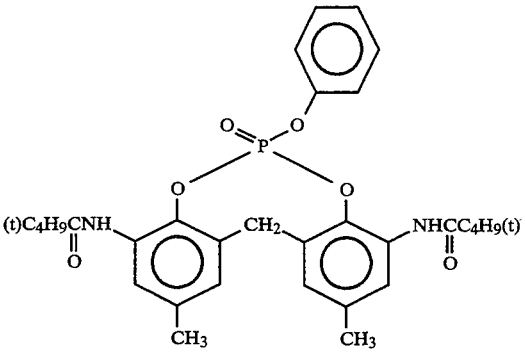

-continued
A-71
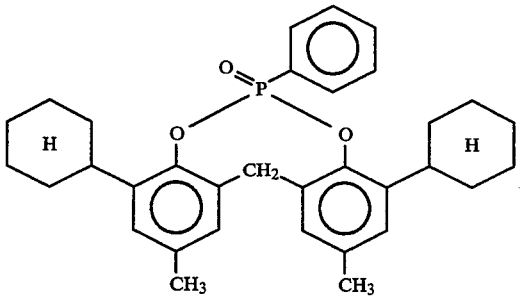
A-72
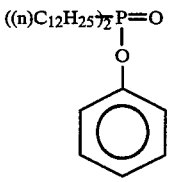
A-73
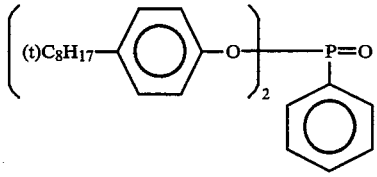
A-74
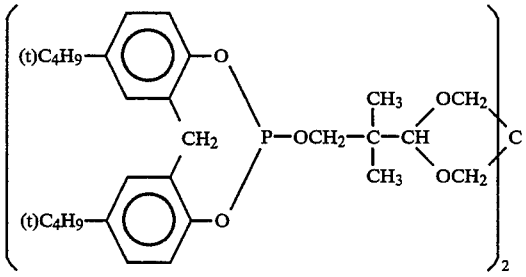
A-75
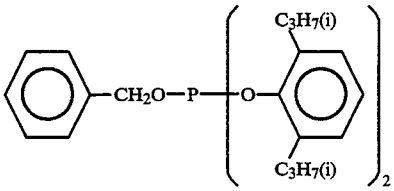
A-76
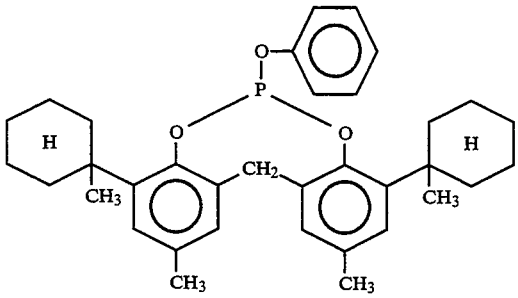
A-77
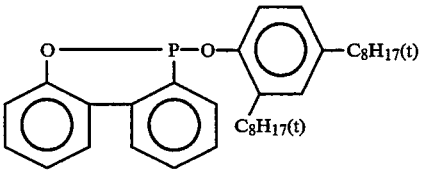
A-78
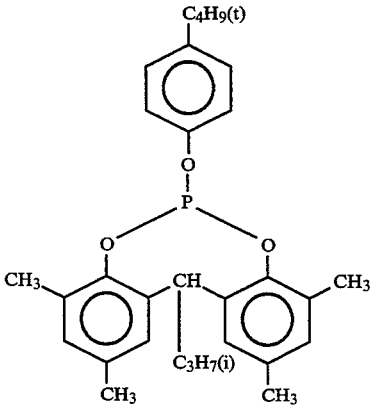
A-79
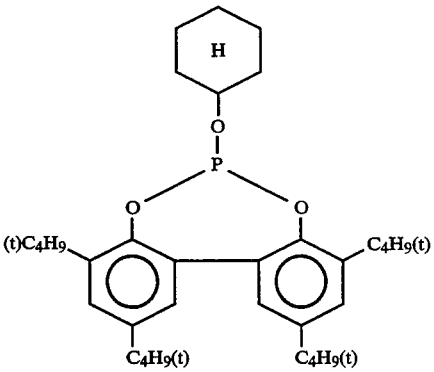
A-80
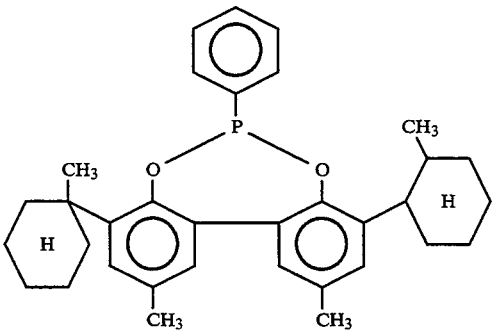

-continued

A-81

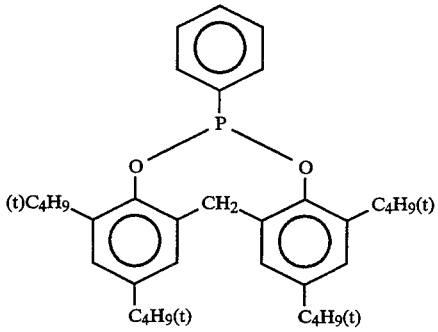

A-82

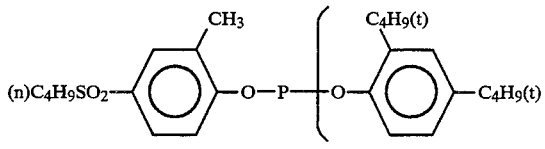

A-83

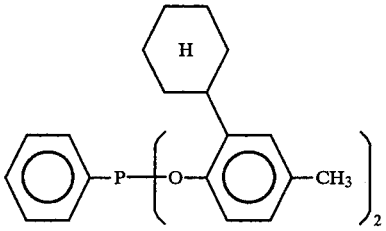

A-84

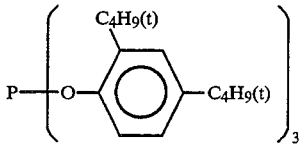

A-85

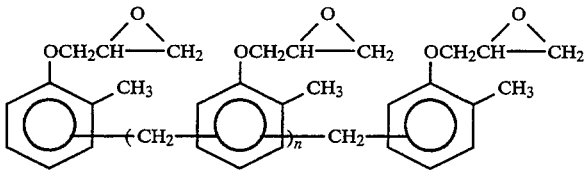

(mixture compound having n of 3 to 12)

A-86

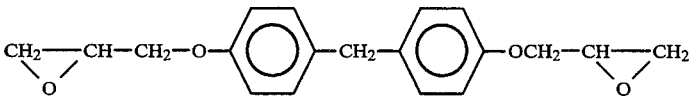

A-87

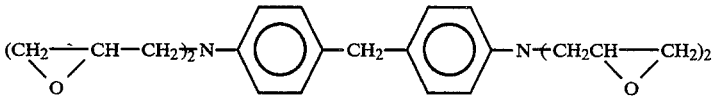

A-88

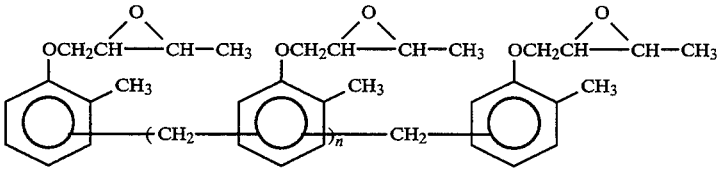

(mixture compound having n of 0 to 7)

A-89

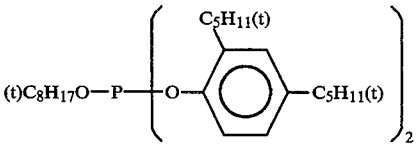

These compounds can be synthesized by the methods described in JP-B-45-14034 (the term "JP-B" as used herewith means an examined Japanese patent publication), JP-B-56-24257, and JP-B-59-52421, JP-A-55-89835, JP-A-56-159644, JP-A-62-244045, JP-A-62-244046, JP-A-62-273531, JP-A-63-220142, JP-A-63-95439, JP-A-63-95448, and JP-A-63-95450, European Patent 0 239 972, Japanese Patent Application No. 3-37719, JP-A-58-105147, JP-A-64-37552, JP-A-64-37553, and JP-A-64-37554, U.S. Pat. No. 4,880,733, JP-A-63-113536, JP-A-63-256952, JP-A-61-137150, JP-A-2-12146, and JP-A-2-181753, JP-B-63-19518, and JP-A-3-25437, or by methods according thereto.

The addition amount of the compounds of the present invention represented by formula (A) varies by kind of a coupler, and it is 0.5 to 300 mol %, preferably 1 to 200 mol %, and most preferably 5 to 150 mol% per mol of the cyan dye-forming coupler represented by formula (I) or (II).

The compounds of the present invention represented by formula (A) are preferably used by co-emulsifying with the coupler represented by formula (I) or (II) in terms of achieving the effects of the present invention.

The compounds of the present invention represented by formula (A) may be used in combination with a conventional anti-fading agent, whereby an anti-fading effect is further increased. Similarly, the compounds themselves represented by formula (A) may be used in a combination of two or more kinds.

In the silver halide color photographic light-sensitive material of the present invention containing a pyrrolotriazole type cyan dye-forming coupler and the compound of the present invention represented by formula (A), a pyrazolotriazole type magenta coupler is preferably used in combination therewith in terms of increasing the previously stated effects of the present invention.

The light-sensitive material of the present invention may be provided on a support with at least one layer containing the cyan coupler of the present invention and the compound of the present invention represented by formula (A); this layer may be a hydrophilic colloid layer provided on the support. In general, the light-sensitive material comprises each at least one blue-sensitive silver halide emulsion layer, green-sensitive silver halide emulsion layer and red-sensitive silver halide emulsion layer provided on the support in this order but this order may vary. Further, an infrared-sensitive silver halide emulsion layer can replace at least one of the above light-sensitive emulsion layers. The silver halide emulsions having the sensitivities in these respective wavelength regions and the color couplers which form the dyes having a complementary color relationship with light to which the emulsions are sensitive can be incorporated into these light-sensitive emulsion layers to carry out color reproduction by a subtractive color process, although it is not necessary that the light-sensitive emulsion layers and the hues of the color couplers have such relationship as mentioned above.

When the cyan couplers of the present invention and the compounds of the present invention represented by formula (A) are applied to a light-sensitive material, they are most preferably applied to a red-sensitive silver halide emulsion layer.

The content of the cyan couplers of the present invention in a light-sensitive material is suitably $1\times10^{-3}$ to 1 mole, preferably $2\times10^{-3}$ to $3\times10^{-1}$ mole per mole of silver halide.

The cyan couplers of the present invention represented by formula (A) can be incorporated into a light-sensitive material by various conventional dispersion methods. Preferred is an oil-in-water dispersion method in which they are dissolved in a high boiling organic solvent (a low boiling organic solvent is used in combination according to necessity) and are emulsified and dispersed in a gelatin aqueous solution to add to a silver halide emulsion.

Examples of the high boiling solvent used in the oil-in-water dispersion method are described in U.S. Pat. No. 2,322,027. The step and effect of a latex dispersing methods as one of the polymer dispersing methods and examples of a latex for impregnation are described in U.S. Pat. No. 4,199,363, German Patent Applications (OLS) 2,541,274 and 2,541,230, JP-B-53-41091, and European Patent Application 029 104 A, and further a dispersion method by an organic solvent-soluble polymer is described in PCT International Patent Publication W088/00723.

Examples of the high boiling organic solvent which can be used in the above oil-in-water dispersion method include, phthalic acid esters (for example, dibutyl phthalate, dioctyl phthalate, dicyclohexyl phthalate, di-2-ethylhexyl phthalate, decyl phthalate, bis(2,4-di-tert-amylphenyl) isophthalate, and bis(1,1-di-ethylpropyl) phthalate), phosphoric acid or phosphonic acid esters (for example, diphenyl phosphate, triphenyl phosphate, tricresyl phosphate, 2-ethylhexyl-diphenyl phosphate, dioctylbutyl phosphate, tricyclo-hexyl phosphate, tri-2-ethylhexyl phosphate, tridodecyl phosphate, and di-2-ethylhexylphenyl phosphate), benzoic acid esters (for example, 2-ethylhexyl benzoate, 2,4-dichlorobenzoate, dodecyl benzoate, and 2-ethylhexyl-p-hydroxybenzoate), amides (for example, N,N-diethyl dodecanamide and N,N-diethyl laurylamide), alcohols or phenols (for example, isostearyl alcohol and 2,4-di-tertamylphenol), aliphatic esters (for example, dibutoxyethyl succinate, di-2-ethylhexyl succinate, 2-hexyldecyl tetradecanate, tributyl citrate, diethyl azelate, isostearyl lactate, and trioctyl citrate), aniline derivatives (for example, N,N-dibutyl-2-butoxy-5-tert-octylaniline), chlorinated paraffin (for example, paraffins having a chlorine content of 10 to 80%), trimesic acid esters (for example, tributyl trimesate), dodecylbenzene, diisopropylnaphthalene, phenols (for example, 2,4-di-tert-amylphenol, 4-dodecylphenol, 4-dodecyloxycarbonylphenol, and 4-(4-dodecyloxyphenyl-sulfonyl) phenol), carboxylic acids (for example, 2-(2,4-di-tertamylphenoxy) butyric acid, and 2-ethoxy-octanedecanoic acid), and alkylphosphoric acids (for example, di-2(ethylhexyl) phosphoric acid and diphenylphosphoric acid). Further, an organic solvent having a boiling point of 30° C. or higher and about 160° C. or lower (for example, ethyl acetate, butyl acetate, ethyl propionate, methyl ethyl ketone, cyclohexanone, 2-ethoxyethyl acetate, and dimethylformamide) may be used in combination as an auxiliary solvent.

The high boiling organic solvents can be used in an amount of 0 to 2.0 times, preferably 0 to 1.0 times by weight to a coupler.

The following patent publications, particularly European Patent Application 0 355 660 A (corresponding to U.S. Pat. No. 5,122,444) describe the silver halide emulsions, other materials (the additives) and photographic constitutional layers (a layer arrangement) preferably applied in the present invention, and the processing methods and additives for processing, which are applied for processing the light-sensitive material:

| Photographic elements | JP-A-62-215272 | JP-A-2-33144 | EP 0 335 660 A2 |
|---|---|---|---|
| Silver halide emulsion | p. 10, right upper col., line 6 to p. 12, left lower col., line 5, and p. 12, right lower col., line 4 from bottom to p. 13, left upper col., | p. 28, right upper col., line 16 to p. 29, right lower col., line 11, and p. 30, lines 2 to 5 | p. 45, line 53 to p. 47, line 3, and p. 47, lines 20 to 22. |

-continued

| Photographic elements | JP-A-62-215272 | JP-A-2-33144 | EP 0 335 660 A2 |
|---|---|---|---|
| | line 17. | | |
| Silver halide solvent | p. 12, left lower col., lines 6 to 14, and p. 13, left upper col., line 3 from bottom to p. 18, left lower col., last line. | | |
| Chemical sensitizer | p. 12, left lower col., line 3 from bottom to right lower col., line 5 from bottom, and p. 18, right lower col., line 1 to p. 22, right upper col., line 9 from bottom. | p. 29, right lower col., line 12 to last line. | p. 47, lines 4 to 9. |
| Spectral sensitizer (spectral sensitizing method) | p. 22, right upper col., line 8 from bottom to p. 38, last line. | p. 30, left upper col., lines 1 to 13. | p. 47, lines 10 to 15. |
| Emulsion stabilizer | p. 39, left upper col., line 1 to p. 72, right upper col., last line. | p. 30, left upper col., line 14 to right upper col., line 1. | p. 47, lines 16 to 19. |
| Development accelerator | p. 72, left lower col., line 1 to p. 91, right upper col., line 3. | | |
| Color coupler (cyan, magenta and cyan couplers) | p. 91, right upper col., line 4 to p. 121, left upper col., line 6. | p. 3, right upper col., line 14 to p. 18, left upper col., last line, and p. 30, right upper col., line 6 to p. 35 right lower col., line 11. | p. 4 lines 15 to 27, p. 5, line 30 to p. 28, last line, p. 45, lines 29 to 31, and p. 47, line 23 to p. 63, line 50. |
| Color forming accelerator | p. 121, left upper col., line 7 to p. 125, right upper col., line 1. | | |
| UV absorber | p. 125, right upper col., line 2 to p. 127, left lower col., last line. | p. 37, right lower col., line 14 to p. 38, left upper col., line 11. | p. 65, lines 22 to 31. |
| Anti-fading agent (an image stabilizer) | p. 127, right lower col., line 1 to p. 137, left lower col., line 8. | p. 36, right upper col., line 12 to p. 37, left upper col., line 19. | p. 4, line 30 to p. 5, line 23, p. 29, line 1 to p. 45, line 25, p. 45, lines 33 to 40, and p. 65, lines 2 to 21. |
| High boiling and/or low boiling organic solvent | p. 137, left lower col., line 9 to p. 144, right upper col., last line | p. 35, right lower col., line 14 to p. 36, left upper col., line 4 from bottom. | p. 64, lines 1 to 51. |
| Method for dispersing photographic additives | p. 144, left lower col., line 1 to p. 146, right upper col., line 7. | p. 27, right lower col., line 10 to p. 28, left upper col., last line, and p. 35, right lower col., line 12 to p. 36, right upper col., line 7. | p. 63, line 51 to p. 64, line 56. |
| Hardener | p. 146, right upper col., line 8 to p. 155, left lower col., line 4. | | |
| Precursor of a developing agent | p. 155, left lower col., line 5 to right lower col., line 2. | | |
| Development inhibitor-releasing compound | p. 155, right lower col., lines 3 to 9. | | |
| Support | p. 155, right lower col., line 19, to p. 156, left upper col., line 14. | p. 38, right upper col., line 18 to p. 39, left upper col., line 3. | p. 66, line 29 to p. 67, line 13. |
| Light-sensitive layer structure | p. 156, left upper col., line 15 to right lower col., line 14. | p. 28, right upper col., lines 1 to 15. | p. 45, lines 41 to 52. |
| Dye | p. 156, right lower col., line 15 to p. 184, right lower col., last line. | p. 38, left upper col., line 12 to right upper col., line 7. | p. 66, lines 18 to 22. |
| Anti-color mixing agent | p. 185, left upper col., line 1 to p. 188, right lower col., line 3. | p. 36, right upper col., lines 8 to 11. | p. 64, line 57 to p. 65, line 1. |
| Gradation controller | p. 188, right lower col., lines 4 to 8. | | |
| Anti-stain agent | p. 188, right lower col., line 9 to p. 193, right lower col., line 10. | p. 37, left upper col., last line to right lower col., line 13. | p. 65, line 32 to p. 66, line 17. |
| Surface active agent | p. 201, left lower col., line 1 to p. 210, right upper col., last line | p. 18, right upper col., line 1 to p. 24, right lower col., last line, and p. 27, left lower col., line 10 from bottom to right lower col., line 9. | |
| Fluorinated compound | p. 210, left lower col., | p. 25, left upper col., | |

-continued

| Photographic elements | JP-A-62-215272 | JP-A-2-33144 | EP 0 335 660 A2 |
|---|---|---|---|
| (anti-electrification agent, coating aid, lubricant and anti-adhesion agent) | line 1 to p. 222, left lower col., line 5. | line 1 to p. 27, right lower col., line 9. | |
| Binder (hydrophilic colloid) | p. 222, left lower col., line 6 to p. 225, left upper col., last line. | p. 38, right upper col., lines 8 to 18. | p. 66, lines 23 to 28. |
| Thickner | p. 255, right upper col., line 1 to p. 227, right upper col., line 2. | | |
| Anti-electrification agent | p. 227, right upper col., line 3 to p. 230, left upper col., line 1. | | |
| Polymer latex | p. 230, left upper col., line 2 to p. 239, last line. | | |
| Matting agent | p. 240, left upper col., line 1 to right upper col., last line. | | |
| Photographic processing method (processing steps and additives) | p. 3, right upper col., line 7 to p. 10, right upper col., line 5. | p. 39, left upper col., line 4 to p. 42, left upper col., last line. | p. 67, line 14 to p. 69, line 28. |

Remarks:
1. There is included in the cited items of JP-A-62-215272, the content amended according to the Amendment dated March 16, 1987.
2. Of the above color couplers, also preferably used are the so-called short wave type yellow couplers described in JP-A-63-231451, JP-A-63-123047, JP-A-63-241547, JP-A-1-173499, JP-A-1-213648, and JP-A-1-250944.

Silver halides which can be used in the present invention include, silver chloride, silver bromide, silver chlorobromide, silver iodochlorobromide and silver iodobromide. Particularly for the purpose of a rapid processing, preferably used is silver chlorobromide containing substantially no silver iodide and having a silver chloride content of 90 mole % or more, more preferably 95 mole % or more, and particularly 98 mole % or more, or pure silver chloride.

For the purpose of improving image sharpness, dyes are preferably incorporated into a hydrophilic colloid layer of the light-sensitive material according to the present invention so that an optical reflection density of the light-sensitive material in 680 nm becomes 0.70 or more, these dyes (among them, an oxonol type dye) capable of being decolored by processing, as described at pages 27 to 76 of European Patent Application 0 337 490 A2. Moreover, titanium oxide is preferably incorporated into the anti-water resin layer of a support; this titanium oxide being subjected to a surface treatment with di- to tetrahydric alcohols (for example, trimethylolethane) in a proportion of 12% by weight or more (more preferably 14% by weight or more).

Also, in the light-sensitive material according to the present invention, the color image preservability-improving compounds described in European Patent Application 0 277 589 A2 are preferably used together with couplers. In particular, they are used preferably in combination with a pyrazoloazole type magenta coupler.

Preferably used simultaneously or singly for preventing side effects of such as the generation of stain due to the reaction of a color developing agent or an oxidation product thereof remaining in a layer during storage after processing with a coupler, are the compounds (A) described in European Patent Application 0 277 589 A2 which are chemically combined with an aromatic amine type developing agent remaining after a color development processing to form a chemically inactive and substantially colorless compound, and/or the compounds (B) described in European Patent Application 0 277 589 A2 which are chemically combined with the oxidation product of an aromatic amine type developing agent remaining after a color development processing to form a chemically inactive and substantially colorless compound.

Further, the anti-mold agents described in JP-A-63-271247 are preferably added to the light-sensitive material according to the present invention for the purpose of preventing various molds and bacteria which grow in a hydrophilic colloid layer to deteriorate an image.

Types of supports for the light-sensitive material according to the present invention for display include a white color polyester type support or a support in which a layer containing a white pigment is provided on a support side having a silver halide emulsion layer. An anti-halation layer is preferably provided on a support side coated thereon with a silver halide emulsion layer or the backside thereof in order to further improve sharpness. In particular, transmission density of the support is preferably controlled in the range of 0.35 to 0.8 so that a display can be viewed with either a reflected light or a transmitted light.

The light-sensitive material according to the present invention may be exposed with either a visible ray or an infrared ray. The exposing manner may be either a low illuminance exposure or a short-time high illuminance exposure. Particularly in the latter case, preferred is a laser scanning exposing method in which an exposing time per a picture element is shorter than $10^{-4}$ second.

In exposure, a band stop filter described in U.S. Pat. No. 4,880,726 is preferably used, whereby a light mixture is removed to notably improve a color reproduction.

The present invention can be applied to, for example, a color paper, a color reversal paper, a direct positive color light-sensitive material, a color negative film, a color positive film, and a color reversal film. Above all, it is preferably applied to a color light-sensitive material having a reflective support (for example, a color paper and a color reversal paper) and a color light-sensitive material for forming a positive image (for example, a direct positive color light-sensitive material, a color positive film and a color reversal film), and is particularly preferably applied to the color light-sensitive material having a reflective support.

The compounds of the present invention are preferably used in combination with the magenta dye-forming coupler and yellow dye-forming coupler which form magenta and yellow dyes, respectively, upon a coupling reaction with an oxidation product of an aromatic primary amine color developing agent. Also, they are preferably used in combination with a conventional phenol type or naphthol type cyan dye-forming coupler.

These couplers used in combination may be either tetraequivalent or diequivalent to the silver ions and may be in the form of a polymer or an oligomer. Further, the couplers used in combination may be a single one or a mixture of two or more kinds.

The couplers preferably used in combination with the cyan couplers of the present invention will be explained.

There can be given as a cyan coupler, phenol type and naphthol type couplers. Preferred are the compounds described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173; German Patent Application (OLS) 3,329,729, European Patent Applications 121 365 A and 249 453 A; U.S. Pat. Nos. 3,446,622, 4,333,999, 4,775,616, 4,451,559, 4,427,767, 4,690,889, 4,254,212, and 4,296,199; and JP-A-61-42658. Further, there can be used in combination therewith, the pyrazoloazole type couplers described in JP-A-64-553, JP-A-64-554, JP-A-64-555, and JP-A-64-556, and the imidazole type couplers described in U.S. Pat. No. 4,818,672.

Particularly preferred cyan couplers include the couplers represented by formulas (C-I) and (C-II) described in the left lower column at page 17 to the left lower column at page 20 of JP-A-2-139544. These couplers may be used in the layer which is the same as or different from that containing the cyan coupler of the present invention, as long as the effects of the present invention are demonstrated.

The 5-pyrazolone type and pyrazoloazole type compounds are preferred as a magenta coupler. More preferred are the compounds described in U.S. Pat. Nos. 4,310,619 and 4,351,897, European Patent 073 636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and International Publication WO 88/04795. Particularly preferred magenta couplers include the pyrazoloazole type magenta couplers described in the right lower column at page 3 to the right lower column at page 10 of JP-A-2-139544 and the 5-pyrazolone magenta couplers represented by formula (M-I) described in the left lower column at page 17 to the left upper column at page 21 of JP-A-2-139544. Most preferred are the above pyrazoloazole type magenta couplers.

Compounds which can be used in combination as a yellow coupler include, U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023 and 4,511,649, European Patent Application 249 473 A, JP-A-63-23145, JP-A-63-123047, JP-A-1-250944, and JP-A-1-213648, as long as the effects of the present invention are not badly affected.

Particularly preferred yellow couplers include the yellow couplers represented by formula (Y) described in the left upper column at page 18 to the left lower column at page 22 of JP-A-2-139544, the acyl acetamide type yellow couplers characterized by an acyl group, described in European Patent Application 0 447 969 A, and the yellow couplers represented by formula (Cp-2) described in European Patent Application 0 446 863 A2.

Compounds releasing a photographically useful residue by coupling can also be used in the present invention. Preferred as a DIR coupler releasing a development inhibitor, are the compounds described in the patents and abstracts of the above RD No. 17643, VII-F, JP-A-57-151944, JP-A-57-154234, JP-A-60-184248, and JP-A-63-37346, and U.S. Pat. Nos. 4,248,962 and 4,782,012.

The compounds preferred as the coupler releasing imagewise a nucleus-forming agent or a development accelerator during developing are described in British Patents 2,097,140 and 2,131,188, and JP-A-59-157638 and JP-A-59-170840.

In addition to the above, couplers which can be used in combination for the light-sensitive material of the present invention include the competitive couplers described in U.S. Pat. No. 4,130,427; the polyequivalent couplers described in U.S. Pat. Nos. 4,283,472, 4,338,393 and 4,310,618; the DIR redox compound-releasing couplers, DIR coupler-releasing couplers, DIR coupler-releasing redox compounds or DIR redox-releasing redox compounds described in JP-A-60-185950 and JP-A-62-24252; the couplers releasing a dye whose color is recovered after splitting off, described in European Patent Application 0 173 302 A; the bleaching accelerator-releasing couplers described in RD NO. 11449 and 24241, and JP-A-61-201247; the ligand-releasing couplers described in U.S. Pat. No. 4,553,477; the couplers releasing a leuco dye, described in JP-A-63-75747; and the couplers releasing a fluorescent dye, described in U.S. Pat. No. 4,774,181.

The standardly used amounts of these color couplers which can be used in combination in the present invention are in the range of 0.001 to 1 mole per mole of a light-sensitive silver halide, preferably 0.01 to 0.5 mole for a yellow coupler, 0.003 to 0.3 mole for a magenta coupler and 0.002 to 0.3 mole for a cyan coupler, each per mole of a light-sensitive silver halide.

The light-sensitive material of the present invention may contain a hydroquinone derivative, an aminophenol derivative, a gallic acid derivative, and an ascorbic acid derivative as an anti-foggant.

Also, for the purpose of preventing deterioration of a cyan dye image by heat and particularly by light, it is more effective to incorporate a UV absorber into a cyan color-developing layer and the both layers adjacent thereto.

There may be used as a UV absorber, benzotriazole compounds substituted with an aryl group (for example, the compounds described in U.S. Pat. No. 3,533,794), 4-thiazolidone compounds (for example, the compounds described in U.S. Pat. Nos. 3,314,794 and 3,352,681), benzophenone compounds (for example, the compounds described in JP-A-46-2784), cinnamic acid ester compounds (for example, the compounds described in U.S. Patents 3,705,805 and 3,707,395), butadiene compounds (for example, the compounds described in U.S. Pat. No. 4,045,229), and benzoxazole compounds (for example, the compounds described in U.S. Pat. Nos. 3,406,070 and 4,271,307). There may be used a UV absorptive coupler (for example, an α-naphthol type cyan dye-forming coupler) and a LB; absorptive polymer. These UV absorbers may be mordanted in a specific layer. Of the above compounds, the benzotriazole compounds substituted with an aryl group are preferred.

The light-sensitive material according to the present invention can be subjected to a development processing by the conventional method described at pages 28 to 29 of *Research Disclosure* No. 17643 and in a left column to a right column of 615 of *Research Disclosure* No. 18716. For example, a color development processing step, a desilver processing step, and a rinsing processing step are carried out. In the desilver processing step, a bleaching step using a bleaching agent and a fixing step using a fixing agent can be replaced with a bleach-fixing step using a bleach-fixing agent, and a bleaching step, a fixing step and a bleach-fixing step may be combined in an arbitrary order. The rinsing step may be replaced with a stabilizing step, and the rinsing step may be followed by the stabilizing step. Further, a mono bath processing step can be carried out in which color developing, bleaching and fixing are carried out in a single bath using a mono bath develop-bleach-fixing processing solution. In combination with these processing steps, there may be carried out a pre-hardening processing step, a neutralizing step therefor, a stop-fixing processing step, a post-hardening processing step, an adjusting step, and an intensifying step. Further, a rinsing processing step may optionally be provided between the above-described processing steps. In these processings, the color development processing step may be replaced with a so-called activator processing step.

EXAMPLES

The present invention will be explained below with reference to the examples but not limited thereto.

EXAMPLE 1

The layer of the following composition was provided on a subbed triacetyl cellulose support to thereby prepare a single layer light-sensitive material for evaluation (Sample Preparation of an Emulsion Layer Coating Solution Ethyl acetate (10 ml) and tricresyl phosphate of the weight amount equivalent to that of a coupler were added to the coupler (1.85 mmol) for dissolving. This solution was emulsified and dispersed in a 14 % gelatin aqueous solution 33 g containing a 10 % sodium dodecylbenzenesulfonate solution (3 ml). Meanwhile, a silver chlorobromide emulsion (silver bromide: 70 mole %), which was subjected to sulfur sensitization, was prepared, and this was mixed with the above emulsion, whereby the coating solution was prepared so that the composition of the emulsion layer became as shown below. Sodium 1-oxy-3,5-dichloro-s-triazine was used as a hardener.

Layer Structure

The layer structure of the sample used in the present invention is shown below (the numerals show the coated amounts per $m^2$).

| | |
|---|---|
| Support: | |
| Triacetyl cellulose support | |
| Emulsion layer: | |
| Silver chlorobromide emulsion (above mentioned) | 4.0 mmol |
| Coupler (R-1) | 1.0 mmol |
| Solvent | (the same amount as the coated amount of the coupler) |
| Gelatin | 5.2 g |
| Protective layer: | |
| Gelatin | 1.3 g |
| Acryl-modified copolymer of vinyl alcohol (modification degree: 17%) | 0.17 g |
| Liquid paraffin | 0.03 g |

The above light-sensitive material was imagewise exposed via an optical wedge and then was processed at the following processing steps:

| Processing steps | | |
|---|---|---|
| Processing step | Temperature | Time |
| Color developing | 33° C. | 2 minutes |
| Bleach/fixing | 33° C. | 1.5 minutes |
| Rinsing | 33° C. | 3 minutes |

| Composition of the processing solutions | |
|---|---|
| Color developing solution: | |
| Distilled water | 800 ml |
| Triethanolamine | 8.1 g |
| Diethylhydroxylamine | 4.2 g |
| Potassium bromide | 0.6 g |
| Sodium hydrogencarbonate | 3.9 g |
| Sodium sulfite | 0.13 g |
| N-ethyl-N-(β-methanesulfonamidethyl)-3-methyl-4-aminoaniline sulfate | 5.0 g |
| Potassium carbonate | 18.7 g |
| Water was added to | 1000 ml |
| pH | 10.25 |
| Bleach/fixing solution: | |
| Distilled water | 400 ml |
| Ammonium thiosulfate (700 g/liter) | 150 ml |
| Sodium sulfate | 18.0 g |
| Iron (III) ammonium ethylenediaminetetracetate | 55.0 g |
| Sodium ethylenediaminetetracetate | 5.0 g |
| Water was added to | 1000 ml |
| pH | 6.70 |

Next, the samples were prepared in the same manner as Sample 1 except that the coupler of Sample 1 was replaced with the equimolar couplers of the present invention and further that the anti-fading agents shown in Tables 1 to 4 were added by 25 % by weight based on an amount of the coupler and the anti-fading agents shown in Table 5 were added by 10, 20, 50 and 100% by weight based on an amount of the coupler.

The structure of the coupler used as a comparative compound in the present invention is shown below:

R-1

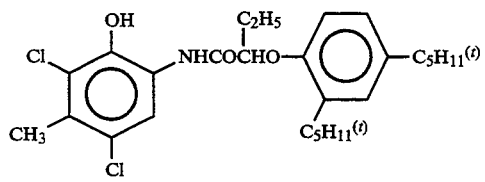

-continued

R-2

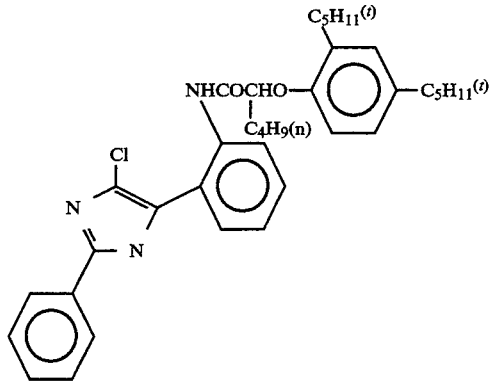

Compound described in European Patent 0 249 453

R-3

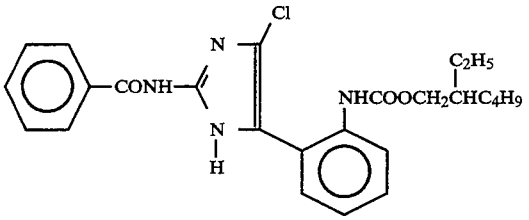

Compound described in European Patent 0 320 778

M-1

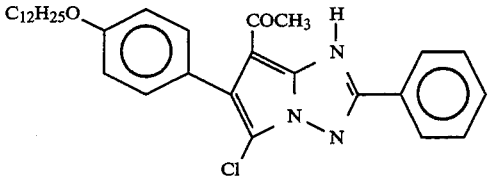

Compound described in JP-A-62-279340

After processing, the samples were subjected to the measurement of optical density with a red light by using a densitometer (manufactured by Fuji Photo Film Co., Ltd.). After these samples were stored under the irradiation of a xenon light (an intermittent irradiation with the light of 100,000 lux of every 12 hours with the other 12 hours in a dark condition) for 16 days for evaluating light fading or under the condition of 80° C. and 60% RH for 14 days for evaluating dark fading, they were subjected once again to the measurement of the density with the red light to evaluate the fading (a residual rate) at the initial density of 1.5. The results thereof are shown in Tables 1 to 5.

TABLE 1

| Sample No. | Coupler | Anti-fading agent | Dmax | Light fading (Residual rate) | Dark fading (Residual rate) |
|---|---|---|---|---|---|
| 1 (Comp.) | R-1 | — | 2.12 | 70 | 60 |
| 2 (Comp.) | R-2 | — | 1.78 | 12 | 15 |
| 3 (Comp.) | R-2 | A-1 | 1.71 | 22 | 25 |
| 4 (Comp.) | R-2 | A-2 | 1.69 | 26 | 28 |
| 5 (Comp.) | R-2 | A-8 | 1.70 | 20 | 22 |
| 6 (Comp.) | R-2 | A-13 | 1.68 | 21 | 21 |
| 7 (Comp.) | R-2 | A-30 | 1.65 | 19 | 25 |
| 8 (Comp.) | R-2 | A-32 | 1.69 | 25 | 24 |
| 9 (Comp.) | R-2 | A-33 | 1.71 | 23 | 24 |
| 10 (Comp.) | R-2 | A-36 | 1.71 | 20 | 21 |
| 11 (Comp.) | R-2 | A-44 | 1.68 | 17 | 25 |

TABLE 1-continued

| Sample No. | Coupler | Anti-fading agent | Dmax | Light fading (Residual rate) | Dark fading (Residual rate) |
|---|---|---|---|---|---|
| 12 (Comp.) | R-2 | A-53 | 1.70 | 22 | 27 |
| 13 (Comp.) | R-2 | A-57 | 1.72 | 19 | 22 |
| 14 (Comp.) | R-2 | A-74 | 1.66 | 22 | 26 |
| 15 (Comp.) | R-3 | — | 1.95 | 16 | 20 |
| 16 (Comp.) | R-3 | A-1 | 1.83 | 25 | 29 |
| 17 (Comp.) | R-3 | A-2 | 1.85 | 31 | 33 |
| 18 (Comp.) | R-3 | A-8 | 1.87 | 27 | 28 |
| 19 (Comp.) | R-3 | A-13 | 1.81 | 22 | 27 |
| 20 (Comp.) | R-3 | A-30 | 1.82 | 23 | 29 |
| 21 (Comp.) | R-3 | A-32 | 1.88 | 25 | 25 |
| 22 (Comp.) | R-3 | A-33 | 1.85 | 28 | 26 |
| 23 (Comp.) | R-3 | A-36 | 1.84 | 25 | 24 |
| 24 (Comp.) | R-3 | A-44 | 1.79 | 26 | 27 |
| 25 (Comp.) | R-3 | A-53 | 1.80 | 21 | 28 |
| 26 (Comp.) | R-3 | A-57 | 1.81 | 27 | 23 |
| 27 (Comp.) | R-3 | A-74 | 1.76 | 23 | 27 |

TABLE 2

| Sample No. | Coupler | Anti-fading agent | Dmax | Light fading (Residual rate) | Dark fading (Residual rate) |
|---|---|---|---|---|---|
| 28 (Comp.) | M-1 | — | (2.65) | 25 | 27 |
| 29 (Comp.) | M-1 | A-2 | (2.31) | 36 | 33 |
| 30 (Comp.) | M-1 | A-8 | (2.28) | 32 | 31 |
| 31 (Comp.) | (3) | — | 2.55 | 33 | 52 |
| 32 (Inv.) | (3) | A-1 | 2.51 | 74 | 73 |
| 33 (Inv.) | (3) | A-2 | 2.54 | 80 | 82 |
| 34 (Inv.) | (3) | A-8 | 2.50 | 78 | 75 |
| 35 (Inv.) | (3) | A-13 | 2.51 | 75 | 68 |
| 36 (Inv.) | (3) | A-30 | 2.49 | 70 | 73 |
| 37 (Inv.) | (3) | A-32 | 2.51 | 78 | 75 |
| 38 (Inv.) | (3) | A-33 | 2.47 | 72 | 72 |
| 39 (Inv.) | (3) | A-36 | 2.55 | 73 | 70 |
| 40 (Inv.) | (3) | A-44 | 2.51 | 71 | 77 |
| 41 (Inv.) | (3) | A-53 | 2.53 | 76 | 74 |
| 42 (Inv.) | (3) | A-57 | 2.50 | 75 | 73 |
| 43 (Inv.) | (3) | A-74 | 2.48 | 70 | 72 |
| 44 (Inv.) | (3) | A-7 | 2.47 | 68 | 68 |
| 45 (Inv.) | (3) | A-18 | 2.51 | 63 | 61 |
| 46 (Inv.) | (3) | A-23 | 2.54 | 69 | 60 |
| 47 (Inv.) | (3) | A-24 | 2.48 | 71 | 66 |
| 48 (Inv.) | (3) | A-25 | 2.42 | 67 | 63 |
| 49 (Inv.) | (3) | A-49 | 2.46 | 65 | 59 |
| 50 (Inv.) | (3) | A-50 | 2.50 | 68 | 62 |
| 51 (Inv.) | (3) | A-54 | 2.48 | 70 | 64 |
| 52 (Inv.) | (3) | A-76 | 2.37 | 69 | 69 |
| 53 (Inv.) | (3) | A-80 | 2.44 | 64 | 68 |

TABLE 3

| Sample No. | Coupler | Anti-fading agent | Dmax | Light fading (Residual rate) | Dark fading (Residual rate) |
|---|---|---|---|---|---|
| 54 (Comp.) | (39) | — | 2.47 | 41 | 55 |
| 55 (Inv.) | (39) | A-1 | 2.43 | 80 | 82 |
| 56 (Inv.) | (39) | A-2 | 2.46 | 87 | 87 |
| 57 (Inv.) | (39) | A-8 | 2.45 | 82 | 79 |
| 58 (Inv.) | (39) | A-13 | 2.44 | 83 | 78 |
| 59 (Inv.) | (39) | A-30 | 2.46 | 81 | 80 |
| 60 (Inv.) | (39) | A-32 | 2.43 | 79 | 76 |
| 61 (Inv.) | (39) | A-33 | 2.40 | 80 | 79 |
| 62 (Inv.) | (39) | A-36 | 2.42 | 79 | 77 |
| 63 (Inv.) | (39) | A-44 | 2.45 | 82 | 80 |
| 64 (Inv.) | (39) | A-53 | 2.44 | 84 | 81 |
| 65 (Inv.) | (39) | A-69 | 2.41 | 83 | 79 |
| 66 (Inv.) | (39) | A-74 | 2.42 | 80 | 81 |
| 67 (Inv.) | (39) | A-7 | 2.40 | 76 | 73 |
| 68 (Inv.) | (39) | A-18 | 2.38 | 73 | 72 |
| 69 (Inv.) | (39) | A-23 | 2.37 | 75 | 69 |
| 70 (Inv.) | (39) | A-24 | 2.41 | 80 | 64 |
| 71 (Inv.) | (39) | A-25 | 2.39 | 72 | 68 |
| 72 (Inv.) | (39) | A-49 | 2.37 | 73 | 65 |

TABLE 3-continued

| Sample No. | Coupler | Anti-fading agent | Dmax | Light fading (Residual rate) | Dark fading (Residual rate) |
|---|---|---|---|---|---|
| 73 (Inv.) | (39) | A-50 | 2.34 | 71 | 70 |
| 74 (Inv.) | (39) | A-54 | 2.39 | 75 | 62 |
| 75 (Inv.) | (39) | A-76 | 2.31 | 69 | 61 |
| 76 (Inv.) | (39) | A-80 | 2.40 | 73 | 72 |

TABLE 4

| Sample No. | Cyan Coupler | Anti-fading agent | Dmax | Light fading (Residual rate) | Dark fading (Residual rate) |
|---|---|---|---|---|---|
| 77 (Comp.) | (1) | — | 2.51 | 30 | 48 |
| 78 (Inv.) | (1) | A-2 | 2.49 | 72 | 68 |
| 79 (Inv.) | (1) | A-8 | 2.48 | 70 | 65 |
| 80 (Inv.) | (1) | A-69 | 2.44 | 62 | 66 |
| 81 (Comp.) | (2) | — | 2.48 | 29 | 45 |
| 82 (Inv.) | (2) | A-2 | 2.46 | 72 | 69 |
| 83 (Inv.) | (2) | A-8 | 2.45 | 68 | 67 |
| 84 (Inv.) | (2) | A-32 | 2.43 | 65 | 60 |
| 85 (Comp.) | (34) | — | 2.44 | 37 | 51 |
| 86 (Inv.) | (34) | A-2 | 2.42 | 74 | 78 |
| 87 (Inv.) | (34) | A-8 | 2.42 | 71 | 75 |
| 88 (Inv.) | (34) | A-57 | 2.40 | 63 | 63 |
| 89 (Comp.) | (36) | — | 2.41 | 35 | 52 |
| 90 (Inv.) | (36) | A-2 | 2.39 | 71 | 75 |
| 91 (Inv.) | (36) | A-8 | 2.35 | 70 | 78 |
| 92 (Inv.) | (36) | A-32 | 2.31 | 66 | 69 |
| 93 (Comp.) | (15) | — | 2.52 | 38 | 48 |
| 94 (Inv.) | (15) | A-2 | 2.51 | 75 | 75 |
| 95 (Inv.) | (15) | A-8 | 2.50 | 74 | 70 |
| 96 (Inv.) | (15) | A-36 | 2.50 | 67 | 66 |
| 97 (Comp.) | (19) | — | 2.51 | 36 | 43 |
| 98 (Inv.) | (19) | A-2 | 2.51 | 70 | 68 |
| 99 (Inv.) | (19) | A-8 | 2.49 | 69 | 65 |
| 100 (Inv.) | (19) | A-30 | 2.45 | 65 | 59 |
| 101 (Comp.) | (48) | — | 2.19 | 25 | 41 |
| 102 (Inv.) | (48) | A-2 | 2.18 | 68 | 69 |
| 103 (Inv.) | (48) | A-8 | 2.15 | 63 | 63 |
| 104 (Inv.) | (48) | A-57 | 2.14 | 59 | 60 |

TABLE 5

| Sample No. | Cyan Coupler | Anti-fading agent Kind | Anti-fading agent Amount | Light fading (Residual rate) | Dark fading (Residual rate) |
|---|---|---|---|---|---|
| 31 (Comp.) | (3) | — | — | 33 | 52 |
| 105 (Inv.) | (3) | A-2 | 10% | 64 | 66 |
| 106 (Inv.) | (3) | A-2 | 20% | 74 | 75 |
| 107 (Inv.) | (3) | A-2 | 50% | 85 | 83 |
| 108 (Inv.) | (3) | A-2 | 100% | 88 | 90 |
| 109 (Inv.) | (3) | A-8 | 10% | 61 | 62 |
| 110 (Inv.) | (3) | A-8 | 20% | 72 | 70 |
| 111 (Inv.) | (3) | A-8 | 50% | 78 | 75 |
| 112 (Inv.) | (3) | A-8 | 100% | 81 | 81 |
| 113 (Inv.) | (3) | A-69 | 10% | 55 | 68 |
| 114 (Inv.) | (3) | A-69 | 20% | 68 | 73 |
| 115 (Inv.) | (3) | A-69 | 50% | 80 | 77 |
| 116 (Inv.) | (3) | A-69 | 100% | 83 | 79 |
| 54 (Comp.) | (39) | — | — | 41 | 55 |
| 117 (Inv.) | (39) | A-2 | 10% | 68 | 63 |
| 118 (Inv.) | (39) | A-2 | 20% | 80 | 82 |
| 119 (Inv.) | (39) | A-2 | 50% | 90 | 91 |
| 120 (Inv.) | (39) | A-2 | 100% | 93 | 92 |
| 121 (Inv.) | (39) | A-8 | 10% | 65 | 67 |
| 122 (Inv.) | (39) | A-8 | 20% | 74 | 71 |
| 123 (Inv.) | (39) | A-8 | 50% | 88 | 83 |
| 124 (Inv.) | (39) | A-8 | 100% | 90 | 87 |

The maximum densities (Dmax) just after processing are shown together in the tables.

It was visually observed that the couplers of the present invention provided a clear and beautiful cyan color in comparison to that provided by the comparative coupler R-1.

The measuring results with the conventional pyrrolotriazole type magenta coupler M-1 are shown in Samples No. 28 to 30 in Table 2. The optical densities obtained with this coupler were measured with a green light.

As is apparent from the results summarized in the table, the anti-fading performance is markedly inferior in the conventional comparative compounds R-2 and R-3 while a hue is excellent. While a slight improvement is observed only where the anti-fading agent according to the present invention is used in combination therewith, a satisfactory level is not deemed to be reached in a practical use.

The conventional pyrrolotriazole type magenta coupler M-1 provides an inferior anti-fading performance as well and also in this case the combined use of the anti-fading agent according to the present invention provides only a little improvement.

Meanwhile, the pyrrolotriazole type cyan couplers of the present invention show the notable effects by being used in combination with the anti-fading agents according to the present invention and are deemed to reach an almost satisfactory level.

EXAMPLE 2

A paper support laminated on the both sides thereof with polyethylene, which was subjected to a corona discharge treatment, was provided with a gelatin subbing layer containing sodium dodecylbenzenesulfonate, and further was coated with the various photographic constitutional layers, whereby the multilayered color photographic paper (Sample 201) having the following layer constitution was prepared. The coating solutions were prepared in the following manner.

Preparation of the First Layer Coating Solution

Ethyl acetate (180 ml), and 25 g each of solvent (Solv-1) and solvent (Solv-2) were added to a yellow coupler (ExY) (153.0 g), a dye image stabilizer (Cpd-1) (15.0 g), a dye image stabilizer (Cpd-2) (7.5 g), and a dye image stabilizer (Cpd-3) (16.0 g) for dissolving them and this solution was dispersed in a 10% gelatin aqueous solution (1000 g) containing a 10% sodium dodecylbenzenesulfonate aqueous solution (60 ml) and citric acid (10 g), to thereby prepare the emulsified dispersion A.

Meanwhile, a silver chlorobromide emulsion B was prepared (cube, a 6:4 mixture by Ag mole ratio of the large size emulsion B1 with an average grain size of 0.88 μm and the small size emulsion B2 with an average grain size of 0.70 μm, wherein the fluctuation coefficients in the grain size distributions were 0.08 and 0.10, respectively, and either size emulsions contained the grains in which AgBr 0.3 mol % was localized on a part of the surface thereof).

The foregoing emulsified dispersion A and this silver chlorobromide emulsion B were mixed and dissolved, whereby the first layer-coating solution was prepared so that it was of the following composition.

Preparation of the Fifth Layer-Coating Solution

Ethyl acetate (60.0 ml) was added to a cyan coupler (ExC) (33.0 g), a UV absorber (UV-2) (18.0 g), a dye image stabilizer (Cpd-1) (33.0 g), a solvent (Solv-6) (22.0 g), and a solvent (Solv-1) (1.0 g) to dissolve them. This solution was added to a 20% gelatin aqueous solution (500 ml) containing sodium dodecylbenzenesulfonate (8 g) and then was dispersed to an emulsion with a supersonic homogenizer to thereby prepare an emulsified dispersion.

Meanwhile, a silver chlorobromide emulsion C was prepared (cube, a 1:4 mixture by Ag mole ratio of the large size emulsion C with an average grain size of 0.50 μm and the small size emulsion C with an average grain size of 0.41 μm, wherein the fluctuation coefficients of the grain size distributions were 0.09 and 0.11, respectively, and either size emulsions contained the grains in which AgBr (0.8 mol %) was localized on a part of the surface thereof).

Further, a sulfur sensitizer and a gold sensitizer were added to this emulsion to subject it to a chemical ripening. The foregoing emulsified dispersion and this red-sensitive silver chlorobromide emulsion C were mixed and dissolved, whereby the fifth layer-coating solution was prepared so that it was of the following composition. The coating solutions for the 2nd layer to 4th layer, the 6th layer and the 7th layer were prepared in the same manner as the 1st layer-coating solution. Sodium 1-oxy-3,5-dichloro-s-triazine was used as the gelatin hardener for the respective layers.

Further, Cpd-15 and Cpd-16 were added to the respective layers so that the whole amounts thereof became 25.0 mg/m$^2$ and 50.0 mg/m$^2$, respectively.

The following spectral sensitizing dyes were used for silver chlorobromide emulsion in the respective light-sensitive emulsion layers.

Blue-Sensitive Emulsion Layer

Sensitizing dye A

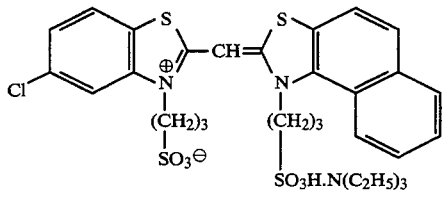

and

Sensitizing dye B

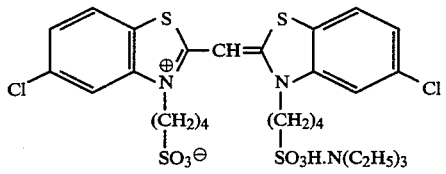

(each $2.0\times10^{-4}$ mole per mole of silver halide to the large size emulsion and each $2.5\times10^{-4}$ mole per mole of silver halide to the small size emulsion)

Green-Sensitive Emulsion Layer

Sensitizing dye C

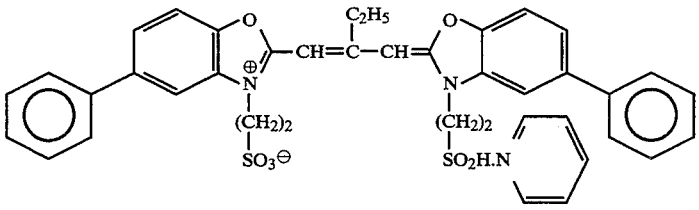

($4.0\times10^{-3}$ mole per mole of silver halide to the large size emulsion and $5.6\times10^{-4}$ mole per mole of silver halide to the small size emulsion), and Sensitizing dye D

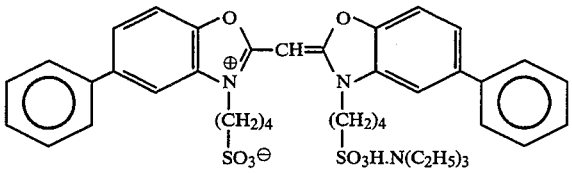

($7.0\times10^{-5}$ mole per mole of silver halide to the large size emulsion and $1.0\times10^{-5}$ mole per mole of silver halide to the small size emulsion).

Red-Sensitive Emulsion Layer

Sensitizing dye E

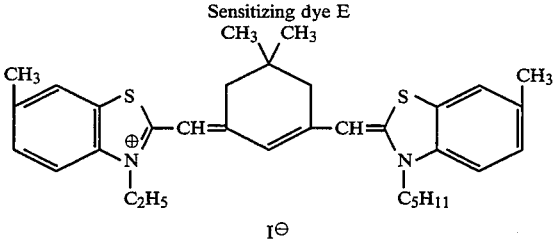

($0.9\times10^{-4}$ mole per mole of silver halide to the large size emulsion and $1.1\times10^{-4}$ mole per mole of silver halide to the small size emulsion).

Further, the following compound F of $2.6\times10^{-3}$ mole per mole of silver halide was added.

Compound F

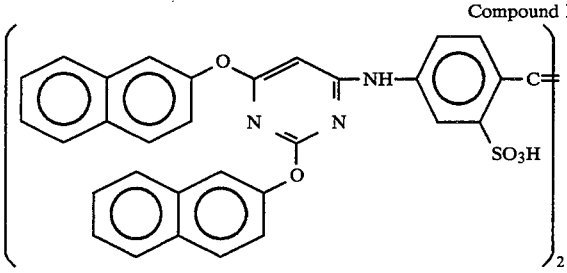

Further, 1-(5-methylureidophenyl)-5-mercaptotetrazole was added to the blue-sensitive layer, green-sensitive layer and red-sensitive layer in the amounts of $3.4\times10^{-4}$ mole, $9.7\times10^{-4}$ mole and $5.5\times10^{-4}$ mole per mole of silver halide, respectively.

Further, 4-hydroxy-6-methyl-1,3,3a,7-tetrazaindene was added to the blue-sensitive layer and green-sensitive layer in the amounts of $1\times10^{-4}$ mole and $2\times10^{-4}$ mole per mole of silver halide, respectively.

The following dye (the number in the parenthesis represents a coated amount) was added to an emulsion layer in order to prevent irradiation:

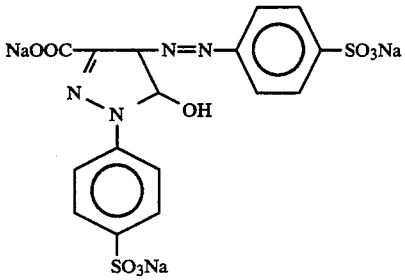

(10 mg/m²),

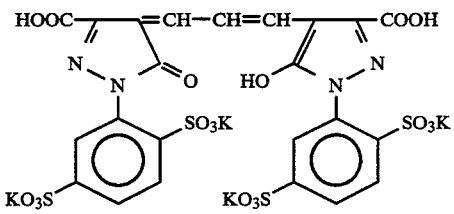

(10 mg/m²),

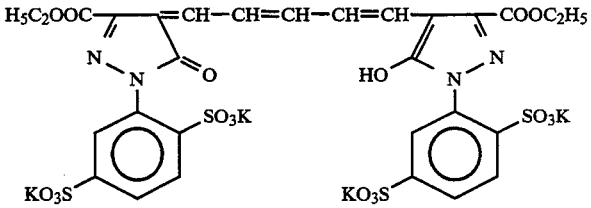

(40 mg/m²)

and

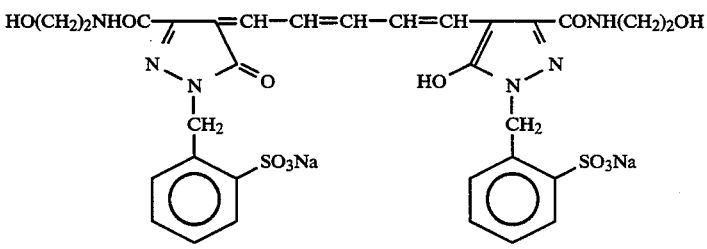

(20 mg/m²)

Layer Constitution

The compositions of the respective layers are shown below. The numerals represent the coated amounts (g/m²). The coated amounts of the silver halide emulsions are expressed in terms of the amounts converted to silver.

| | |
|---|---|
| Support: | |
| Polyethylene laminated paper (polyethylene coated on the 1st layer side contains a white pigment ($TiO_2$) and a blue dye (ultramarine)). | |
| First layer: a blue-sensitive emulsion layer | |
| Silver chlorobromide emulsion (cube; 6:4 mixture by Ag mole ratio of the large size emulsion having an average grain size of 0.88 μm and the small size emulsion having an average grain size of 0.70 μm, wherein the fluctuation coefficients of the grain size distributions were 0.08 and 0.10, respectively, and either size emulsions contained the grains in which AgBr (0.3 mol %) was localized on a part of the surface thereof) | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| Second layer: an anti-color mixing layer | |
| Gelatin | 0.99 |

-continued

| | |
|---|---|
| Anti-color mixing agent (Cpd-4) | 0.08 |
| Solvent (Solv-2) | 0.25 |
| Solvent (Solv-3) | 0.25 |
| Third layer: a green-sensitive emulsion layer | |
| Silver chlorobromide emulsion (cube; 6:4 mixture by Ag mole ratio of the large size emulsion having an average grain size of 0.55 μm and the small size emulsion having an average grain size of 0.39 μm, wherein the fluctuation coefficients of the grain size distributions were 0.10 and 0.08, respectively, and either size emulsions contained the grains in which AgBr (0.8 mol %) was localized on a part of the surface thereof) | 0.13 |
| Gelatin | 1.45 |
| Magenta coupler (ExM) | 0.16 |
| Dye image stabilizer (Cpd-6) | 0.15 |
| Dye image stabilizer (Cpd-2) | 0.03 |
| Dye image stabilizer (Cpd-7) | 0.01 |
| Dye image stabilizer (Cpd-8) | 0.01 |
| Dye image stabilizer (Cpd-9) | 0.08 |
| Solvent (Solv-3) | 0.50 |
| Solvent (Solv-4) | 0.15 |
| Solvent (Solv-5) | 0.15 |
| Fourth layer: an anti-color mixing layer | |
| Gelatin | 0.70 |
| UV absorber (UV-1) | 0.47 |
| Anti-color mixing agent (Cpd-4) | 0.04 |
| Solvent (Solv-7) | 0.07 |
| Solvent (Solv-2) | 0.18 |
| Solvent (Solv-3) | 0.18 |
| Fifth layer: a red-sensitive emulsion layer | |
| Silver chlorobromide emulsion C | 0.21 |
| Gelatin | 0.88 |
| Cyan coupler (ExC) | 0.33 |
| UV absorber (UV-2) | 0.18 |
| Dye image stabilizer (Cpd-1) | 0.33 |
| Solvent (Solv-6) | 0.22 |
| Solvent (Solv-1) | 0.01 |
| Sixth layer: a UV absorbing layer | |
| Gelatin | 0.55 |
| UV absorber (UV-1) | 0.38 |
| Dye image stabilizer (Cpd-13) | 0.15 |
| Dye image stabilizer (Cpd-8) | 0.02 |
| Seventh layer: a protective layer | |
| Gelatin | 1.13 |
| Acryl-modified copolymer of polyvinyl alcohol (a modification degree: 17%) | 0.15 |
| Liquid paraffin | 0.03 |
| Dye image stabilizer (Cpd-14) | 0.01 |

Yellow coupler (ExY)

1:1 mixture (mole ratio) of

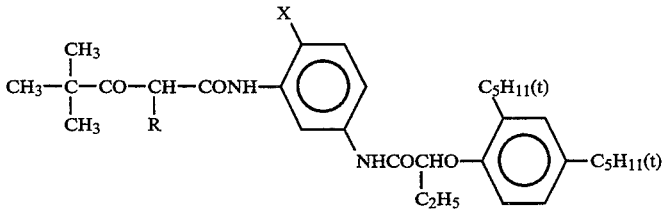

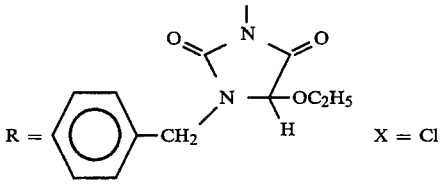

and

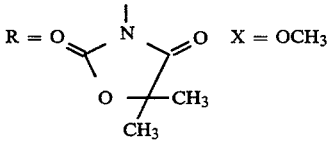

-continued
Magenta coupler (ExM)
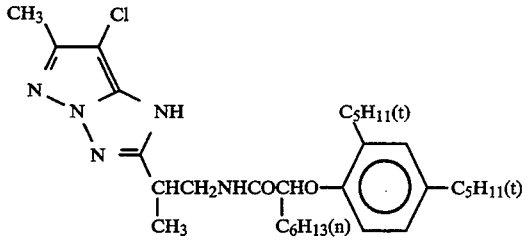
Cyan coupler (ExC)
1:1 mixture (mole ratio) of
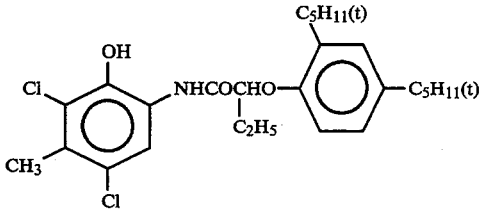
and
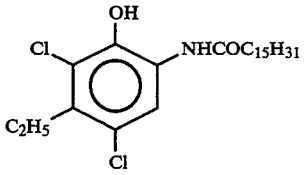
Dye image stabilizer (Cpd-1)
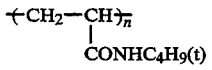
Average molecular weight: 60,000
Dye image stabilizer (Cpd-2)
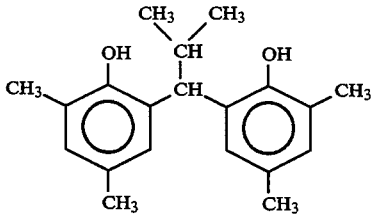
Dye image stabilizer (Cpd-3)
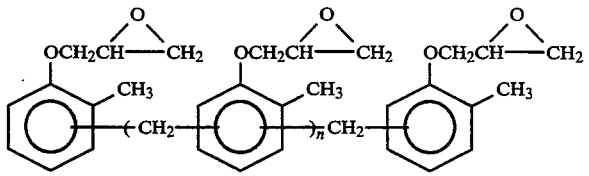
n = 7 to 8 (average value)
Anti-color mixing agent (Cpd-4)

-continued
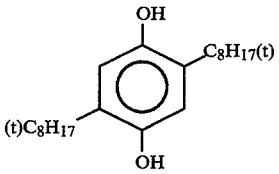
Dye image stabilizer (Cpd-6)
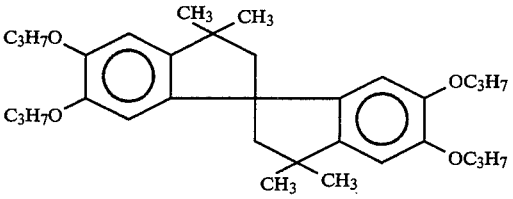
Dye image stabilizer (Cpd-7)
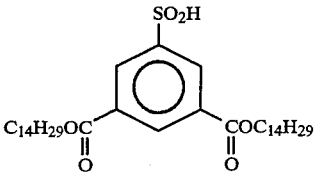
Dye image stabilizer (Cpd-8)
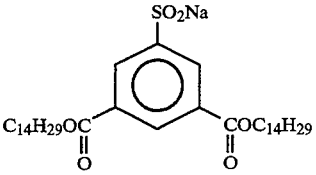
Dye image stabilizer (Cpd-9)
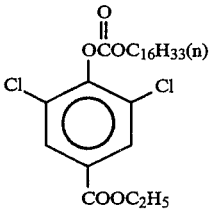
(Cpd-13)
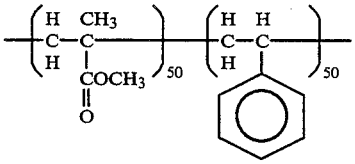
an average molecular weight: about 60,000
(Cpd-14)
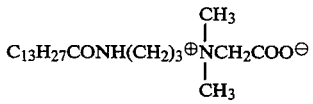
Preservative (Cpd-15)

-continued
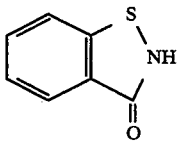
Preservative (Cpd-16)
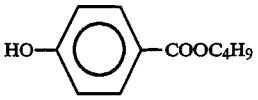
UV absorber (UV-1)
10:5:1:5 mixture (weight ratio) of
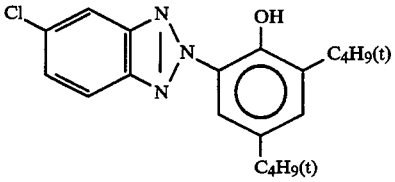
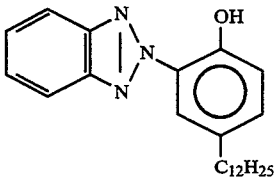
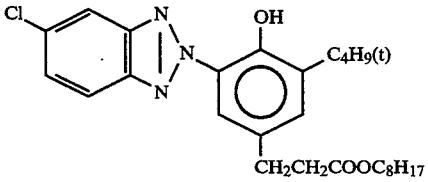
and
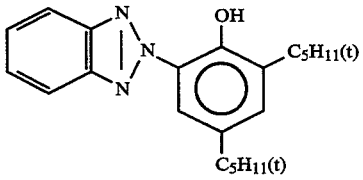
UV absorber (UV-2)
1:2:2 mixture (weight ratio) of
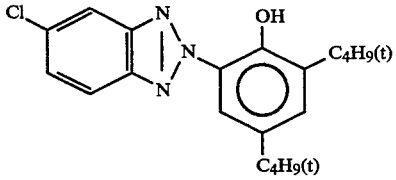
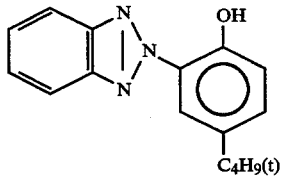

-continued and

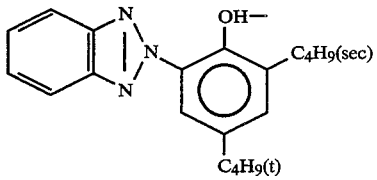

Solvent (Solv-1)

$C_8H_{17}CH(O)CH(CH_2)_7COOC_8H_{17}$

Solvent (Solv-2)

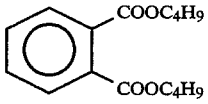

Solvent (Solv-3)

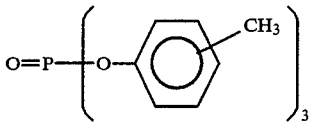

Solvent (Solv-4)

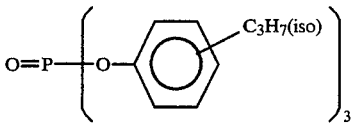

Solvent (Solv-5)

$O{=}P{-}(OCH_2CH(C_2H_5)C_4H_9^{(n)})_3$

Solvent (Solv-6)

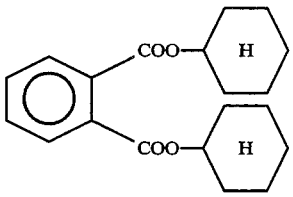

Solvent (Solv-7)

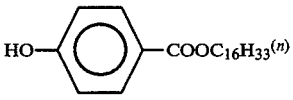

First, Sample 201 was subjected to a grey exposure with a densitometer (FWH type manufactured by Fuji Photo Film Co., Ltd., a color temperature of a light source: 3200° K) so that about 30% of a coated silver amount was developed.

The exposed samples were subjected to a continuous processing at the following steps with a paper processing machine in the following processing solutions until a running equilibrium status was reached in a developing processing.

| Processing step | Temperature | Time | Replenishing solution* | Tank capacity |
|---|---|---|---|---|
| Color | 35° C. | 45 seconds | 161 ml | 17 liter |

-continued

| Processing step | Temperature | Time | Replenishing solution* | Tank capacity |
|---|---|---|---|---|
| developing | | | | |
| Bleach/fixing | 30 to 35° C. | 45 seconds | 215 ml | 17 liter |
| Rinsing | 30° C. | 90 seconds | 350 ml | 10 liter |
| Drying | 70 to 80° C. | 60 seconds | | |

*Replenishing amount is per meter of the light-sensitive material.

The compositions of the respective processing solutions are as follows:

| | Tank solution | Replenishing solution |
|---|---|---|
| Color developing solution | | |
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-bis(carboxymethyl) hydrazine | 4.0 g | 5.0 g |
| Sodium N,N-di(sulfoethyl) hydroxylamine | 4.0 g | 5.0 g |
| Fluorescent whitening agent (Whitex 4B manufactured by Sumitomo Chem. Ind.) | 1.0 g | 2.0 g |
| Water was added to | 1000 ml | 1000 ml |
| pH (25° C.) | 10.05 | 10.45 |
| Bleach/fixing solution | | |
| (the tank solution and replenishing solution are common) | | |
| Water | 400 ml | |
| Ammonium thiosulfate (700 g/liter) | 100 ml | |
| Sodium sulfite | 17 g | |
| Iron (III) ammonium ethylenediaminetetracetate | 55 g | |
| Disodium ethylenediaminetetracetate | 5 g | |
| Ammonium bromide | 40 g | |
| Water was added to | 1000 ml | |
| pH (25° C.) | 6.0 | |
| Rinsing solution | | |
| (the tank solution and replenishing solution are common) | | |
| Deionized water (contents of calcium and magnesium: each 3 ppm or lower) | | |

Next, the samples were prepared in the same manner as Sample 201 except that the cyan coupler (ExC) contained in the fifth layer of Sample 201 was replaced with the equimolar comparative couplers shown in Example 1 or couplers of the present invention, wherein the anti-fading agents shown in Tables 6 and 7 were added in the amount of 50% by weight based on the amount of the coupler.

After exposing through a three colors separation filter, these samples were subjected to a processing in the above running processing solutions and then to a measurement of a density with a red light.

Next, after these samples were subjected to a fading test under the irradiation of a xenon light (an intermittent irradiation every 12 hours with the other 12 hours in a dark condition) for 7 days, they were subjected once again to the measurement of the density with a red light to evaluate a dye image residual rate (%) at the initial density of 1.5.

Further, another samples, which were stored at 60° C. and 70 % RH for two months, were to the measurement of the dye image residual rate as well as the above.

These results are summarized in Tables 6 and 7.

TABLE 6

| Sample No. | Cyan Coupler | Anti-fading agent | Dmax | Light fading (Residual rate) | Dark fading (Residual rate) |
|---|---|---|---|---|---|
| 201 (Comp.) | R-2 | — | 2.18 | 17 | 21 |
| 202 (Comp.) | R-2 | A-2 | 2.07 | 34 | 36 |
| 203 (Comp.) | R-2 | A-8 | 2.10 | 26 | 33 |
| 204 (Comp.) | R-2 | A-13 | 2.09 | 27 | 32 |
| 205 (Comp.) | R-2 | A-30 | 2.02 | 24 | 29 |
| 206 (Comp.) | R-2 | A-32 | 2.06 | 30 | 28 |
| 207 (Comp.) | R-2 | A-33 | 2.11 | 28 | 31 |
| 208 (Comp.) | R-2 | A-36 | 2.12 | 25 | 30 |
| 209 (Comp.) | R-2 | A-44 | 2.08 | 22 | 27 |
| 210 (Comp.) | R-2 | A-53 | 2.07 | 26 | 29 |
| 211 (Comp.) | R-2 | A-57 | 2.06 | 27 | 31 |
| 212 (Comp.) | R-2 | A-69 | 2.02 | 28 | 30 |
| 213 (Comp.) | R-2 | A-74 | 2.11 | 22 | 31 |
| 214 (Comp.) | R-3 | — | 2.26 | 25 | 27 |
| 215 (Comp.) | R-3 | A-2 | 2.19 | 38 | 39 |
| 216 (Comp.) | R-3 | A-8 | 2.18 | 33 | 37 |
| 217 (Comp.) | R-3 | A-13 | 2.11 | 31 | 35 |
| 218 (Comp.) | R-3 | A-30 | 2.16 | 33 | 34 |
| 219 (Comp.) | R-3 | A-32 | 2.12 | 38 | 36 |
| 220 (Comp.) | R-3 | A-33 | 2.20 | 30 | 31 |
| 221 (Comp.) | R-3 | A-36 | 2.21 | 37 | 38 |
| 222 (Comp.) | R-3 | A-44 | 2.13 | 32 | 32 |
| 223 (Comp.) | R-3 | A-53 | 2.17 | 29 | 35 |
| 224 (Comp.) | R-3 | A-57 | 2.16 | 36 | 38 |
| 225 (Comp.) | R-3 | A-69 | 2.09 | 31 | 36 |
| 226 (Comp.) | R-3 | A-74 | 2.18 | 30 | 33 |

TABLE 7

| Sample No. | Cyan Coupler | Anti-fading agent | Dmax | Light fading (Residual rate) | Dark fading (Residual rate) |
|---|---|---|---|---|---|
| 227 (Comp.) | (3) | — | 2.46 | 35 | 55 |
| 228 (Inv.) | (3) | A-2 | 2.44 | 83 | 82 |
| 229 (Inv.) | (3) | A-8 | 2.45 | 86 | 80 |
| 230 (Inv.) | (3) | A-13 | 2.44 | 82 | 83 |
| 231 (Inv.) | (3) | A-30 | 2.46 | 78 | 81 |
| 232 (Inv.) | (3) | A-32 | 2.42 | 84 | 79 |
| 233 (Inv.) | (3) | A-33 | 2.44 | 85 | 84 |
| 234 (Inv.) | (3) | A-36 | 2.43 | 82 | 86 |
| 235 (Inv.) | (3) | A-44 | 2.45 | 80 | 81 |
| 236 (Inv.) | (3) | A-53 | 2.45 | 81 | 82 |
| 237 (Inv.) | (3) | A-57 | 2.41 | 79 | 83 |
| 238 (Inv.) | (3) | A-69 | 2.42 | 83 | 78 |
| 239 (Inv.) | (3) | A-74 | 2.40 | 76 | 75 |
| 240 (Comp.) | (39) | — | 2.42 | 42 | 58 |
| 241 (Inv.) | (39) | A-2 | 2.42 | 86 | 85 |
| 242 (Inv.) | (39) | A-8 | 2.39 | 88 | 87 |
| 243 (Inv.) | (39) | A-13 | 2.38 | 83 | 83 |
| 244 (Inv.) | (39) | A-30 | 2.40 | 82 | 80 |
| 245 (Inv.) | (39) | A-32 | 2.37 | 79 | 78 |
| 246 (Inv.) | (39) | A-33 | 2.39 | 78 | 79 |
| 247 (Inv.) | (39) | A-36 | 2.40 | 81 | 81 |
| 248 (Inv.) | (39) | A-44 | 2.39 | 80 | 82 |
| 249 (Inv.) | (39) | A-53 | 2.38 | 75 | 74 |
| 250 (Inv.) | (39) | A-57 | 2.39 | 83 | 78 |
| 251 (Inv.) | (39) | A-69 | 2.38 | 81 | 83 |
| 252 (Inv.) | (39) | A-74 | 2.36 | 72 | 72 |

The results shown in Tables 6 and 7 illustrate that the anti-fading agents of the present invention used in combination with the couplers of the present invention provide the marked improvement effects.

It also was visually confirmed that the dye images formed with the couplers of the present invention gave the brilliant cyan colors.

EXAMPLE 3

The samples were prepared and evaluated in the same manners as Example 2, except that the yellow coupler (ExY) was replaced with following yellow couplers ExY-1 and ExY-2, wherein the coated amounts of the yellow couplers and silver halides were 80 mole % of those in Example 2.

ExY-1

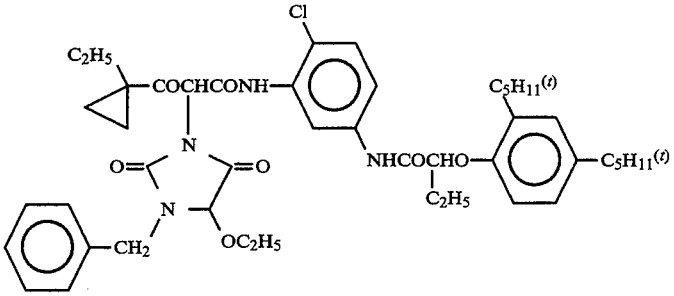

ExY-2

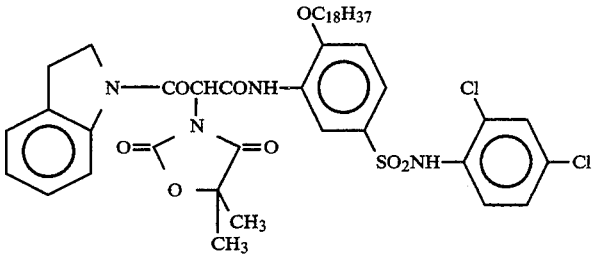

The same results as those obtained in Example 2 were obtained as well in this example.

EXAMPLE 4

The samples were prepared in the same manner as that in JP-A-3-213853 except that EX-2 contained in the third, fourth and fifth layers of the multi-layered color light-sensitive material Sample 101 prepared in Example 1 of JP-A-3-213853 was replaced with the cyan couplers of the invention shown Example 2 of the present invention and further that the anti-fading agents of the invention shown in Example 2 of the present invention were added in the amount of 20% by weight based on the amount of the coupler. They were subjected to the processing No. 1-6 in Example 1 of JP-A-3-213853.

These samples were subjected as well to a fading evaluation by the method according to that of Example 2 of the present invention (a light fading: exposed to a fluorescent lump for 7 days, and a dark fading: stored at 60° C. and 70% RH for one month). Near identical results were obtained as well in this case.

Further, the samples, which were prepared by replacing ExY-1 and ExY-2 with following equimolar ExY-3 and ExY-4, were evaluated in the same manner. Near identical results were obtained as well in this case.

ExY-3

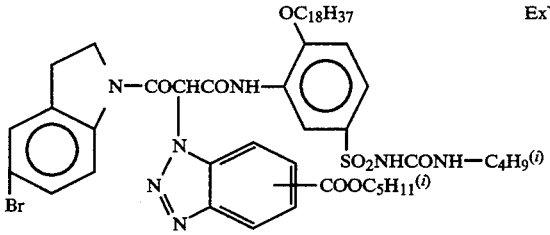

-continued

ExY-4

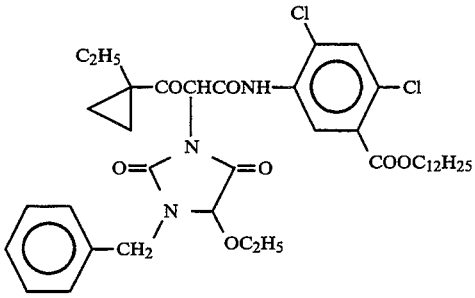

EXAMPLE 5

The samples were prepared in the same manner as that in JP-A-2-854 except that the cyan couplers C-1, C-2, C-6 and C-8 contained in the third, fourth and fifth layers of Sample 101 prepared in Example 1 of JP-A-2-854 was replaced with the equimolar cyan couplers of the invention shown in Example 2 of the present invention and further that the anti-fading agents of the invention shown in Example 2 of the present invention were added in the amount of 25% by weight based on the amount of the coupler. They were subjected to the processing described in Example 1 of JP-A-2-854.

These samples were subjected as well to the evaluation of a fading in the same manner as Example 2 of the present invention. Near identical results were obtained as well in this case.

EXAMPLE 6

The samples were prepared in the same manner as that of the color photographic light-sensitive material described in Example 2 of JP-A-l-158431 except that ExC-1 and ExC-2 contained in the third and fourth layers of the color photographic light-sensitive material in Example 2 of JP-A-l-158431 were replaced with the equimolar couplers (1), (2), (16), (17), (21) and (39) of the present invention and further that the compounds A-1, A-2, A-8, A-13, A-30, A-32, A-33, A-36, A-44, A-53, A-57, and A-74 of the present invention, represented by formula (A), were added to the third and fourth layers by the same weight % as those of the couplers.

Further, the samples were prepared in the same manner as the above samples except that the magenta coupler ExM-1 or ExM-2 contained in the sixth or seventh layer was replaced with equimolar ExM-3 and that the yellow coupler ExY-1 contained in the eleventh or twelfth layer was replaced with equimolar ExY-5 or ExY-1 or ExY-2 shown in Example 3 of the present invention.

ExM-3

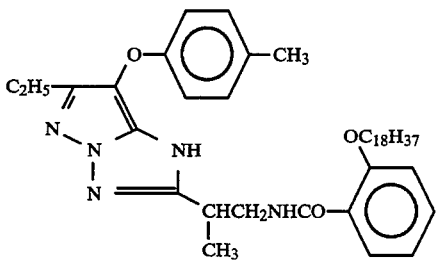

ExY-5

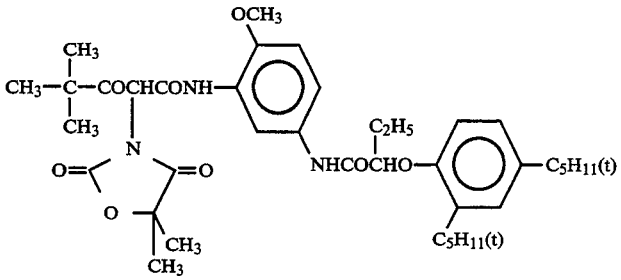

These samples were subjected to the exposure and development processing in the same manner as that described in Example 2 of JP-A-l-158431, and the fading and photographic properties were measured to find that the samples of the present invention demonstrated an excellent anti-fading effect and had the good photographic properties and hue.

It was found that the compounds of the present invention provided the excellent effects as well in a series of these light-sensitive materials.

The silver halide color photographic light-sensitive material in which the pyrrolotriazole type cyan coupler of the invention represented by formula (I) or (II) and the compound of the invention represented by formula (A) are used in combination shows an excellent image fastness and has superior photographic properties and hue as well.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having provided thereon at least one red-sensitive silver halide emulsion layer comprising (a) a cyan dye-forming coupler represented by the following formulas (I-a) or (II-a):

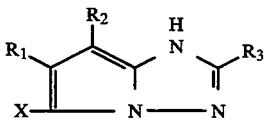

(I-a)

-continued

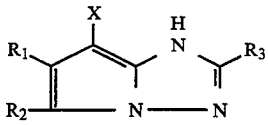

(II-a)

wherein $R_1$ and $R_2$ each are an electron attractive group having a Hammett's substituent constant $\sigma_p$ of 0.20 or more and the sum of the $\sigma_p$ values of $R_1$ and $R_2$ is 0.65 or more;

$R_3$ represents a hydrogen atom or a substituent;

X represents a hydrogen atom or a group capable of splitting off upon a reaction with an oxidation product of an aromatic primary amine color developing agent; and the group represented by $R_1$, $R_2$, $R_3$ or X may become a divalent group and combine with a monomer higher than a dimer and a high molecular weight chain to form a homopolymer or a copolymer; and (b) a compound represented by the following formula (A):

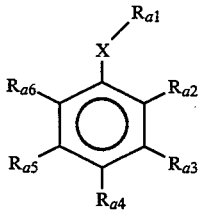

(A)

wherein $R_{a1}$ represents an aliphatic group, an aromatic group, a heterocyclic group, —Si($R_{a7}$) ($R_{a8}$($R_{a9}$), —CO($R_{a10}$), —$SO_2$($R_{a11}$), or —P(O)$_n$($R_{a12}$) ($R_{a13}$);

$R_{a2}$, $R_{a3}$, $R_{a4}$, $R_{a5}$ and $R_{a6}$ may be the same or different and each represent a hydrogen atom, —X'—$R_{a1}$, an aliphatic group, an aromatic group, a heterocyclic group, an aliphatic oxycarbonyl group, an aromatic oxycarbonyl group, a halogen atom, an acyl group, a sulfonyl group, a carbamoyl group, a sulfamoyl group, a cyano group, a nitro group, a sulfo group, or a carboxyl group;

—X—represents —O— or —N($R_{a1}'$)—;

—X'— represents —O—, —S— or —N($R_{a1}$)—;

$R_{a7}$, $R_{a8}$ and $R_{a9}$ may be the same or different and each represent an aliphatic group, an aromatic group, an aliphatic oxy group, or an aromatic oxy group;

$R_{a10}$ and $R_{a11}$ each represent an aliphatic group, an aromatic group, an aliphatic amino group, or an aromatic amino group;

$R_{a12}$ and $R_{a13}$ may be the same or different and each represent an aliphatic group, an aromatic group, an aliphatic oxy group, or an aromatic oxy group;

n represents 0 or 1; and $R_{a1}'$ represents a hydrogen atom or a group defined for $R_{a1}$; of the respective groups of —X—$R_{a1}$ and $R_{a2}$ to $R_{a6}$, the groups located in an ortho position to each other may be combined to form a 5 to 8-membered ring;

and where —X— or —X'— is —N($R_{a1}'$)—, $R_{a1}$ and $R_{a1}'$ may be combined with each together to form a 5 to 8- membered ring.

2. The silver halide color photographic light-sensitive material as in claim 1, wherein $R_3$ is an alkyl group, an aryl group, a heterocyclic group, a cyano group, a nitro group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclicoxy group, an acyloxy group, a carbamoyloxy group, an aryloxycarbonylamino group, an imido group, a heterocyclic thio group, a sulfinyl group, a phosphonyl group, an aryloxycarbonyl group, an acyl group, or an azolyl group.

3. The silver halide color photographic light-sensitive material as in claim 2, wherein $R_3$ is an alkyl group or an aryl group.

4. The silver halide color photographic light-sensitive material as in claim 1, wherein $R_1$ and $R_2$ each are an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkyl-sulfinyl group, an arylsulfinyl group, an alkylsulfonyl group, an arylsulfonyl group, a sulfonyloxy group, an acylthio group, a sulfamoyl group, a thiocyanato group, a thiocarbonyl group, a halogenated alkyl group, a halogenated alkoxy group, a halogenated aryloxy group, a halogenated alkylamino group, a halogenated alkylthio group, an aryl group substituted with the other electron attractive group having $\sigma_p$ of 0.20 or more, a heterocyclic group, a halogen atom, an azo group, or a selenocyanato group and the sum of the $\sigma_p$ values of $R_l$ and $R_z$ is 0.65 or more.

5. The silver halide color photographic light-sensitive material as in claim 4, wherein $R_1$ and R2 each are an acyl group, an acyloxy group, a carbamoyl group, an alkoxycarbonyl group, an aryloxy-carbonyl group, a cyano group, a nitro group, an alkylsulfinyl group, an arylsulfinyl group, an alkyl-sulfonyl group, an arylsulfonyl group, a sulfamoyl group, a halogenated alkyl group, a halogenated alkoxy group, a halogenated alkylthio group, a halogenated aryloxy group, an aryl group substituted with the other electron attractive group having $\sigma_p$ of 0.20 or more, or a heterocyclic group and the sum of the $\sigma_p$ values of $R_1$ and $R_2$ is 0.65 or more.

6. The silver halide color photographic light-sensitive material as in claim 5, wherein $R_1$ and $R_2$ each are an alkoxycarbonyl group, a nitro group, a cyano group, an arylsulfonyl group, a carbamoyl group, or a halogenated alkyl group and the sum of the $\sigma_p$ values of $R_1$ and $R_2$ is 0.65 or more.

7. The silver halide color photographic light-sensitive material as in claim 1, wherein X in formula (I-a) and (II-a) is a hydrogen atom, a halogen atom, an alkoxy group, an aryloxy group, an acyloxy group, an alkyl or arylsulfonyloxy group, an acylamino group, an alkyl or arylsulfonamido group, an alkoxycarbonyloxy group, an aryloxycarbonyloxy group, an alkyl, aryl or heterocyclic thio group, a carbamoylaminio group, a 5-membered or 6-membered nitrogen-containing heterocyclic group, an imido group, or an arylazo group.

8. The silver halide color photographic light-sensitive material as in claim 7, wherein X in formula (I-a) and (II-a) is a halogen atom, an alkoxy group, an aryloxy group, an alkyl or arylthio group, or a 5-membered or 6-membered nitrogen-containing heterocyclic group bonded to a coupling active site via the nitrogen atom.

9. The silver halide color photographic light-sensitive material as in claim 8, wherein X in formula (I-a) and (II-a) is a halogen atom, or an alkyl or alkylthio group.

10. The silver halide color photographic light-sensitive material as in claim 1, wherein in formula (A), at least one of $R_{a2}$ to $R_{a6}$ is —X'—$R_{a1}$.

11. The silver halide color photographic light-sensitive material as in claim 1, wherein in formula (A), —X— is —O— and $R_{a1}$ is —P(O) ($R_{a12}$) ($R_{a13}$).

12. The silver halide color photographic light-sensitive material as in claim 1, wherein the amount of formula (A) in the material is 0.5 to 300 mole per mole of said cyan dye-forming coupler in the material.

13. The silver halide color photographic light-sensitive material as in claim 1, wherein said cyan dye-forming coupler is represented by the formula (I-a).

14. The silver halide color photographic light-sensitive material as in claim 1, wherein $R_1$ is a cyano group and $R_2$ is a branched alkoxycarbonyl group.

15. The silver halide color photographic light-sensitive material as in claim 1, wherein said compound of formula (A) is represented by the following formulas (A-I) to (A-XVII):

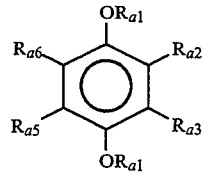

(A-I)

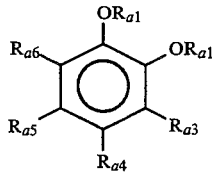

(A-II)

-continued
(A-III)
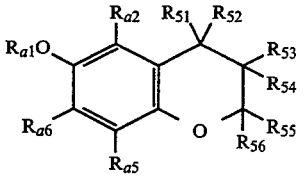
(A-IV)
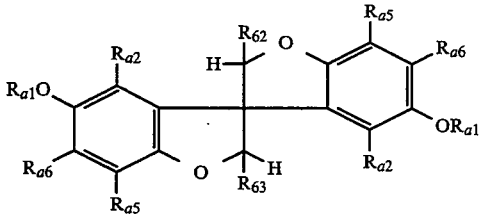
(A-V)
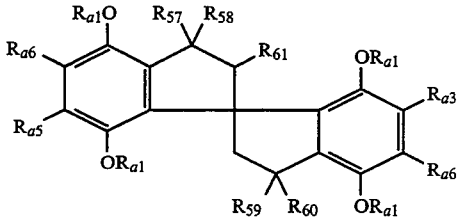
(A-VI)
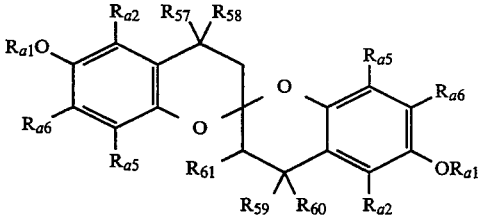
(A-VII)
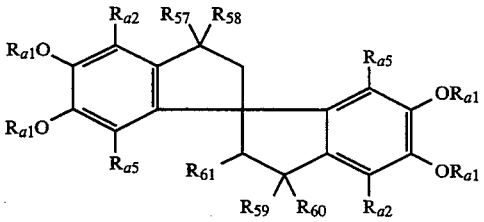
(A-VIII)
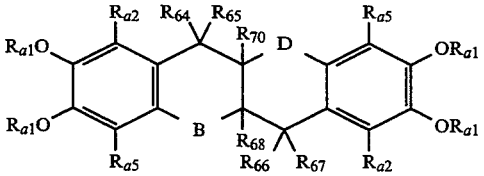
(A-IX)
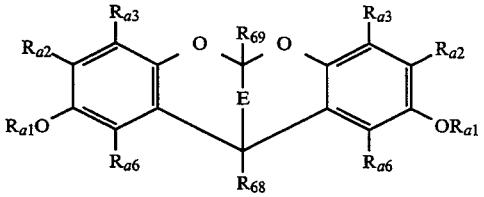
(A-X)
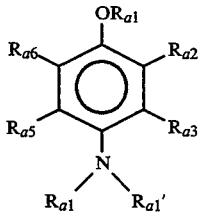
-continued
(A-XI)
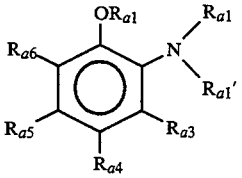
(A-XII)
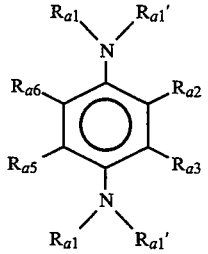
(A-XIII)
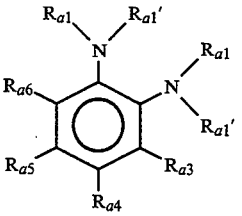
(A-XIV)
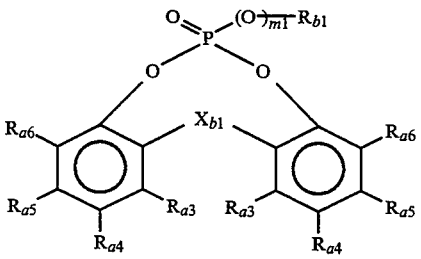
(A-XV)
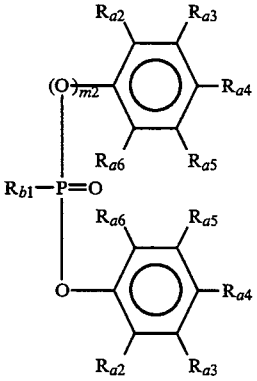
(A-XVI)
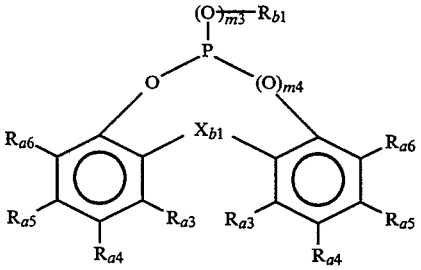

-continued (A-XVII)

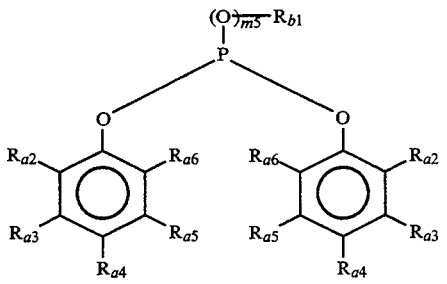

wherein $R_{a1}$ to $R_{a6}$ and $R_{a1}'$ each has the same meanings as defined for formula (A);

$R_{51}$ to $R_{69}$ may be the same or different and each represent a hydrogen atom, an alkyl group, or an aryl group;

$R_{54}$ and $R_{55}$ and $R_{55}$ and $R_{56}$ may be combined with each other to form a 5 to 7-membered hydrocarbon ring;

B and D each represent a single bond, —C($R_{70}$)($R_{71}$)— or —O— and E represents a single bond or —C($R_{70}$)($R_{71}$)—, wherein $R_{70}$ and $R_{71}$ may be the same or different and each represent a hydrogen atom, an alkyl group, or an aryl group;

$R_{b1}$ represents an aliphatic group, or an aromatic group;

$X_{b1}$ represents a single bond, a substituted or unsubstituted methylene group, —S—, —O—, —CO—, —N($R_{a1}'$)—, or —$SO_2$—; and $m_1$ to $m_5$ each represent 0 or 1.

16. The silver halide color photographic light-sensitive material as in claim 15, wherein said compound of formula (A) is represented by the formulas (A-I), (A-V), (A-VI), (A-VII), (A-VIII), (A-IX), (A-X), (A-XI), (A-XIV) or (A-XVI).

17. The silver halide color photographic light-sensitive material as in claim 1, wherein the content of said cyan dye-forming coupler is $1\times10^{-3}$ to 1 mole per mole of silver halide.

* * * * *